US012025127B2

(12) United States Patent
Choi et al.

(10) Patent No.: US 12,025,127 B2
(45) Date of Patent: Jul. 2, 2024

(54) SCROLL COMPRESSOR

(71) Applicant: LG Electronics Inc., Seoul (KR)

(72) Inventors: Jungsun Choi, Seoul (KR); Byungkil Yoo, Seoul (KR); Seheon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/991,228

(22) Filed: Nov. 21, 2022

(65) Prior Publication Data

US 2023/0213034 A1 Jul. 6, 2023

(30) Foreign Application Priority Data

Dec. 31, 2021 (KR) ..... 10-2021-0194544

(51) Int. Cl.

| | |
|---|---|
| ***F04C 18/02*** | (2006.01) |
| ***F01C 17/06*** | (2006.01) |
| ***F04C 29/00*** | (2006.01) |
| ***F04C 29/02*** | (2006.01) |

(52) U.S. Cl.

CPC ..... *F04C 18/0215* (2013.01); *F01C 17/066* (2013.01); *F04C 18/0253* (2013.01); *F04C 29/0042* (2013.01); *F04C 29/028* (2013.01)

(58) Field of Classification Search

None

See application file for complete search history.

(56) References Cited

U.S. PATENT DOCUMENTS 4,958,993 A * 9/1990 Fujio ..... F04C 18/0215 418/55.6
5,342,184 A * 8/1994 Comparin ..... F01C 1/0246 418/55.3
6,071,100 A 6/2000 Yamada et al.

(Continued)

FOREIGN PATENT DOCUMENTS

JP 62240491 A * 10/1987 ..... F01C 18/02
JP 02264173 A * 10/1990 ..... F01C 18/02

(Continued)

OTHER PUBLICATIONS

JP-2002349457-A, English Language Machine translation (Year: 2002).*

(Continued)

*Primary Examiner* — Wesley G Harris
(74) *Attorney, Agent, or Firm* — Fish & Richardson P.C.

(57) ABSTRACT

A scroll compressor includes a casing, a main frame, a rotating shaft, an orbiting scroll, a fixed scroll configured to engage the orbiting scroll to form a compression chamber, and an Oldham ring slidably coupled to the orbiting scroll to prevent rotation of the orbiting scroll. The Oldham ring includes: a ring body provided between the main frame and the orbiting scroll to be supported in an axial direction of the rotating shaft, and a key portion extending in the axial direction from the ring body and slidably inserted into a key accommodating portion provided in the orbiting scroll, the main frame, or the fixed scroll. The ring body or the key portion includes an oil supply passage for guiding oil accumulated in a member on which the ring body is supported to between the key portion and the key accommodating portion.

20 Claims, 42 Drawing Sheets

(56) References Cited

U.S. PATENT DOCUMENTS

| | | | | |
|---|---|---|---|---|
| 6,106,252 | A * | 8/2000 | Yamanaka | F01C 17/066 418/55.3 |
| 6,719,545 | B2 * | 4/2004 | Lizuka | F04C 27/005 418/152 |
| 2013/0164164 | A1 | 6/2013 | Adachi et al. | |

FOREIGN PATENT DOCUMENTS

| | | | | |
|---|---|---|---|---|
| JP | H08007041 | | 2/1996 | |
| JP | 2002349457 | A * | 12/2002 | F01C 17/066 |
| JP | 2012188976 | | 10/2012 | |
| KR | 20050043485 | | 5/2005 | |
| KR | 100547319 | | 1/2006 | |
| KR | 20210101491 | | 8/2021 | |

OTHER PUBLICATIONS

Extended European Search Report in European Appln. No. 22200694.2, dated Jun. 2, 2023, 11 pages.

Korean Office Action in Korean Application No. 10-2021-0194544, dated Jan. 11, 2023, 16 pages (with machine translation).

* cited by examiner

SCROLL COMPRESSOR

CROSS-REFERENCE TO RELATED APPLICATION

Pursuant to 35 USC § 119 (a), this application claims the benefit of an earlier filing date and priority to Korean Application No. 10-2021-0194544, filed on Dec. 31, 2021, the contents of which are incorporated by reference herein in their entirety.

TECHNICAL FIELD

The present disclosure relates to a scroll compressor, and more particularly, to a scroll compressor having a structure that enables more active and direct oil fueling with an Oldham ring key.

BACKGROUND

A scroll compressor is configured such that an orbiting scroll and a non-orbiting scroll are engaged with each other and a pair of compression chambers is provided while the orbiting scroll performs an orbiting motion with respect to the non-orbiting scroll.

The compression chamber includes a suction pressure chamber formed in an outer side, an intermediate pressure chamber continuously formed toward a central portion from the suction pressure chamber while gradually decreasing in volume, and a discharge pressure chamber connected to the center of the intermediate pressure chamber. Typically, the suction pressure chamber is provided through a side surface of a non-orbiting scroll, the intermediate pressure chamber is sealed, and the discharge pressure chamber is provided through an end plate of the non-orbiting scroll.

Meanwhile, scroll compressors may be classified into a low-pressure type and a high-pressure type according to a path through which a refrigerant is suctioned. The low-pressure type is configured such that a refrigerant suction pipe is connected to an internal space of a casing to guide a suction refrigerant of a low temperature to flow into a suction pressure chamber via the internal space of the casing. Meanwhile the high-pressure type is configured such that the refrigerant suction pipe is connected directly to the suction pressure chamber to guide a refrigerant to flow directly into the suction pressure chamber without passing through the internal space of the casing.

Meanwhile, the scroll compressor may include an anti-rotation member that prevents a scroll (e.g., an orbiting scroll) receiving rotational force from the driving motor from rotating with respect to another scroll (e.g., a fixed scroll) or a fixed frame facing each other.

As the anti-rotation member, an Oldham ring or a pin & ring is mainly known. The Oldham ring is more advantageous in terms of assembly compared to pin and ring. Recently, a technology for reducing the weight while securing necessary rigidity by using different materials of a ring body and a key constituting the Oldham ring has been introduced.

The Oldham ring part of the compressor is a part that prevents the orbiting scroll from rotating and generally has a structure in which the key of the Oldham ring is in contact with a groove of the main frame and the orbiting scroll.

Meanwhile, for lubrication of a contact portion of the Oldham ring, oil in an intermediate pressure space of the main frame should be delivered to a contact surface of the key. In order to improve an actual load efficiency of an air conditioner, it is required to expand an operating range to a low pressure ratio area, and in the low pressure ratio area, the oil supply amount in an intermediate pressure space of the main frame is reduced because the oil supply amount is reduced due to a differential pressure.

In some examples, an Oldham Ring oil supply structure of a scroll compressor may prevent wear of the Oldham ring by directly guiding oil to a sliding portion of a main frame and the Oldham ring, thereby preventing a deterioration of compressor efficiency in advance.

In addition, some compressors include a structure for storing oil by forming grooves on both sides of a key coupling groove of a main frame. In addition, a structure for forming a space for storing oil by forming grooves on both sides of the Oldham ring key is disclosed.

In these compressors, when the keyway of the main frame is located in a downward direction of the compressor to form a groove, it is advantageous for oil storage. In addition, this effect may also be achieved in the case of a horizontal compressor.

However, the scroll compressor of an upper compression structure currently being developed by the applicant has a structure that is disadvantageous to lubrication because a keyway of an orbiting scroll is located opposite to the direction in which oil flows. In addition, in order to operate in a low pressure ratio region, the amount of oil is insufficient in an intermediate pressure space where the keyway of the Oldham ring is located.

Therefore, in the conventional Oldham ring structure, it is required to develop a structure enabling more active and direct oil refueling with the key of the Oldham ring.

SUMMARY

Therefore, an aspect of the detailed description is to provide a scroll compressor having a structure enabling more active and direct oil refueling with a key of an Oldham ring in the Oldham ring structure.

Another aspect of the detailed description is to provide a scroll compressor having a structure capable of generating a flow path that may supply oil from bottom to top in a moving direction because it is difficult to supply oil to a key portion of an orbiting scroll when an oil storage amount in the Oldham ring space of a main frame is small.

Another aspect of the detailed description is to provide a scroll compressor having a structure that may solve the problem of insufficient oil amount in an intermediate pressure space where a keyway of the conventional Oldham ring is located by adding simple processing to the Oldham ring without additional parts.

Another aspect of the detailed description is to improve reliability by actively supplying oil to an Oldham ring and increasing a portion in contact with oil at each surface of an orbiting key in contact with an inner periphery of an orbiting keyway.

Another aspect of the detailed description is to apply an oil supply improvement structure at a key portion of an Oldham ring not only to a scroll compressor having an upper compression structure but also to a scroll compressor having a lower compression structure to improve a low pressure ratio oil supply.

Another aspect of the detailed description is to apply an oil supply improvement structure at a key portion of an Oldham ring not only to a two-way Oldham ring in which a key portion is provided on upper and lower surfaces of the Oldham ring but also to a one-way Oldham ring in which a key portion is entirely provided on an upper surface of the Oldham ring.

To achieve these and other advantages and in accordance with the purpose of this specification, as embodied and broadly described herein, a scroll compressor includes: a casing; a main frame provided inside the casing; a rotating shaft supported on the main frame; an orbiting scroll coupled to the rotating shaft and supported by the main frame; a fixed scroll fixed to the main frame and engaged with the orbiting scroll to form a compression chamber; and an Oldham ring slidably coupled to the orbiting scroll to prevent rotation of the orbiting scroll, wherein the Oldham ring includes: a ring body having an annular shape and is provided between the main frame and the orbiting scroll to be supported in an axial direction of the rotating shaft; and a key portion extending in the axial direction from the ring body and slidably inserted into a key accommodating portion provided in the orbiting scroll, the main frame, or the fixed scroll, wherein the ring body or the key portion includes an oil supply passage for guiding oil accumulated in a member on which the ring body is supported to between the key portion and the key accommodating portion.

For this reason, in the scroll compressor of the present disclosure, since oil is more smoothly supplied to the key portion according to movement of the Oldham ring, reliability may be improved.

According to an example related to the present disclosure, the oil supply passage may be an oil supply groove formed in at least one side surface of the key portion or at least one side surface of the key accommodating portion facing the at least one side surface of the key portion.

The oil supply groove may be provided in at least one of an outer surface provided in a circumferential direction of the key portion and an inner surface provided in a circumferential direction of the key portion.

In addition, the oil supply groove may be provided on both sides of the key portion provided between the outer surface of the key portion provided in the circumferential direction and the inner surface of the key portion provided in the circumferential direction.

Such a structure may be advantageous in moving the oil accumulated on the inner and outer periphery of the Oldham ring upward through the oil supply groove in the Oldham ring.

The oil supply groove may have a multi-stage structure in which a plurality of oil supply grooves are spaced apart from each other on each of the both sides.

Preferably, side oil supply grooves disposed at a front with respect to a rotational direction of the rotating shaft, among the both sides of the rotating shaft in the rotational direction may have a greater number or greater width than side oil supply grooves disposed at a rear with respect to the rotational direction of the rotating shaft.

For this reason, since a large amount of oil flows relatively to the side of the orbiting key disposed at the front with respect to the rotational direction of the rotating shaft, a structure more advantageous for oil supply may be provided.

The oil supply groove may be configured to be inclined, and the inclined oil supply groove may have an outer periphery of the Oldham ring as a lower end and an inner periphery of the Oldham ring as an upper end.

For this reason, as the supply of oil to the upper surface of the ring body is induced, oil to the inclined groove formed in an up-down direction on the inner periphery of the orbiting keyway of the orbiting scroll is more actively supplied, and a portion in contact with oil in each surface of the orbiting key in contact with the inner periphery of the orbiting keyway may increase, thereby improving reliability.

The oil supply groove may be provided so that a plurality of oil supply grooves cross each other on each of the both sides.

The oil supply groove may be provided only on the inner surface provided in the circumferential direction of the key portion.

The oil supply groove may be parallel to an extending direction of the rotating shaft.

The oil supply groove may be further provided in a radial direction.

Due to the structure in which the oil supply groove is provided in the radial direction, the oil may be advantageously retained oil in the key portion of the Oldham ring, while flowing upward.

Preferably, the oil supply groove may be provided on at least one side surface of the key accommodating portion, the oil supply groove may be configured to be inclined, an outer peripheral side of the Oldham ring may be a lower end, and an inner peripheral side of the Oldham ring may be an upper end.

For this reason, as the supply of oil to the upper surface of the ring body is induced, oil to the inclined groove formed in an up-down direction on the inner periphery of the orbiting keyway of the orbiting scroll is more actively supplied, and a portion in contact with oil in each surface of the orbiting key in contact with the inner periphery of the orbiting keyway may increase, thereby improving reliability.

The oil supply groove may be provided on at least one side surface of the key accommodating portion, and the oil supply groove may be provided in a radial direction.

Due to the structure in which the oil supply groove is provided in the radial direction, the oil may be advantageously retained oil in the key portion of the Oldham ring, while flowing upward.

According to another example related to the present disclosure, the oil supply passage may be an oil supply hole passing through a surface connected to at least one of both side surfaces of the key portion in the ring body.

The oil supply hole may be configured to pass through both surfaces connected to each of two side surfaces of the key portion.

Both sides of the oil supply hole may have the same diameter.

In addition, the oil supply hole disposed at the front side of the rotating shaft in the rotational direction may have a larger diameter than the oil supply hole disposed at the rear side.

For this reason, since a large amount of oil flows relatively to the side of the orbiting key disposed at the front with respect to the rotational direction of the rotating shaft, a structure more advantageous for oil supply may be provided.

The oil supply hole may be provided only on one of both side surfaces of the key portion, and the oil supply hole may pass through a surface connected to one side surface of the key portion provided at the front side of the rotating shaft in the rotational direction.

The oil supply hole may be inclined in a circumferential direction.

The oil supply hole may be inclined in a radial direction.

According to another example related to the present disclosure, the oil supply passage may be an oil supply surface portion protruding in a radial direction from at least one of the inner periphery and the outer periphery of the ring body and having an inclined surface.

In addition, oil supply grooves may be provided on both side surfaces between an outer surface of the key portion provided in the circumferential direction and an inner surface of the key portion provided in the circumferential direction, the key portion may include a protruding side portion protruding radially from at least one of the outer periphery and the inner periphery of the ring body and connected to the oil supply surface portion, and a lower end of the oil supply groove may be connected to an upper portion of the inclined surface.

For this reason, the oil rising on the inclined surface of the oil supply surface portion may be more promoted to rise to an upper portion of the orbiting key of the oil through the oil supply groove extending to the protruding side portion.

In addition, by the oil supply surface having an inclined surface, the oil accommodated in the Oldham ring accommodating portion of the main frame at the lower portion of the Oldham ring may flow upward from the outer periphery of the ring body on the inclined surface, thereby inducing the supply of oil to the upper surface of the ring body.

In a top compression type scroll compressor of the present disclosure, the orbiting scroll and the fixed scroll may be provided in an upper portion of the casing, the main frame may be disposed on the opposite side of the orbiting scroll with the Oldham ring interposed therebetween, the key accommodating portion may include an orbiting key accommodating portion configured on one surface of the orbiting scroll; and a main key accommodating portion configured on one surface of the main frame, and the key portion may include an orbiting key slidably inserted into the orbiting key accommodating portion on an upper surface of the ring body, and a main key slidably inserted into the main key accommodating portion on a lower surface of the ring body.

In a bottom compression type scroll compressor of the present disclosure, the orbiting scroll and the fixed scroll may be provided below the rotating shaft, the main frame may be disposed on an upper surface of the orbiting scroll and disposed on the opposite side of the orbiting scroll with the Oldham ring interposed therebetween, the key accommodating portion may include a main key accommodating portion configured on one surface of the main frame and an orbiting key accommodating portion configured on one surface of the orbiting scroll, and the key portion may include a main key slidably inserted into the main key accommodating portion on an upper surface of the ring body and an orbiting key slidably inserted into the orbiting key accommodating portion on a lower surface of the ring body.

In a scroll compressor of the present disclosure, which is a top compression type and includes a one-way Oldham ring, the orbiting scroll and the fixed scroll may be provided in an upper portion of the casing, the main frame may be disposed on the opposite side of the orbiting scroll with the Oldham ring interposed therebetween, the key accommodating portion may include an orbiting key accommodating portion configured on one surface of the orbiting scroll; and a fixed key accommodating portion configured on one surface of the fixed frame, and the key portion may include an orbiting key slidably inserted into the orbiting key accommodating portion on an upper surface of the ring body, and a fixed key disposed to be spaced apart from the orbiting key on an upper surface of the ring body and slidably inserted into the fixed key accommodating portion.

DETAILED DESCRIPTION

Figure 1:
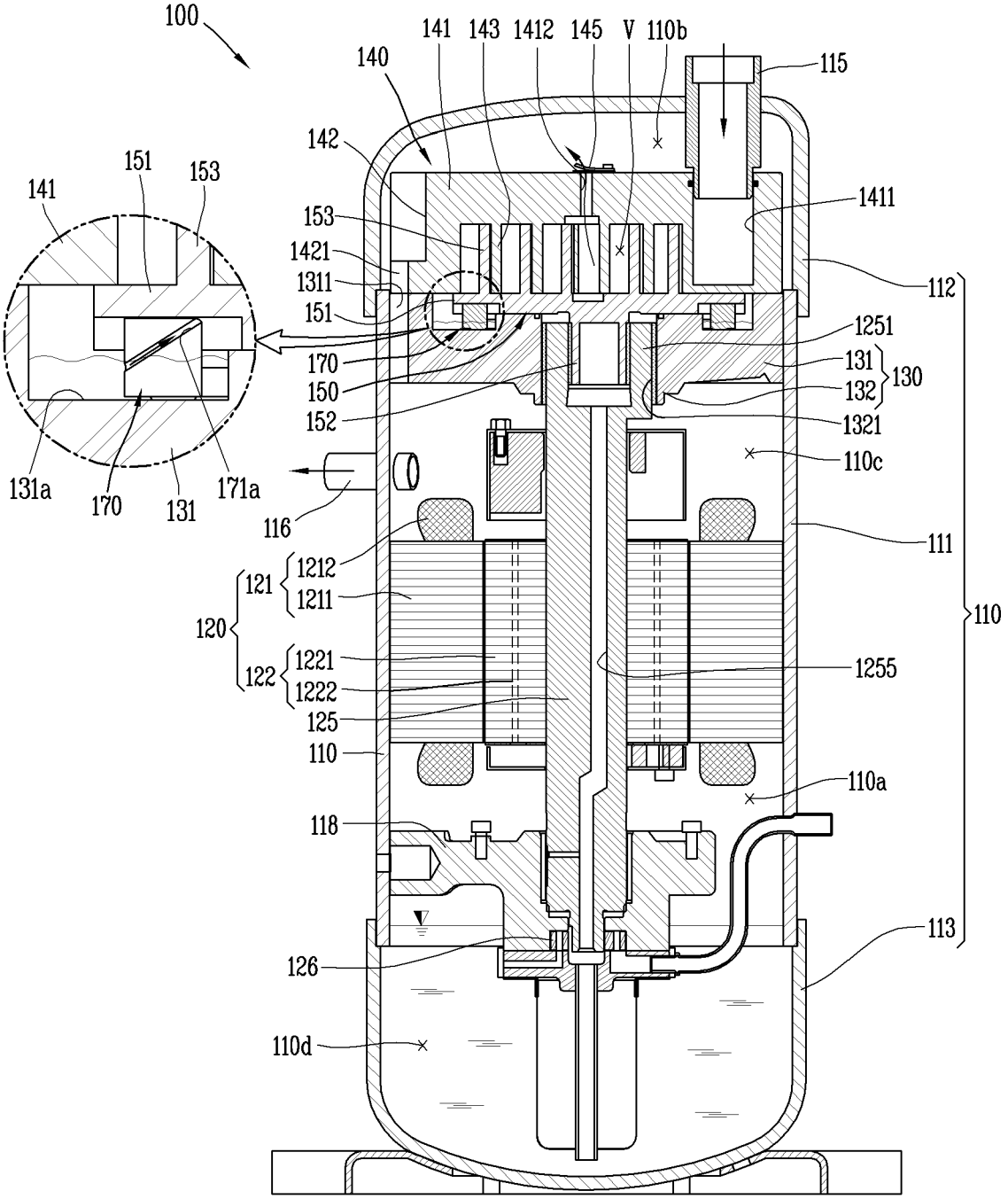
FIG. 1 is a cross-sectional view showing a top compression type scroll compressor of the present disclosure.

Hereinafter, scroll compressors 100 and 200 according to the present disclosure will be described in more detail with reference to the drawings.

In the present specification, the same or similar reference numerals are given to the same or similar components in different embodiments, and a redundant description thereof will be omitted.

Also, a structure applied to one embodiment may be equally applied to another embodiment as long as there is no structural and functional contradiction in the different embodiments.

A singular representation may include a plural representation unless it represents a definitely different meaning from the context.

In describing the present disclosure, if a detailed explanation for a related known function or construction is considered to unnecessarily divert the gist of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

The present disclosure is to provide a scroll compressor 100, 200, and 300 having a structure that enables more active and direct oil supply with a key of the Oldham ring 170 in the structure of the Oldham ring 170, and may be applied to top compression type scroll compressors 100 and 300 and a bottom compression type scroll compressor 200.

Hereinafter, among the scroll compressors 100, 200, and 300 of the present disclosure, a top compression type scroll compressor 100 in which a compression unit is disposed above the driving motor 120 and a key portion of the Oldham ring 170 is provided on an upper surface and a lower surface will be described first.

Figure 2:
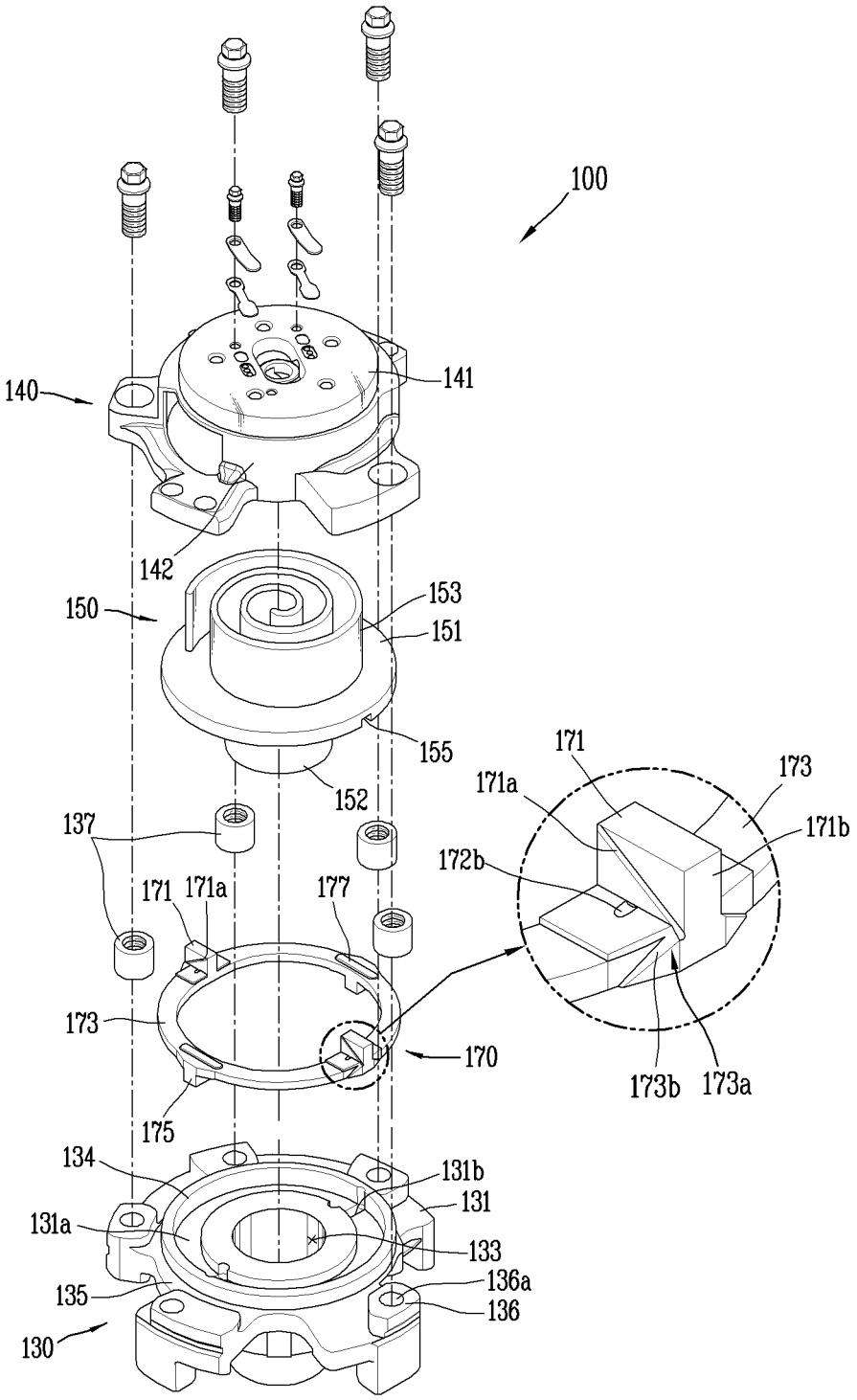
FIG. 2 is an exploded perspective view of a compression unit of FIG. 1.
Figure 3:
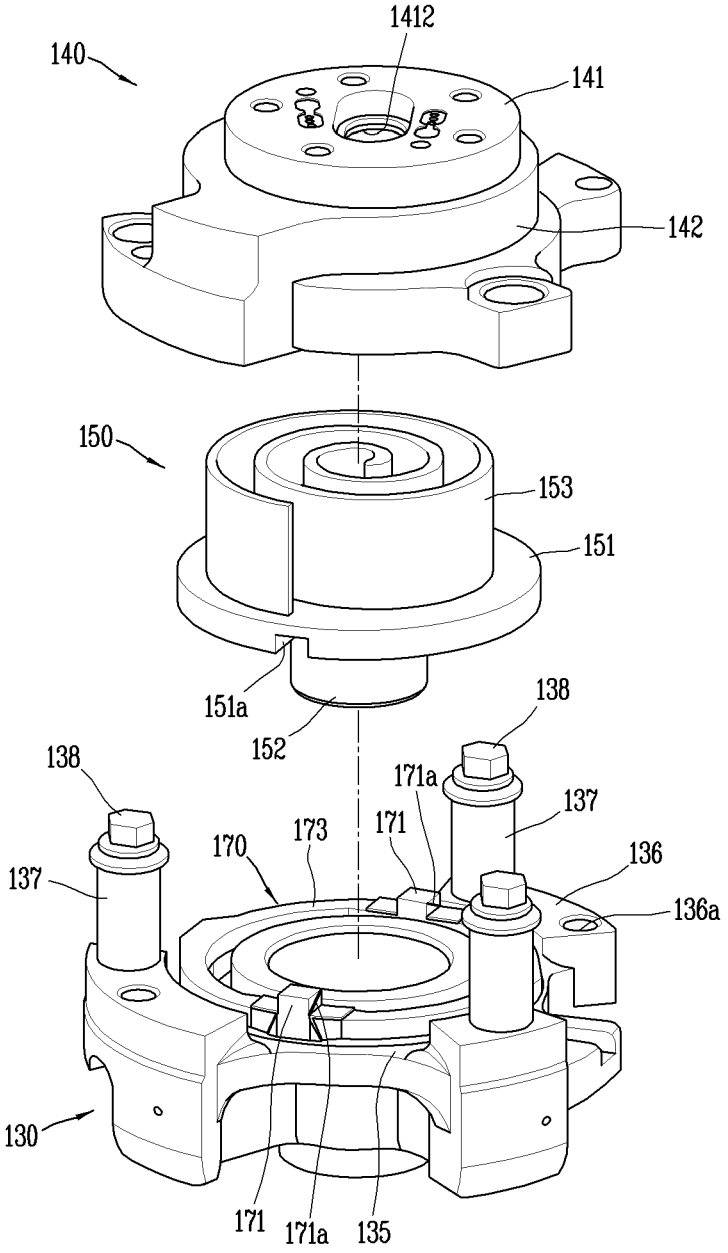
FIG. 3 is an exploded perspective view illustrating an example in which an Oldham ring is installed on a main frame.
Figure 4:
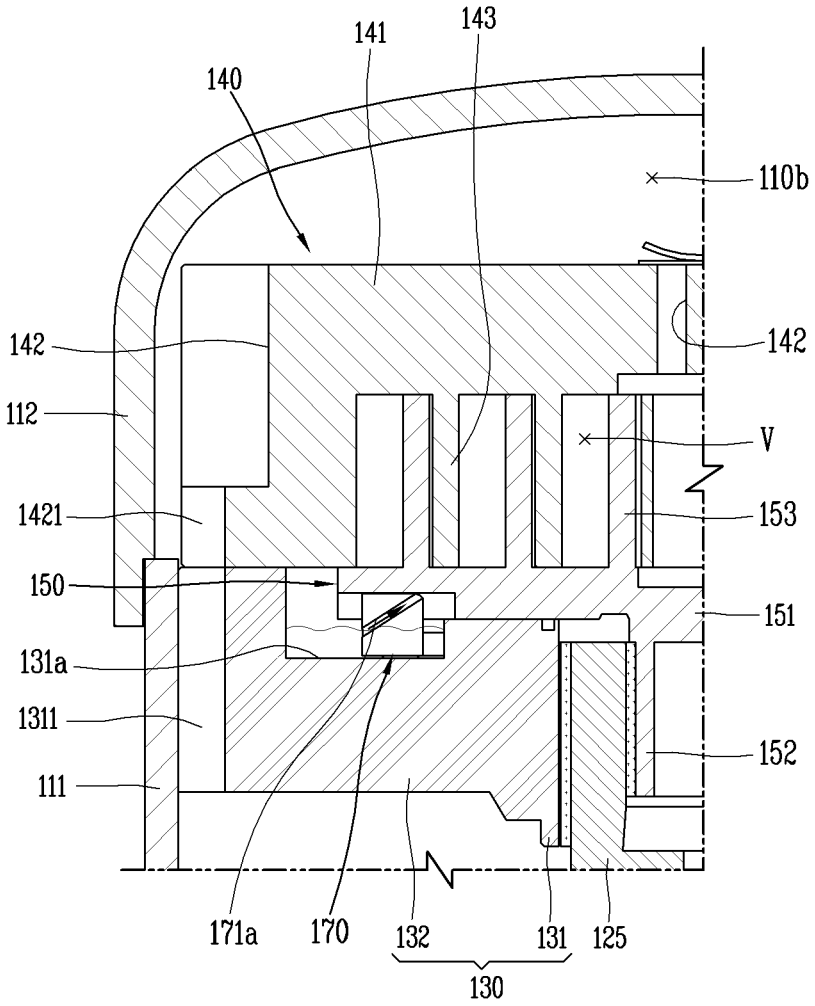
FIG. 4 is an enlarged cross-sectional view of a portion in which an Oldham ring is installed in the compression unit in FIG. 1.
Figure 5:
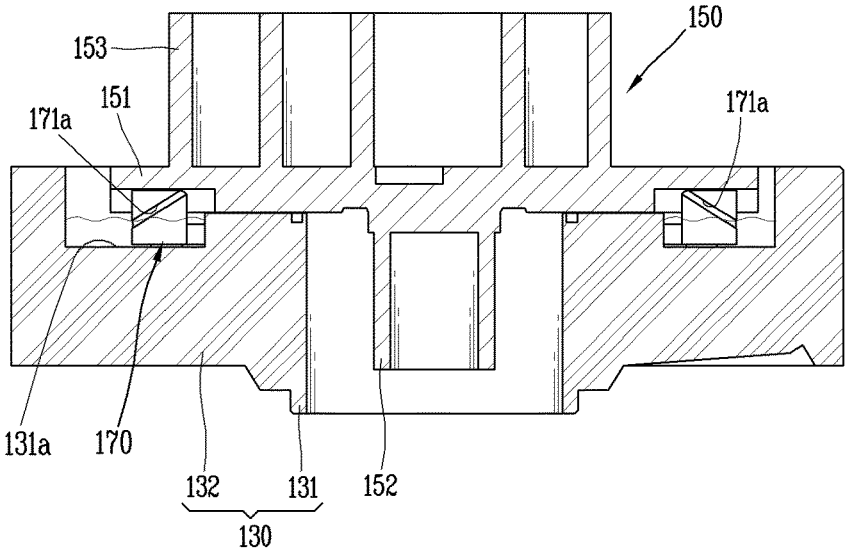
FIG. 5 is a conceptual view illustrating an example in which an Oldham ring is installed between the main frame and the orbiting scroll, and oil is provided to an upper portion of the main frame.

FIG. 1 is a cross-sectional view illustrating a top compression type scroll compressor 100 of the present disclosure, and FIG. 2 is an exploded perspective view of a compression unit of FIG. 1. In addition, FIG. 3 is an exploded perspective view illustrating an example in which the Oldham ring 170 is installed on a main frame 130, and FIG. 4 is an enlarged cross-sectional view of a portion in which the Oldham ring 170 is installed in the compression unit in FIG. 1.

Referring to FIGS. 1 to 4, the scroll compressor 100 of the present disclosure will be described below.

The scroll compressor 100 of the present disclosure includes a casing 110, a main frame 130, a rotating shaft 125, an orbiting scroll 150, a fixed scroll 140, and an Oldham ring 170.

In addition, the Oldham ring 170 includes a ring body 173 and a key portion.

The ring body 173 is provided in an annular shape, is provided between the main frame 130 and the orbiting scroll 150, and is supported in an axial direction of the rotating shaft 125.

The key portion extends in the axial direction from the ring body 173 and is slidably inserted into a key accommodating portion provided in the orbiting scroll 150, the main frame 130, or the fixed scroll 140.

The key portion may include an orbiting key 171 and a main key 175 to be described later.

The key accommodating portion may include an orbiting key accommodating portion 155 and a main key accommodating portion 131*b* which will be described later.

The ring body 173 or the key portion is provided with an oil supply passage, and the oil supply passage is configured to guide the oil accumulated in a member supported by the ring body 173 between the key portion and the key accommodating portion.

The oil supply passage may be at least one of the oil supply groove 171*a*, the oil supply hole 272*b* and the oil supply surface portion 373*a*, which will be described later.

A plurality of scrolls are configured to engage with each other. In addition, the plurality of scrolls includes the orbiting scroll 150.

In addition, the plurality of scrolls may further include a fixed scroll 140, as will be described later.

The orbiting scroll 150 is coupled to the rotating shaft 125 to perform an orbiting motion.

The Oldham ring 170 is slidably coupled to the orbiting scroll 150, and induces an orbiting motion of the orbiting scroll 150.

The orbiting scroll 150 is provided with at least one orbiting key accommodating portion 155. In addition, the Oldham ring 170 is provided with at least one orbiting key 171 protruding to be slidably inserted into the orbiting key accommodating portion 155.

The orbiting key accommodating portion 155 may be provided on the opposite side to a surface on which the orbiting wrap 153 is disposed in the orbiting scroll 150. The opposite side to the surface on which the orbiting wrap 153 is disposed may be an orbiting end plate portion 151 of the orbiting scroll 150 to be described later. The orbiting end plate portion 151 will be described later.

In addition, an oil supply groove 171*a* is provided to extend obliquely from the bottom to the top on at least one side of the orbiting key 171 or at least one inner circumferential surface of the orbiting key accommodating portion 155. The oil supply groove 171*a* is provided in the orbiting key 171 or the orbiting key accommodating portion 155 to enable a flow of oil from a lower end to an upper end of the key.

In relation to the present disclosure, a structure that enables more active and direct oil supply to the key of the Oldham ring 170 will be described in more detail later.

In the scroll compressor 100 of the present disclosure, as shown in FIG. 1, the casing 110 may accommodate the orbiting scroll 150, the fixed scroll 140 and the main frame 130 therein.

The casing 110 is configured to have a sealed internal space. The casing 110 may have, for example, a cylindrical shape.

A driving motor 120 including a stator 121 and a rotor 122 may be installed inside the casing 110. The stator 121 may be fixedly installed on the inner circumferential surface of the casing 110 by shrink fit, and the rotor 122 is rotatably disposed inside the stator 121.

The casing 110 according to the present embodiment may include a cylindrical shell 111, an upper cap 112, and a lower cap 113. Accordingly, the internal space of the casing 110 may be divided into an upper space 110*b* provided inside the upper cap 112, an intermediate space 110*c* provided inside the cylindrical shell 111, and a lower space 110*d* provided inside the lower cap 113 based on a flow order of a refrigerant. Hereinafter, the upper space 110*b* may be defined as a discharge space, the intermediate space 110*c* may be defined as an oil separation space, and the lower space 110*d* may be defined as an oil storage space.

The cylindrical shell 111 has a cylindrical shape with both upper and lower ends open, and the driving motor 120 is press-fitted and fixed to a lower half of an inner circumferential surface of the cylindrical shell 111 and the main frame 130 is press-fitted and fixed to an upper half thereof.

A refrigerant discharge pipe 116 penetrates and is coupled to the intermediate space 110*c* of the cylindrical shell 111, specifically, between the driving motor 120 and the main frame 130. The refrigerant discharge pipe 116 may be directly inserted into and welded to the cylindrical shell 111, but usually an intermediate collar pipe (not shown) formed of the same material as the cylindrical shell 111 may be inserted and welded to the cylindrical shell 111, and the refrigerant discharge pipe 116 formed of copper may be inserted and welded the intermediate connection pipe.

The upper cap 112 is coupled to cover the open upper end of the cylindrical shell 111. A refrigerant suction pipe 115 penetrates to be coupled to the upper cap 112, and the refrigerant suction pipe 115 passes through an upper space 110*b* of the casing 110 to be directly connected to a suction chamber (no reference numeral given) of the compression unit to be described later. Accordingly, the refrigerant may be supplied to the suction chamber through the refrigerant suction pipe 115.

The lower cap 113 is coupled to cover the opened lower end of the cylindrical shell 111. The lower space 110*d* of the lower cap 113 forms an oil storage space, and a preset amount of oil may be stored in the oil storage space. The lower space 110*d* constituting the oil storage space may communicate with the upper space 110*b* and the intermediate space 110*c* of the casing 110 through an oil recovery passage (no reference numeral given). Accordingly, the oil separated from the refrigerant in the upper space 110*b* and the intermediate space 110*c* and the oil recovered after being supplied to the compression unit are recovered and stored in the lower space 110*d* constituting the oil storage space through the oil recovery passage.

Referring to FIG. 1, the driving motor 120 according to the present embodiment is installed in the lower half of the intermediate space 110*c* constituting a high-pressure portion in the internal space of the casing 110, and includes a stator 121 and a rotor 122. The stator 121 is fixed to the inner wall surface of the cylindrical shell 111 by hot pressing, and the rotor 122 is rotatably provided inside the stator 121.

The stator 121 includes a stator core 1211 and a stator coil 1212.

The stator core 1211 is provided in a cylindrical shape and may be fixed to an inner circumferential surface of the cylindrical shell 111 by hot pressing. The stator coil 121*a* may be wound around the stator core 1211 and may be electrically connected to an external power source through a terminal (no reference numeral given) coupled through the casing 110.

The rotor 122 may include a rotor core 1221 and a permanent magnet 1222.

The rotor core 1221 may be provided in a cylindrical shape, and may be rotatably inserted into the stator core 1211 with a preset gap therebetween. The permanent magnet 1222 may be embedded in the rotor core 1221 at a preset interval along the circumferential direction.

The rotating shaft 125 is press-fitted and coupled to the rotor 122. An upper end of the rotating shaft 125 is provided with an eccentric portion and is rotatably supported in a radial direction on the main frame 130 to be described later, and a lower end of the rotating shaft 125 is rotatably radially and axially supported on the subframe 118.

In addition, an oil supply hole 1255 formed through between upper and lower ends of the rotating shaft 125 and parallel in the axial direction may be provided in the rotating shaft 125. The oil supply hole 1255 may be provided to pass through from a lower end of the rotating shaft 125 to a bottom surface of the eccentric portion 1251. Accordingly, the oil stored in the lower space 110*d* constituting the oil storage space may be supplied to the inside of the eccentric portion 1251 through the oil supply hole 1255.

In addition, an oil pickup 126 may be installed at the lower end of the rotating shaft 125, precisely, at the lower end of the oil supply hole 1255. The oil pickup 126 may be installed to be submerged in the oil stored in the oil storage space 110*d*. Accordingly, the oil stored in the oil storage space 110*d* may be pumped by the oil pickup 126 and sucked through the oil supply hole 1255.

The main frame 130 includes a main flange portion 131 and a shaft support protrusion 132.

The main flange portion 131 is provided in an annular shape and is accommodated in the intermediate space 110*c* of the cylindrical shell 111. For example, an outer circumferential surface of the main flange portion 131 may be configured in a circular shape to be in close contact with the inner circumferential surface of the cylindrical shell 111. In this case, at least one oil recovery hole (not shown) penetrating in the axial direction may be provided between the outer circumferential surface and the inner circumferential surface of the main flange portion 131.

In addition, at least one frame fixing protrusion (no reference numeral given) may be provided to extend in a radial direction on the outer circumferential surface of the main flange portion 131. An outer circumferential surface of the frame fixing protrusion may be fixed in close contact with the inner circumferential surface of the cylindrical shell 111. In this case, the frame fixing protrusion may be provided with a second discharge passage groove 1311 penetrating between both sides of the main flange portion 131 in the axial direction. The second discharge passage groove 1311 may be provided to communicate with a first discharge passage groove 1421 to be described later on the same axial line. Accordingly, since the upper space 110*b* and the intermediate space 110*c* communicate with each other, the refrigerant discharged from the compression unit to the upper space 110*b* may move to the intermediate space 110*c* to be discharged toward the condenser through the refrigerant discharge pipe 116.

Figure 6:
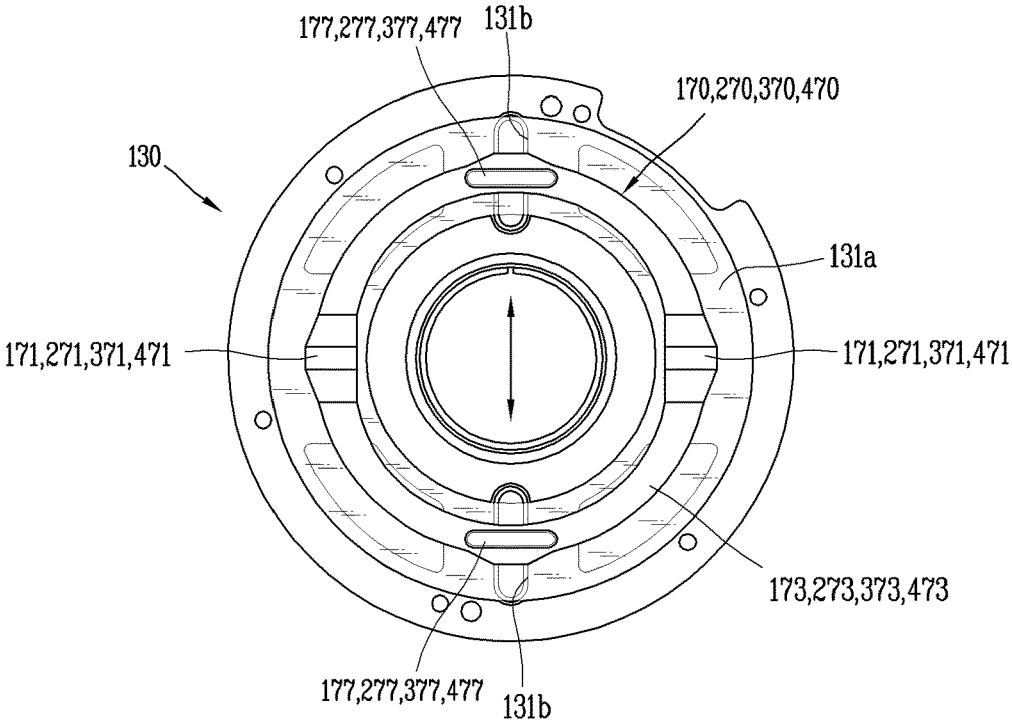
FIG. 6 is a plan view showing an example in which an Oldham ring is installed in an Oldham ring accommodating portion of a main frame.

In addition, an Oldham ring accommodating portion 131*a* may be provided on the upper surface of the main flange portion 131, and a main key accommodating portion 131*b* may be provided on the Oldham ring accommodating portion 131*a*. Referring to FIG. 6, for example, an Oldham ring accommodating portion 131*a* is provided on the upper surface of the main flange portion 131, and two main key accommodating portions 131*b* are provided with a phase difference of approximately 180° along the circumferential direction in the Oldham ring accommodating portion 131*a*.

For example, the Oldham ring accommodating portion 131*a* may be provided in an annular shape to accommodate the ring-shaped Oldham ring 170. A width of the annular shape of the Oldham ring accommodating portion 131*a* is preferably wider than a width of the ring body 173 of the Oldham ring 170 to accommodate the Oldham ring 170 without interference.

In addition, the oil sucked from the oil storage space is accommodated in the Oldham ring accommodating portion 131*a* so that oil may be provided to the oil supply groove 171*a* and the oil supply hole 172*b* of the Oldham ring 170.

The main key accommodating portion 131*b* may be provided to cross the Oldham ring accommodating portion 131*a* in a radial direction with respect to the circumferential direction in which the ring body 173 of the Oldham ring 170 is disposed, so that the Oldham ring 170 may slide in the radial direction in which the main key accommodating portion 131*b* is provided.

The main key accommodating portion 131*b* is provided by a length longer than the main key 175 in the sliding direction of the main key 175 of the Oldham ring 170 so that the main key 175 may move by a predetermined distance.

The main key 175 of the Oldham ring 170 to be described later may be slidably inserted into the main key accommodating portion 131*b* in the radial direction.

In this case, a liner forming a wear preventing member may be inserted into the main key accommodating portion 131*b* or the main key 175 of the Oldham ring 170 inserted into the main key accommodating portion 131*b* may be formed of a different material (dissimilar material) from the ring body 173 of the Oldham ring 170.

For example, when the main frame 130 is formed of the same material as the main key 175 of the Oldham ring 170, a liner formed of a material different from that of the main frame 130 or the Oldham ring 170 may be provided to suppress wear between the main frame 130 and the Oldham ring 170.

However, when the main frame 130 and the main key 175 of the Oldham ring 170 are formed of different materials (for example, the main frame 130 is formed of cast iron and the main key 175 of the Oldham ring 170 is formed of aluminum), there is no need to install a separate liner in the main key accommodating portion 131*b*.

The shaft support protrusion 132 extends from the center of the main flange portion 131 toward the driving motor 120, and a shaft support hole 1321 is provided inside the shaft support protrusion 132. The shaft support hole 1321 may be provided through both sides of the main flange portion 131 in the axial direction. Accordingly, the main flange portion 131 may be provided in an annular shape.

Referring to FIGS. 1 to 3, the fixed scroll 140 according to the present embodiment may include a fixed end plate portion 141, a fixed side wall portion 142, and a fixed wrap 143.

The fixed end plate portion 141 may be provided in a disk shape. An outer circumferential surface of the fixed end plate portion 141 may be configured to be in close contact with an inner circumferential surface of the upper cap 112 forming the upper space 110*b* or may be provided to be spaced apart from the inner circumferential surface of the upper cap 112.

In addition, a suction port 1411 that penetrates in the axial direction and communicates with a suction chamber (no reference numeral given) is provided at the edge of the fixed end plate portion 141, and a refrigerant suction pipe 115 penetrating through the upper cap 112 of the casing 110 may be inserted and coupled to the suction port 1141. Accordingly, the refrigerant suction pipe 115 may directly communicate with the suction port 1411 of the fixed scroll 140 through the upper space 110*b* of the casing 110.

In addition, a discharge port 1412 and a bypass hole (not shown) are provided in the center of the fixed end plate portion 141, and a discharge valve 145 for opening and closing the discharge port 1412 and a bypass valve (not shown) for opening and closing a bypass hole may be installed on the upper surface of the fixed end plate portion 141. Accordingly, the refrigerant compressed in the compression chamber V is discharged from the upper side of the fixed scroll 140 to the upper space 110*b* formed in the upper cap 112.

The fixed side wall portion 142 may extend in an annular shape from the edge of the fixed end plate portion 141 toward the main frame 130. Accordingly, a lower surface of the fixed side wall portion 142 may be in close contact with the upper surface of the main frame 130, that is, the upper surface of the main flange portion 131, and may be bolted.

At least one first discharge passage groove 1421 may be provided on the outer circumferential surface of the fixed side wall portion 142. The first discharge passage groove 1421 may be recessed from the outer circumferential surface of the fixed scroll 140 to communicate with both sides of the fixed scroll 140 in the axial direction. For example, the first discharge passage groove 1421 may be configured to communicate with the lower surface of the fixed side wall portion 142 from the upper surface of the fixed end plate portion 141. Accordingly, an upper end of the first discharge passage groove 1421 may communicate with the upper space 110*b*, and a lower end of the first discharge passage groove 1421 may communicate with an upper end of the second discharge passage groove 1311 provided in the main frame 130.

The fixed wrap 143 may extend from the lower surface of the fixed end plate portion 141 toward the orbiting scroll 150. The fixed wrap 143 may be provided in various shapes, such as an involute. The fixed wrap 143 may be engaged with an orbiting wrap 153 to be described later to form a pair of compression chambers V.

Referring to FIG. 1, the orbiting scroll 150 according to the present embodiment may include an orbiting end plate portion 151, a rotating shaft coupling portion 152, and an orbiting wrap 153.

The orbiting end plate portion 151 is provided in a disk shape and is supported in the axial direction by the main frame 130 to perform an orbiting motion between the main frame 130 and the fixed scroll 140.

An orbiting key accommodating portion 155 is provided on one side of the orbiting end plate portion 151, that is, on the opposite side of the orbiting wrap 153, and an orbiting key 171 forming a portion of the Oldham ring 170 to be described later may be installed in the orbiting key accommodating portion 155. The orbiting key 171 may be provided in two with a phase difference of approximately 180° along the circumferential direction in the Oldham ring 170.

In addition, in the present disclosure, the orbiting key 171 or the orbiting key accommodating portion 155 may be provided with an oil supply groove 171*a* that enables the flow of oil to the orbiting key 171, so that oil may be more smoothly supplied to the orbiting key 171 according to the movement of the Oldham ring 170, thereby improving reliability.

The orbiting key 171 may extend in the axial direction toward the Oldham ring 170 so as to be slidably inserted into the orbiting key accommodating portion 155 of the Oldham ring 170 to be described later. The orbiting key 171, the orbiting key accommodating portion 155, and the structure in which the oil supply groove 171*a* is configured will be described again later with the Oldham ring 170.

The rotating shaft coupling portion 152 may extend from a geometric center of the orbiting scroll 150 toward an eccentric portion 1251 of the rotating shaft 125. The rotating shaft coupling portion 152 may be rotatably inserted into the eccentric portion 1251 of the rotating shaft 125. Accordingly, the orbiting scroll 150 performs an orbiting motion by the eccentric portion 1251 of the rotating shaft 125 and the rotating shaft coupling portion 152.

The orbiting wrap 153 may extend toward the fixed scroll 140 from the upper surface of the orbiting end plate portion 151. The orbiting wrap 153 may be provided in various shapes such as an involute to correspond to the fixed wrap 143.

The Oldham ring 170 may be provided between the main frame 130 and the orbiting scroll 150. Of course, in some cases, the Oldham ring 170 may be provided on the fixed scroll 140 and the orbiting scroll 150. However, in the present disclosure, an example in which the Oldham ring 170 is provided between the main frame 130 and the orbiting scroll 150 will be mainly described.

For example, the Oldham ring 170 may be slidably coupled to each of the main frame 130 and the orbiting scroll 150. Accordingly, the Oldham ring 170 limits a rotational movement of the orbiting scroll 150 so that the orbiting scroll 150 performs an orbiting motion with respect to the main frame 130. The Oldham ring 170 will be described again later.

The operational effects of the scroll compressor 100 according to the present embodiment as described above are as follows.

That is, when power is applied to the driving motor 120 and rotational force is generated, the orbiting scroll 150 eccentrically coupled to the rotating shaft 125 performs an orbiting motion with respect to the fixed scroll 140 by the Oldham ring 170. At this time, a pair of compression chambers V that move continuously are provided between the fixed scroll 140 and the orbiting scroll 150.

Then, the volume of the compression chamber V is gradually reduced while moving from the suction port (or suction chamber) 1411 to the discharge port (or discharge chamber) 1412 while the orbiting scroll 150 performs an orbiting motion.

Then, the refrigerant flows into the compression chamber V through the suction port 1411 of the fixed scroll 140 through the refrigerant suction pipe 115, and the refrigerant is compressed while moving toward the final compression chamber by the orbiting scroll 150. This refrigerant is discharged into the upper space 110*b* of the casing 110 through the discharge port 1412 of the fixed scroll 140 in the final compression chamber, and is moved to the intermediate space 110*c* and/or the lower space 110*d* of the casing 110 through the refrigerant guide passage including the first discharge passage groove 1421 and the second discharge passage groove 1311.

Then, a series of process in which, as the refrigerant circulates in the internal space 110*a* of the casing 110, the oil is separated from the refrigerant, and the oil separated from the refrigerant moves to the oil storage space constituting the lower space 110*d* of the casing 110 and is stored, and then supplied to the compression unit through the oil pickup 126 and the oil supply hole 1255 of the rotating shaft 125, while the refrigerant separated from the oil is discharged to the outside of the casing though the refrigerant discharge pipe 116, is repeated.

Meanwhile, as described above, the orbiting scroll 150 is slidably coupled to the Oldham ring 170 to perform an orbiting motion with respect to the fixed scroll and/or the main frame 130.

The scroll compressor 100 of the present disclosure includes a plurality of scrolls and the Oldham ring 170.

The plurality of scrolls is provided to engage with each other. In addition, the plurality of scrolls includes the orbiting scroll 150.

In addition, the plurality of scrolls may further include the aforementioned fixed scroll 140 as well as the orbiting scroll 150. The fixed scroll 140 forms a compression chamber together with the orbiting scroll 150.

The orbiting scroll 150 is coupled to the rotating shaft 125 to perform an orbiting motion.

As described above, the orbiting scroll 150 may include the rotating shaft coupling portion 152 and may be coupled to the rotating shaft 125. In addition, the rotating shaft 125 is rotated by the rotation of the driving motor 120, and the rotating shaft coupling portion 152 of the orbiting scroll 150 may be coupled to the eccentric portion of the rotating shaft 125 to perform an orbiting motion.

The Oldham ring 170 is slidably coupled to the orbiting scroll 150 to induce the orbiting motion of the orbiting scroll 150.

At least one orbiting key accommodating portion 155 is provided in the orbiting scroll 150, and the Oldham ring 170 is provided with at least one orbiting key 171 protruding to be slidably inserted into the orbiting key accommodating portion 155.

In addition, at least one side surface of the orbiting key 171 or at least one inner circumferential surface of the orbiting key accommodating portion 155 is provided with an oil supply groove 171*a* to extend obliquely from the lower side to the upper side. The oil supply groove 171*a* is provided in the orbiting key 171 or the orbiting key accommodating portion 155 to enable the flow of oil from the lower end to the upper end of the orbiting key 171.

That is, the scroll compressor 100 of the present disclosure may improve reliability by more smoothly supplying oil to the key portion according to the movement of the Oldham ring 170 by applying a groove structure such as application of an inclined end to the edge portion.

In addition, the scroll compressor 100 of the present disclosure may improve reliability by more smoothly supplying oil to the orbiting key 171 according to the movement of the Oldham ring 170 by machining the inclined oil supply hole and applying the oil supply groove to a key contact portion.

In the scroll compressor 100 of the present disclosure, the orbiting key accommodating portion 155 is provided in the orbiting scroll 150, and the orbiting key 171 is provided in the Oldham ring 170.

Among the keys provided in the Oldham ring 170, the key slidably inserted into the orbiting scroll 150 is referred to as the orbiting key 171, and the groove into which the orbiting key 171 is inserted is referred to as the orbiting key accommodating portion 155.

In addition, as will be described later, among the keys provided in the Oldham ring 170, a key that is slidably inserted into the main frame may be referred to as a main key 175, and a groove into which the main key 175 is inserted may be referred to as a main key accommodating portion 131*b*. However, the present disclosure is not necessarily limited thereto, and the orbiting key 171 and the main key 175 may be referred to as a first key and a second key (or reverse order is possible), respectively, and the orbiting key accommodating portion 155 and the main key accommodating portion 131*b* may be referred to as a first keyway and a second keyway (or reverse order is possible), respectively.

Figure 7:
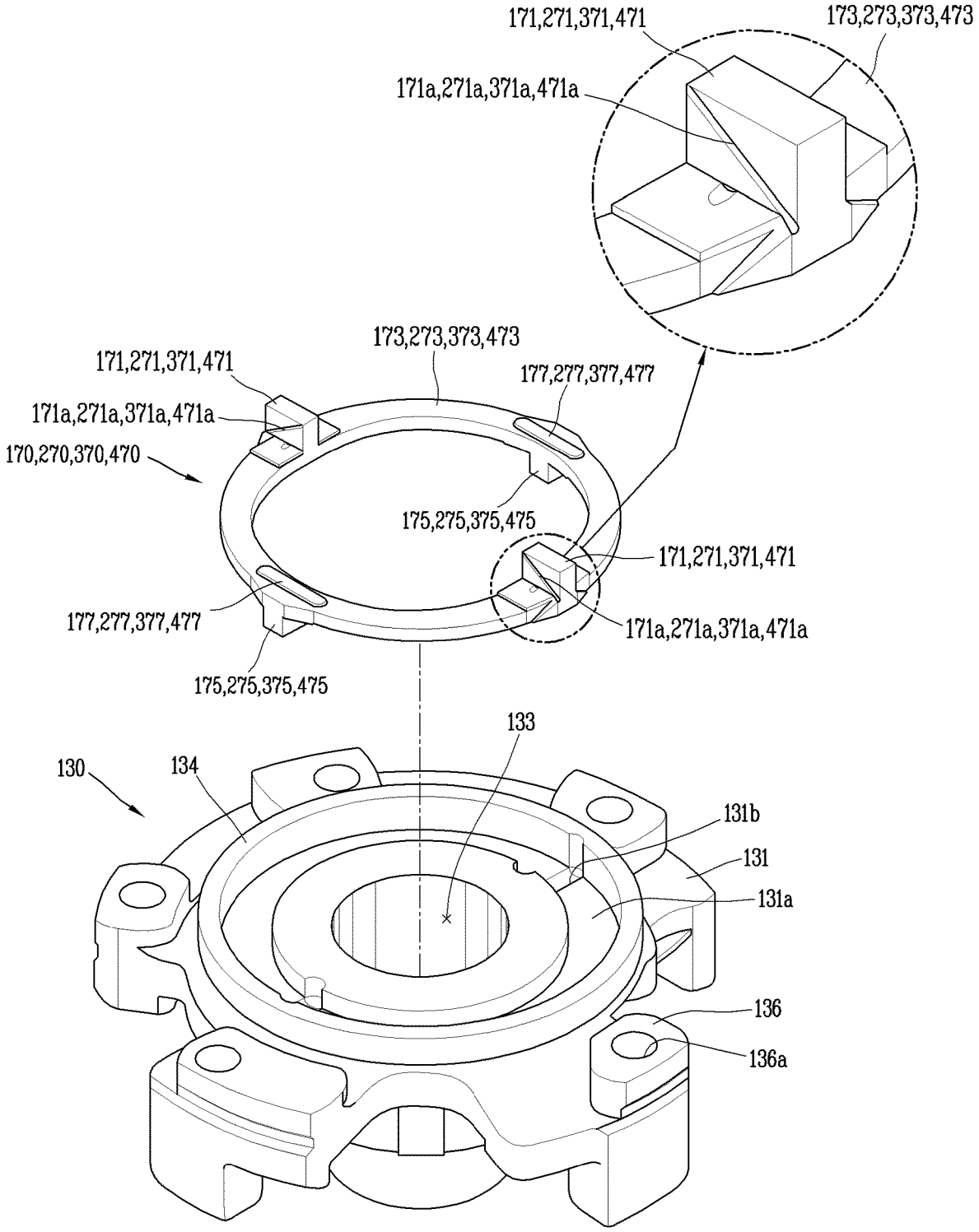
FIG. 7 is an exploded perspective view showing a main frame and an Oldham ring.
Figure 8:
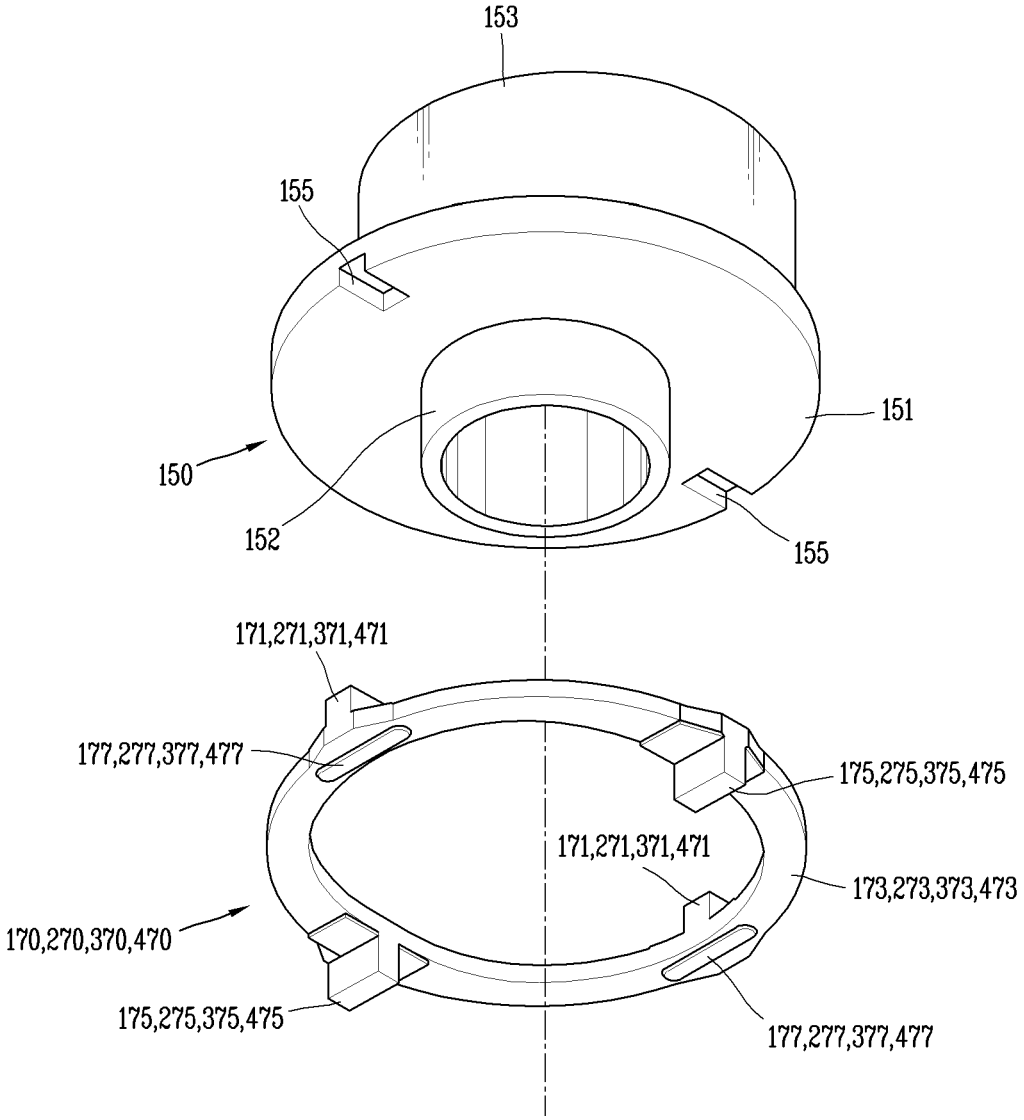
FIG. 8 is an exploded perspective view showing an orbiting scroll and an Oldham ring.
Figure 9A:
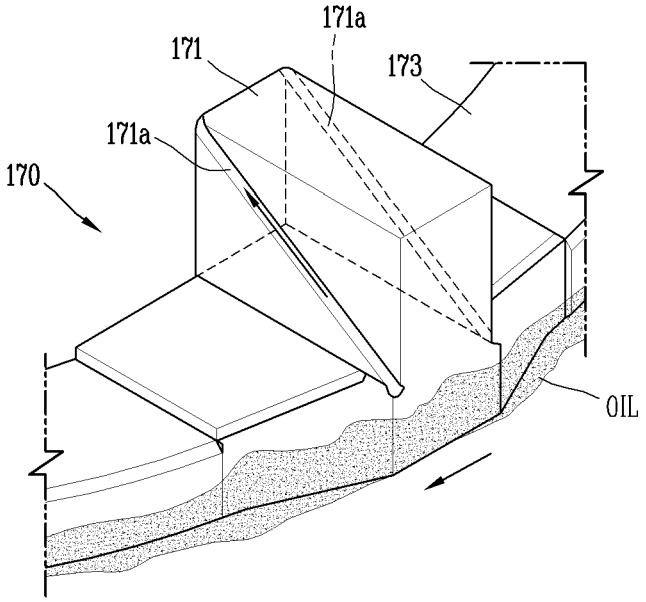
FIG. 9A is a perspective view showing an Oldham ring of a first embodiment.
Figure 11:
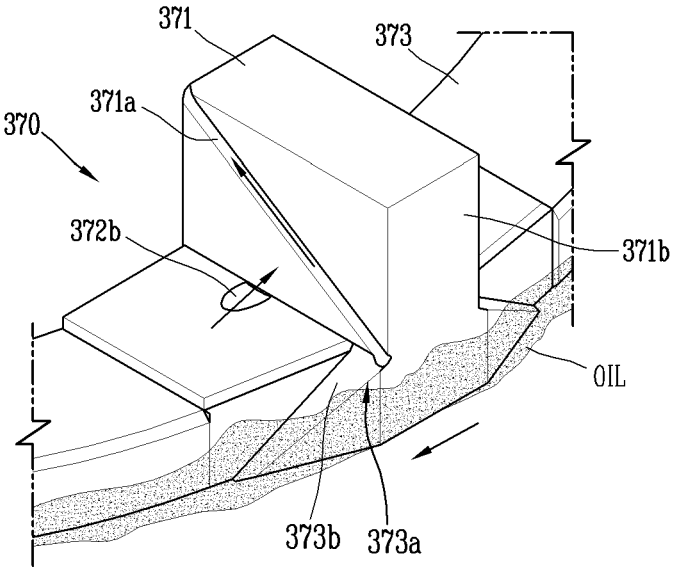
FIG. 11 is a perspective view showing an Oldham ring of a third embodiment.
Figure 12A:
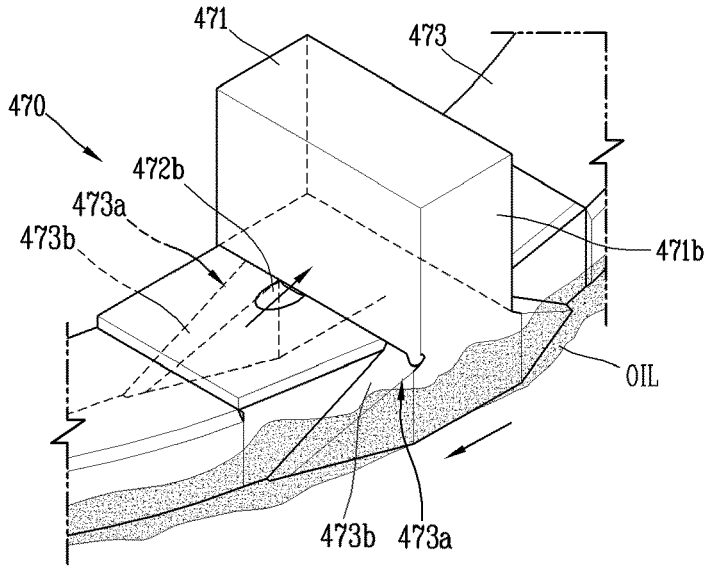
FIG. 12A is a perspective view showing an Oldham ring of a fourth embodiment.
Figure 12B:
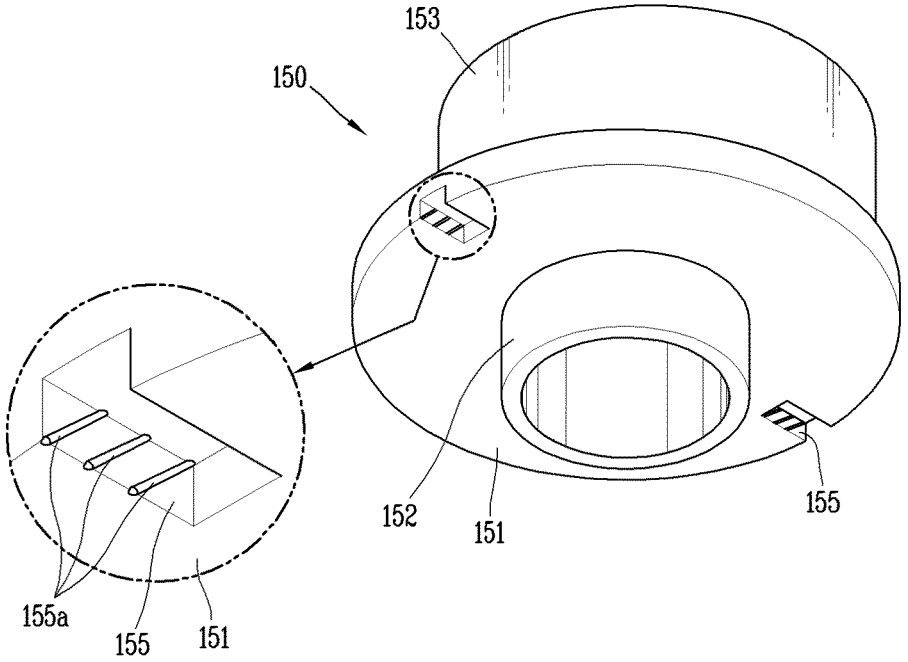
FIG. 12B is a perspective view showing a bottom surface of an orbiting scroll on which an Oldham ring of the fourth embodiment is installed.

FIG. 6 is a plan view showing an example in which an Oldham ring is installed in an Oldham ring accommodating portion of a main frame, and FIG. 7 is an exploded perspective view showing a main frame and an Oldham ring. Also, FIG. 8 is an exploded perspective view showing an orbiting scroll and an Oldham ring, FIG. 9A is a perspective view showing an Oldham ring of a first embodiment, and FIG. 10 is a perspective view showing an Oldham ring of a second embodiment. FIG. 11 is a perspective view showing an Oldham ring of a third embodiment. FIG. 12A is a perspective view showing an Oldham ring of a fourth embodiment, and FIG. 12B is a perspective view showing a bottom surface of an orbiting scroll on which an Oldham ring of the fourth embodiment is installed.

Hereinafter, an Oldham ring of the first to fourth embodiments of the present disclosure will be described with reference to FIGS. 6 to 12B and the like.

An example of the Oldham ring 170 is shown in FIG. 9A, and this will be referred to as the Oldham ring 170 of the first embodiment. Hereinafter, the Oldham ring 170 of the first embodiment will be described with reference to FIG. 9A.

In addition, FIG. 8 shows an example in which the orbiting key accommodating portion 155 is provided on the bottom surface of the orbiting end plate portion 151 of the orbiting scroll 150, and the orbiting key 171 is provided in the Oldham ring 170 adjacent thereto.

In the present disclosure, an example in which the orbiting key accommodating portion 155 is provided in the orbiting scroll 150 and the orbiting key 171 is provided in the Oldham ring 170 will be mainly described.

However, the present disclosure is not necessarily limited thereto, and an example in which the orbiting key accommodating portion 155 is provided in the Oldham ring 170 and the orbiting key 171 is provided in the orbiting scroll 150 is not completely excluded.

An oil supply groove 171*a* extending obliquely from the lower side to the upper side is provided on one surface of the orbiting key 171. The oil supply groove 171*a* enables the flow of oil from the lower end to the upper end of the orbiting key 171.

The oil supply groove 171*a* may be provided on both sides of the key portion provided between the outer surface of the key portion provided in the circumferential direction and the inner surface of the key portion provided in the circumferential direction.

As shown in FIG. 9A, an example in which the oil supply groove 171*a* is provided on both sides provided on opposite sides of each other in the orbiting key 171.

For example, the oil supply groove 171*a* may obliquely extend from a lower point provided on the outer periphery of the Oldham ring 170 to an upper point provided on the inner periphery of the Oldham ring 170.

FIG. 7 shows an example in which an inclined oil supply groove 171*a* is provided in each of the orbiting keys 171 spaced apart from each other by 180 degrees in the ring body 173.

In addition, in FIG. 9A, an example of the oil supply groove 171*a* formed from one point on the lower right side to one point on the upper left side in one orbiting key 171 is shown.

This inclination direction is a direction that rises toward the inside of the Oldham ring 170, and the oil subjected to centrifugal force may move to the inside of the Oldham ring 170, and at the same time, it may be a structure that promotes an upward flow of oil in contact with the orbiting key 171 of the Oldham ring 170.

As the oil supply groove 171*a* inclined in the vertical direction is provided on one surface of the orbiting key 171 of the Oldham ring 170, the oil in contact with the Oldham ring 170 may more actively flow in the orbiting key 171 through the oil supply groove 171*a*, the supply of the oil to the orbiting key 171 may become smoother, and the number of parts in contact with oil on each side of the orbiting key 171 may increase, so the reliability is improved.

In addition, the Oldham ring 170 may further include a ring body 173. The ring body 173 is provided in an annular shape, and the orbiting key 171 may be provided to protrude from one surface of the ring body 173 toward the orbiting key accommodating portion 155.

FIG. 7 shows an example in which the orbiting key 171 protrudes from the upper surface of the annular ring body 173 in a direction toward the orbiting end plate portion 151 of the orbiting scroll 150. In addition, an example in which two orbiting keys 171 have a shape of a rectangular parallelepiped and are spaced apart by 180 degrees is shown.

The scroll compressor 100 of the present disclosure improves the actual load efficiency according to the low pressure ratio operation by securing the low pressure ratio operation reliability by the structure in which the inclined oil supply groove 171*a* is provided in the orbiting key 171 as described above.

Meanwhile, referring to FIGS. 7 and 8, the Oldham ring 170 may further include a main key 175. In addition, the main frame 130 may be provided with a main key accommodating portion 131*b* for accommodating the main key 175 to be slidably inserted.

The main key 175 may be provided to protrude downward from the lower surface of the ring body 173 on the opposite side where the orbiting key 171 is provided, for example. In addition, as shown in FIGS. 7 and 8, two main keys 175 may be spaced apart at a 180 degree interval and may be alternately disposed, while maintaining a 90 degree interval with the orbiting key 171 in the circumferential direction.

The main key 175 may be provided in the shape of a rectangular parallelepiped, similar to the orbiting key 171. In addition, the main key accommodating portion 131*b* may be radially formed to accommodate the main key 175 in the main frame 130 to slide in the radial direction. An example of the main key accommodating portion 131*b* formed in the radial direction of the main frame 130 is shown, and in the drawing, the main key accommodating portion 131*b* is shown in the upper part and the lower part in the form of an elliptical long slot.

Meanwhile, referring to FIGS. 7 and 8, a support portion 177 may be provided between the two orbiting keys 171 on the upper surface of the ring body 173, and a support portion 177 may also be provided between two main keys 175 on the lower surface of the ring body 173. The support portion 177 of the upper surface of the ring body 173 may be in contact with the orbiting scroll 150, and the support portion 177 of the upper surface of the ring body 173 may be in contact with the main frame 130. The Oldham ring may slide, while being supported between the main frame 130 and the orbiting scroll 150 by the support portions 177 respectively provided on the upper and lower surfaces of the ring body 173.

The Oldham ring 170 prevents rotation of the orbiting scroll 150 by the structure in which the main key 175 slides on the main key accommodating portion 131*b* and the orbiting key 171 slides on the orbiting key accommodating portion 155.

Another example of the Oldham ring of the first embodiment of FIG. 9A is shown in FIGS. 9B to 9E, which will be described below.

Meanwhile, an oil supply groove 171*a*-1 may be provided in at least one of the outer surface provided in the circumferential direction of the key portion and the inner surface provided in the circumferential direction of the key portion.

Figure 9B:
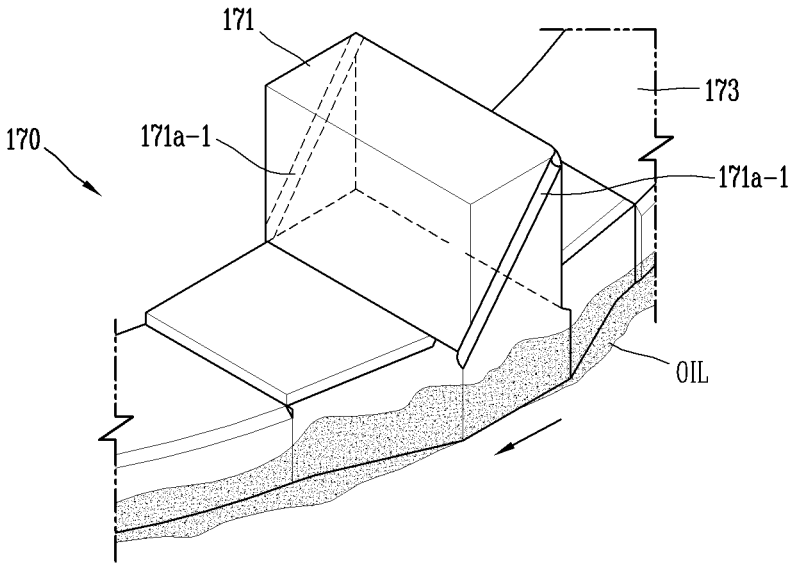
FIG. 9B is a perspective view showing an example in which oil supply grooves are provided on an inner peripheral side and an outer peripheral side. As another example of the Oldham ring of the first embodiment.

Referring to FIG. 9B, an example in which the oil supply groove 171*a*-1 is provided on each of the outer surface provided in the circumferential direction of the orbiting key 171 and the inner surface provided in the circumferential direction of the orbiting key 171 is shown.

This structure may be advantageous in moving the oil stacked on the inner and outer periphery of the Oldham ring 170 upward through the oil supply groove 171*a*-1 in the Oldham ring.

However, the oil supply groove 171*a*-1 may be provided only on the inner surface provided in the circumferential direction of the orbiting key 171.

When the oil supply groove 171*a*-1 is provided only on the inner surface of the orbiting key 171, it may be a structure advantageous for raising the oil stacked on the inside of the Oldham ring.

In addition, the oil supply grooves 171*a*-2 and 171*a*-3 may be provided in a multi-stage structure in which a plurality of oil supply grooves 171*a*-2 and 171*a*-3 are spaced apart from each other on both side surfaces of the key portion.

In addition, the oil supply groove 171*a*-2 on the side disposed in the front with respect to a rotational direction of the rotating shaft, among the both sides of the rotating shaft the rotational direction may be provided to be more than the oil supply groove 171*a*-3 on the side disposed in the rear with respect to the rotational direction of the rotating shaft or may have a wider width.

Figure 9C:
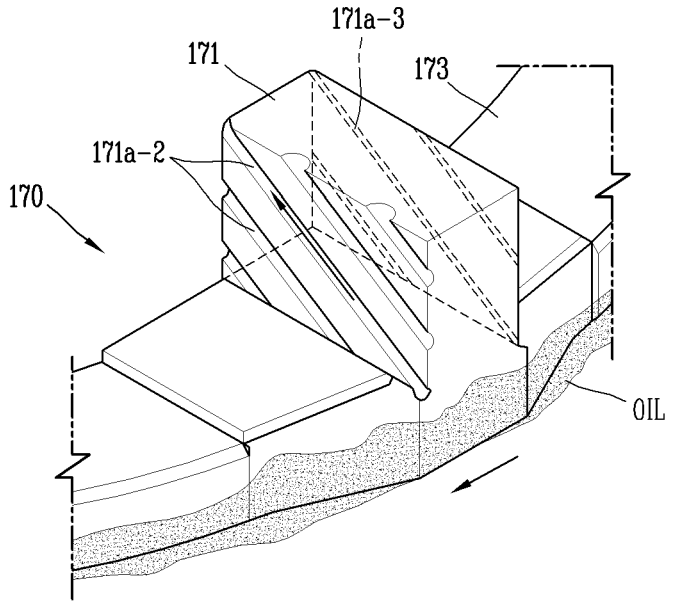
FIG. 9C is a perspective view showing different numbers of oil supply grooves having different widths on both sides as another example of the Oldham ring of the first embodiment.

In the present disclosure, both sides may be understood as both sides of the orbiting key provided between the outer periphery and the inner periphery of the Oldham ring (the surface on which the oil supply groove is provided in FIGS. 9A and 9C).

Referring to FIG. 9C, an example in which a plurality of oil supply grooves are spaced apart from each other on both sides of the orbiting key is shown. In FIG. 9C, an example in which, based on the rotational direction of the rotating shaft indicated by the arrow, the oil supply groove 171*a*-2 on the side of the orbiting key provided in the front is provided as four pieces and has a wider width compared with the oil supply groove 171*a*-3 on the side of the orbiting key provided in the rear is shown.

In addition, in FIG. 9C, an example in which, based on the rotational direction of the rotating shaft indicated by the arrow, the oil supply groove 171*a*-3 on the side surface of the orbiting key provided at the rear is provided as two pieces (indicated by the dotted line) and has a narrower width, compared with the oil supply groove 171*a*-2 on the side surface of the orbiting key provided in the front is shown.

This structure is a more advantageous structure for oil supply because a large amount of oil flows relatively to the side of the orbiting key disposed in the front with respect to the rotational direction of the rotating shaft.

In addition, the oil supply groove 171*a*-4 may be provided so that a plurality of oil supply grooves 171*a*-4 cross each other on both sides of the key portion.

Figure 9D:
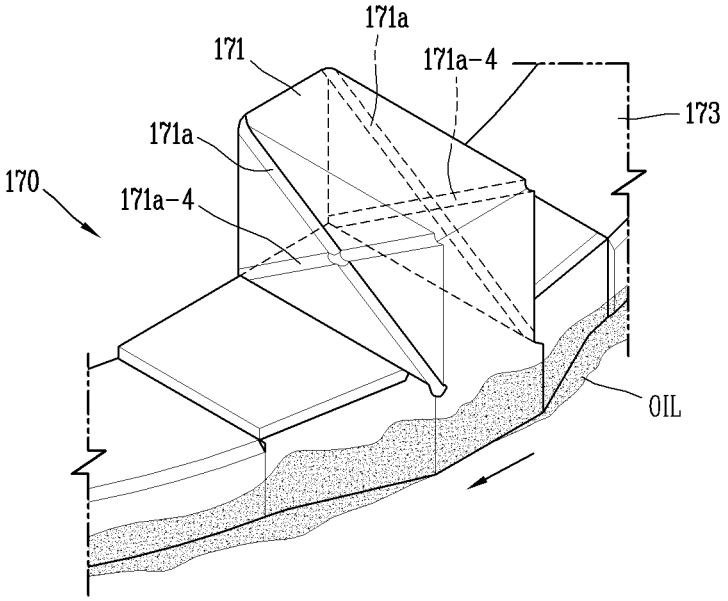
FIG. 9D is a perspective view showing oil supply grooves diagonally crossing each other on both sides as another example of the Oldham ring of the first embodiment.

Referring to FIG. 9D, an example in which, on each of both sides of the orbiting key 171, two oil supply grooves 171*a*-4 are provided diagonally to each other to cross each other is shown.

This structure may be advantageous in raising the oil stacked on the inner portion of the Oldham ring 170, compared to the oil supply groove 171*a* described in FIG. 9A.

In addition, the oil supply groove 171*a*-5 may be parallel to an extending direction of the rotating shaft 125. In addition, the oil supply groove 171*a*-6 may be further provided in the radial direction.

Figure 9E:
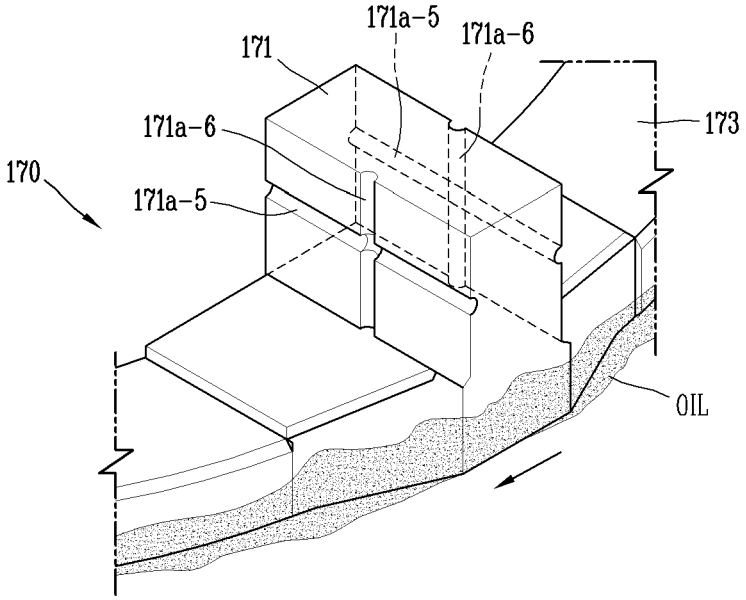
FIG. 9E is a perspective view showing oil supply grooves that cross each other in radial and axial directions on both sides as another example of the Oldham ring of the first embodiment.

Referring to FIG. 9E, an example in which the oil supply groove 171*a*-5 is provided in a direction (vertical direction) parallel to the extending direction of the rotating shaft 125 and the oil supply groove 171*a*-6 crossing the oil supply groove 171*a*-5 is provided in a radial direction (horizontal direction is shown.

With this structure, while the oil flows upward, it may be a structure advantageous for oil retention on the side of the orbiting key 171 of the Oldham ring 170.

Figure 10A:
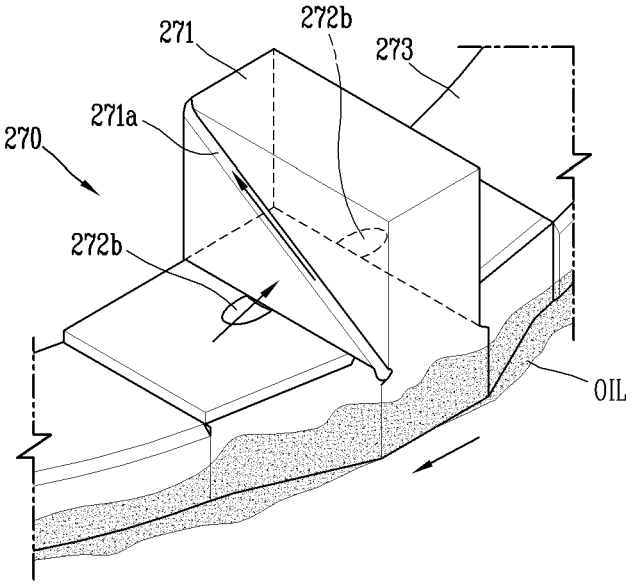
FIG. 10A is a perspective view showing an Oldham ring of a second embodiment.

FIG. 10A shows an Oldham ring 270 of another example, which will be referred to as an Oldham ring 270 of a second embodiment. Hereinafter, the Oldham ring 270 of the second embodiment will be described with reference to FIG. 10.

Referring to FIG. 10A, the aforementioned oil supply passage may be an oil supply hole 272*b* passing through a surface connected from at least one of both sides of the key portion in the ring body 273.

FIG. 8 shows an example in which the orbiting key accommodating portion 155 is provided on the bottom surface of the orbiting end plate portion 151 of the orbiting scroll 150, and the orbiting key 271 is provided in the Oldham ring 270 adjacent thereto is shown.

As described above, in the present disclosure, an example in which the orbiting scroll 150 is provided with the orbiting key accommodating portion 155 and the Oldham ring 270 is provided with the orbiting key 271 will be mainly described.

However, the present disclosure is not necessarily limited thereto, and an example in which the orbiting key accommodating portion 155 is provided in the Oldham ring 270 and the orbiting key 271 is provided in the orbiting scroll 150 is not completely excluded.

In addition, an oil supply groove 271*a* extending obliquely from the lower side to the upper side is provided on one surface of the orbiting key 271. The oil supply groove 271*a* enables the flow of oil from the lower end to the upper end of the orbiting key 271.

Of course, in FIG. 10A, an example in which the oil supply groove 271*a* is provided only one side of the orbiting key 271 is shown, but the oil supply groove 271*a* may be provided on both sides of the orbiting key 271.

For example, the oil supply groove 171*a* may extend obliquely from a lower point provided on the outer periphery side of the Oldham ring 270 to an upper point provided on the inner periphery side of the Oldham ring 270.

FIG. 7 shows an example in which an inclined oil supply groove 171*a* is provided in each of the orbiting keys 271 spaced apart from each other at a 180 degrees in the ring body 173.

In addition, in FIG. 10A, an example of the oil supply groove 271*a* formed from one point on the lower right side to one point on the upper left side in one orbiting key 271 is shown.

This inclination direction is a direction that rises toward the inside of the Oldham ring 270, and the oil subjected to centrifugal force may move to the inside of the Oldham ring 270, and at the same time, the upward flow of oil in contact with the orbiting key 271 of the Oldham ring 270 may be promoted.

As the oil supply groove 271*a* inclined in the vertical direction is provided on one surface of the orbiting key 271 of the Oldham ring 270, the oil in contact with the Oldham ring 270 actively flows in the orbiting key 271 through the oil supply groove 271*a* according to the movement of the Oldham ring 270, oil supply to the orbiting key 271 may become more smooth, and the number of parts in contact with oil on each side of the orbiting key 271 may increase, and thus, reliability may be improved.

In addition, the Oldham ring 270 may further include a ring body 273. The ring body 273 is provided in an annular shape, and the orbiting key 271 may be provided to protrude from one surface of the ring body 273 toward the orbiting key accommodating portion 155.

Referring to FIGS. 7 and 10A, an example in which the orbiting key 271 protrudes from the upper surface of the annular ring body 273 toward the orbiting end plate portion 151 of the orbiting scroll 150 is shown. In addition, an example in which two orbiting keys 271 have a shape of a rectangular parallelepiped and are spaced apart from each other by 180 degrees is shown.

Unlike the Oldham ring 170 of FIG. 9A, the Oldham ring 270 of FIG. 10A is different in that an oil supply hole 272*b* is provided in the ring body 273.

The oil supply hole 272*b* may be inclined in the ring body 273, and the oil supply hole 272*b* may be inclined while passing through the upper and lower ends of the ring body 273.

In addition, the oil supply hole 272*b* may be provided so that an upper end is adjacent to the side of the orbiting key 271.

Figure 13:
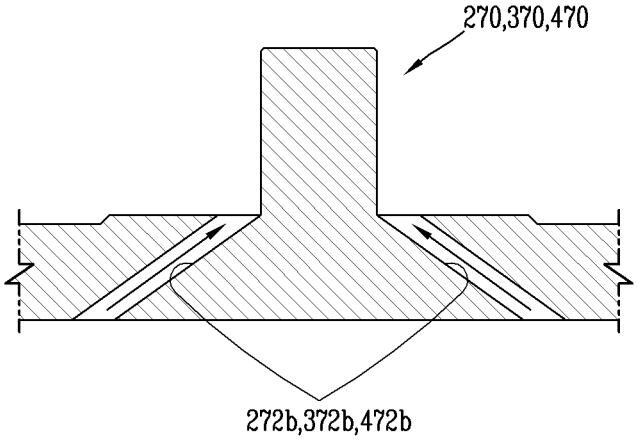
FIG. 13 is a cross-sectional view showing an example in which oil supply holes are provided in a ring body of an Oldham ring on the left and right sides of an orbiting key, respectively.

As shown in FIG. 10A, an example in which the oil supply hole 272*b* penetrates the upper surface of the ring body 273 so as to be adjacent to the left surface of the orbiting key 271, and maintains a predetermined angle, and the oil supply hole 272*b* is inclined is shown. In addition, an example in which the oil supply hole 272*b* is provided on the left and right sides of the orbiting key 271 to enable the flow of oil in both directions is shown in FIGS. 10A and 13.

In addition, the oil supply holes 272*b* respectively formed on both sides may have the same diameter.

Due to the structure in which the oil supply hole 272*b* is inclined in the ring body 273 and penetrates the upper and lower ends of the ring body 273, the oil stored in the Oldham ring accommodating portion 131*a* may flow from the lower surface of the Oldham ring 270 to the upper surface through the oil supply hole 272*b*, while the Oldham ring 270 is moved with respect to the main frame 130.

In addition, as the supply of oil to the inclined oil supply groove 271*a* formed in the vertical direction on one surface of the orbiting key 271 of the Oldham ring 270 becomes more active, the supply to the orbiting key 271 becomes smoother, and the number of parts in contact with oil on each side of the orbiting key 271 increases, so that reliability may be improved.

In addition, the oil supply hole 272*b*-1 disposed on the front side in the rotational direction of the rotating shaft 125 may have a larger diameter than the oil supply hole 272*b*-3 disposed on the rear side.

Figure 10B:
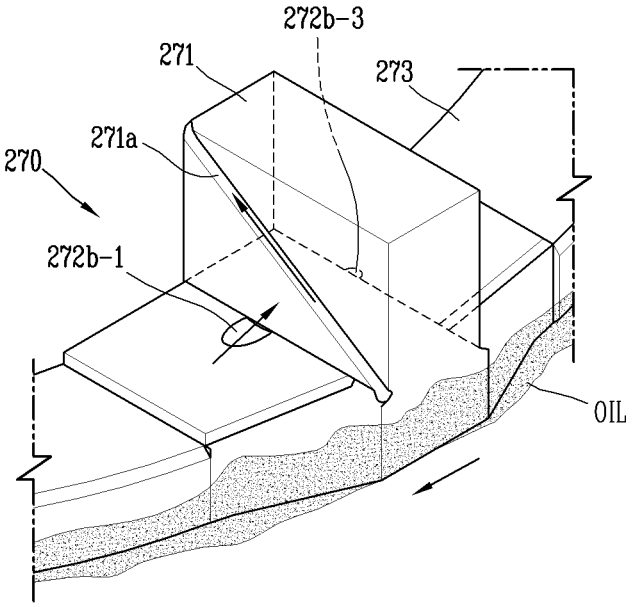
FIG. 10B is a perspective view showing another example of an Oldham ring of a second embodiment.

Referring to FIG. 10B, an example in which the oil supply hole 272*b*-1 disposed on the front side in the rotational direction of the rotating shaft indicated by the arrow at the lower right has a larger diameter than the oil supply hole 272*b*-3 disposed on the rear side is shown.

However, the present disclosure is not limited to the structure of FIG. 10B, and the oil supply hole 272*b*-1 may be disposed only on the front side in the rotational direction of the rotating shaft 225.

With this structure, a relatively large amount of oil may rise by the rotational force of the Oldham ring 270 on the front side of the rotational direction of the rotating shaft 125.

Referring to FIGS. 10A and 10B, an example in which the oil supply holes 272*b* and 272*b*-1 are provided in the circumferential direction is shown.

Meanwhile, the oil supply hole 272*b*-3 may also be provided in the radial direction.

Figure 10C:
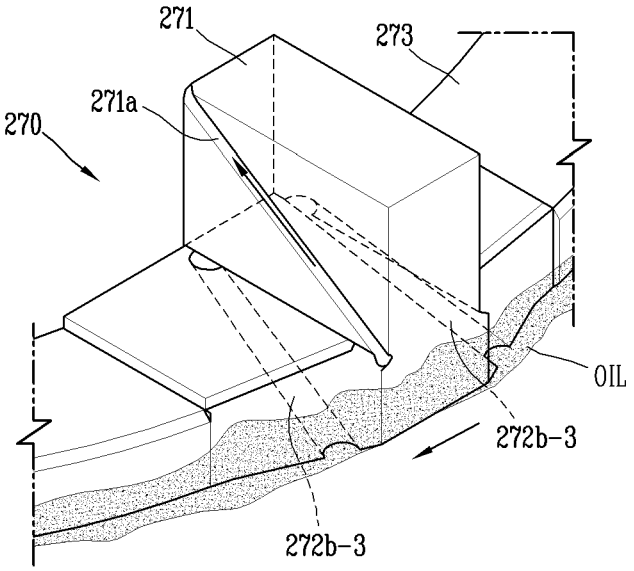
FIG. 10C is a perspective view showing another example of an Oldham ring of the second embodiment.

FIG. 10C shows an example in which the oil supply holes 272*b*-3 are provided to penetrate through the upper and lower surfaces of the ring body 273 adjacent to both sides of the orbiting key 271 in the radial direction.

With this structure, the oil on the outer circumferential bottom surface of the Oldham ring 270 may rise in the radial direction along the oil supply hole 272*b*-3.

In the scroll compressor 100 of the present disclosure, with the structure in which the oil supply hole 272*b* is provided in the ring body 273 as described above, the actual load efficiency according to the low pressure ratio operation may be improved by securing the low pressure ratio operation reliability.

Meanwhile, referring to FIGS. 7 and 8, the Oldham ring 170 may further include a main key 175. In addition, the main frame 130 may be provided with a main key accommodating portion 131*b* for accommodating the main key 175 to be slidably inserted.

The main key 175 may be provided to protrude downward from the lower surface of the ring body 273 on the opposite side where the orbiting key 271 is provided, for example. In addition, as shown in FIGS. 7 and 8, two main keys 175 may be spaced apart from each other at a 180-degree interval, and may be alternately disposed, while maintaining a 90 degree interval with the orbiting key 271 in the circumferential direction.

The main key 175 may be provided in the shape of a rectangular parallelepiped, similar to the orbiting key 271. In addition, the main key accommodating portion 131*b* may be radially formed to accommodate the main key 175 in the main frame 130 to slide in the radial direction. FIG. 7 shows an example of the main key accommodating portion 131*b* formed in the radial direction of the main frame 130, and in the drawing, the main key accommodating portion 131*b* is configured as an elliptical long slot in the upper portion and the lower portion.

Meanwhile, referring to FIGS. 7 and 8, a support portion 277 may be provided between the two orbiting keys 271 on the upper surface of the ring body 273, and the support portion 277 may be provided between two main keys 275 on the lower surface of the ring body 273. The support portion 277 of the upper surface of the ring body 273 may be in contact with the orbiting scroll 150, and the support portion 277 of the upper surface of the ring body 273 may be in contact with the main frame 130. The Oldham ring may slide while being supported between the main frame 130 and the orbiting scroll 150 by the support portions 277 respectively provided on the upper and lower surfaces of the ring body 273.

The Oldham ring 170 prevents rotation of the orbiting scroll 150 by the structure in which the main key 175 slides on the main key accommodating portion 131*b* and the orbiting key 271 slides on the orbiting key accommodating portion 155.

Another example of the Oldham ring 370 is shown in FIG. 11, and this will be referred to as an Oldham ring 370 of a third embodiment. Hereinafter, the Oldham ring 370 of the third embodiment will be described with reference to FIG. 11.

Referring to FIGS. 8 and 11, an example in which an orbiting key accommodating portion 155 is provided on the bottom surface of the orbiting end plate portion 151 of the orbiting scroll 150, and the orbiting key 371 is provided in the Oldham ring 370 adjacent thereto is shown.

As described above, in the present disclosure, an example in which the orbiting scroll 150 is provided with the orbiting key accommodating portion 155 and the Oldham ring 370 is provided with the orbiting key 371 will be mainly described.

However, the present disclosure is not necessarily limited thereto, and an example in which the orbiting key accommodating portion 155 is provided in the Oldham ring 370 and the orbiting key 371 is provided in the orbiting scroll 150 is not completely excluded.

In addition, an oil supply groove 171*a* extending obliquely from the lower side to the upper side is provided on one surface of the orbiting key 371. The oil supply groove 171*a* enables the flow of oil from the lower end to the upper end of the orbiting key 371.

For example, the oil supply groove 171*a* may extend obliquely from a lower point provided on the outer periphery side of the Oldham ring 370 to an upper point provided on the inner periphery side of the Oldham ring 370.

FIG. 7 shows an example in which an inclined oil supply groove 171*a* is provided in each of the orbiting keys 271 spaced apart from each other by 180 degrees in the ring body 173.

In addition, in FIG. 11, an example of the oil supply groove 371*a* formed from one point on the lower right side to one point on the upper left side in one orbiting key 371 is shown.

This inclination direction is a direction that rises toward the inside of the Oldham ring 370, and the oil subjected to centrifugal force may move to the inside of the Oldham ring 370, and at the same time, the upward flow of oil in contact with the orbiting key 371 of the Oldham ring 370 may be promoted.

As the oil supply groove 371*a* inclined in the vertical direction is provided on one surface of the orbiting key 371 of the Oldham ring 370, the oil in contact with the Oldham ring 270 actively flows in the orbiting key 371 through the oil supply groove 371*a* according to the movement of the Oldham ring 370, oil supply to the orbiting key 371 may become more smooth, and the number of parts in contact with oil on each side of the orbiting key 371 may increase, and thus, reliability may be improved.

In addition, the Oldham ring 370 may further include a ring body 373. The ring body 373 is provided in an annular shape, and the orbiting key 371 may be provided to protrude from one surface of the ring body 373 toward the orbiting key accommodating portion 155.

Referring to FIGS. 7 and 11, an example in which the orbiting key 371 protrudes from the upper surface of the annular ring body 373 toward the orbiting end plate portion 151 of the orbiting scroll 150 is shown. In addition, an example in which two orbiting keys 371 have a shape of a rectangular parallelepiped and are spaced apart from each other by 180 degrees is shown.

Unlike the Oldham rings 170 and 270 in FIGS. 9A and 10A, the Oldham ring 370 of FIG. 11 is different in that an oil supply surface portion 373*a* protrudes from the outer periphery of the ring body 373.

The oil supply surface portion 373*a* has an inclined surface 373*b*, the inclined surface 373*b* is provided to be inclined so that the oil introduced into the lower part of the Oldham ring 370 may flow to the upper part.

The inclined surface 373*b* may be parallel to the formation direction of the oil supply hole 372*b*, for example.

As shown in FIG. 11, the oil supply surface portion 373*a* may have a triangular shape having a predetermined width.

In addition, although not clearly shown in the drawings, the oil supply surface portion 373*a* may be provided not only on the outer periphery of the ring body 373 provided with the orbiting key 371, but also on the inner periphery.

Due to this, the oil may flow upward in both the outer periphery and the inner periphery of the oil supply surface portion 373*a*.

In addition, the orbiting key 371 may have a protruding side portion 371*b* that further protrudes in a direction toward at least one of the outer periphery and the inner periphery of the ring body 373. The oil supply surface portion 373*a* may be connected to the protruding side portion 371*b* to provide oil to the oil supply groove 371*a* through the upper portion of the inclined surface 373*b*. FIG. 11 shows the protruding side portion 371*b* protruding in the direction toward the outer periphery of the ring body 373 and the oil supply surface portion 373*a* connected thereto. The oil supply groove 371*a* may be provided to extend to a side end portion to be connected to the inclined surface 373*b* of the protruding side portion 371*b*.

Accordingly, the oil rising on the inclined surface 373*b* of the oil supply surface portion 373*a* may be more promoted to the upper part of the orbiting key 371 of the oil through the oil supply groove 371*a* extending to the protruding side portion 371*b*.

In this way, the oil accommodated in the Oldham ring accommodating portion 131*a* in the lower part of the Oldham ring 370 is induced to flow upwardly to be supplied to the upper surface of the ring body 373 from the outer periphery of the ring body 373 riding the inclined surface 373*b* by the oil supply surface portion 373*a* having the inclined surface 373*b*.

In addition, as the supply of oil to the upper surface of the ring body 373 is induced, the supply of oil to the inclined oil supply groove 171*a* provided in the vertical direction on one surface of the orbiting key 371 of the Oldham ring 370 becomes more active, the supply to the orbiting key 371 becomes smoother, and the number of parts in contact with oil on each surface of the orbiting key 371 increases, so that reliability may be improved.

Also, in the Oldham ring 370 shown in FIG. 11, the oil supply hole 372*b* may be inclined in the ring body 373, and the oil supply hole 372*b* may pass through the upper and lower ends of the ring body 373 to be inclined.

In addition, the oil supply hole 372*b* may be provided so that the upper end is adjacent to the side of the orbiting key 371.

As shown in FIG. 11, an example in which the oil supply hole 372*b* penetrates the upper surface of the ring body 373 so as to be adjacent to the left surface of the orbiting key 371, and maintains a predetermined angle, and the oil supply hole 372*b* is inclined is shown. In addition, an example in which the oil supply hole 372*b* is provided on the left and right sides of the orbiting key 371 to enable the flow of oil in both directions is shown in FIG. 13.

Due to the structure in which the oil supply hole 372*b* is inclined in the ring body 373 and penetrates the upper and lower ends of the ring body 373, the oil stored in the Oldham ring accommodating portion 131*a* may flow from the lower surface of the Oldham ring 370 to the upper surface through the oil supply hole 372*b*, while the Oldham ring 370 is moved with respect to the main frame 130.

In addition, as the supply of oil to the inclined oil supply groove 171*a* formed in the vertical direction on one surface of the orbiting key 371 of the Oldham ring 370 becomes more active, the supply to the orbiting key 371 becomes smoother, and the number of parts in contact with oil on each side of the orbiting key 371 increases, so that reliability may be improved.

In particular, referring to FIGS. 11 and 13, in the Oldham ring 370, the inclined surface 373*b* and the oil supply hole 372*b* are provided side by side, so that when the Oldham ring 370 slides with respect to the main frame 130, oil at the bottom of the Oldham ring 370 may flow to the upper surface of the ring body 373 along the inclined end of the inclined surface 373*b* and the inclination angle of the oil supply hole 372*b* along the movement direction.

In the scroll compressor 100 of the present disclosure, the oil supply surface portion 373*a* provided with the inclined surface 373*b* is configured in the ring body 373 and the oil supply hole 372*b* is provided in the ring body 373 as described above, and thus, it is possible to improve the actual load efficiency according to the low pressure ratio operation by securing the low pressure ratio operation reliability.

Meanwhile, referring to FIGS. 7 and 8, the Oldham ring 170 may further include a main key 175. In addition, the main frame 130 may be provided with a main key accommodating portion 131*b* for accommodating the main key 175 to be slidably inserted.

The main key 175 may be provided to protrude downward from the lower surface of the ring body 373 on the opposite side where the orbiting key 371 is provided, for example. In addition, as shown in FIGS. 7 and 8, two main keys 175 may be spaced apart at a 180 degree interval and may be alternately disposed, while maintaining a 90 degree interval with the orbiting key 371 in the circumferential direction.

The main key 175 may be provided in the shape of a rectangular parallelepiped, similar to the orbiting key 371. In addition, the main key accommodating portion 131*b* may be radially formed to accommodate the main key 175 in the main frame 130 to slide in the radial direction. An example of the main key accommodating portion 131*b* formed in the radial direction of the main frame 130 is shown, and in the drawing, the main key accommodating portion 131*b* is shown in the upper part and the lower part in the form of an elliptical long slot.

Meanwhile, referring to FIGS. 7 and 8, a support portion 377 may be provided between the two orbiting keys 371 on the upper surface of the ring body 373, and a support portion 377 may also be provided between two main keys 375 on the lower surface of the ring body 373. The support portion 377 of the upper surface of the ring body 373 may be in contact with the orbiting scroll 150, and the support portion 377 of the upper surface of the ring body 373 may be in contact with the main frame 330. The Oldham ring may slide, while being supported between the main frame 330 and the orbiting scroll 150 by the support portions 377 respectively provided on the upper and lower surfaces of the ring body 373.

The Oldham ring 370 prevents rotation of the orbiting scroll 150 by the structure in which the main key 175 slides on the main key accommodating portion 131*b* and the orbiting key 371 slides on the orbiting key accommodating portion 155.

FIG. 12A shows an Oldham ring 470 of another example, which will be referred to as an Oldham ring 470 of a fourth embodiment. Hereinafter, the Oldham ring 470 of the fourth embodiment will be described with reference to FIG. 12A.

Referring to FIGS. 8 and 12A, an example in which the orbiting key accommodating portion 155 is provided on the bottom surface of the orbiting end plate portion 151 of the orbiting scroll 150 and the orbiting key 171 is provided in the Oldham ring 470 adjacent thereto is shown.

As described above, In the present disclosure, an example in which the orbiting key accommodating portion 155 is provided in the orbiting scroll 150 and the orbiting key 171 is provided in the Oldham ring 470 will be mainly described.

However, the present disclosure is not necessarily limited thereto, and an example in which the orbiting key accommodating portion 155 is provided in the Oldham ring 470 and the orbiting key 171 is provided in the orbiting scroll 150 is not completely excluded.

Unlike the previous embodiments, in the Oldham ring 470 of FIG. 12A, the oil supply groove 171*a* is not formed in the orbiting key 171.

Meanwhile, an oil supply groove 171*a* is provided in the orbiting key accommodating portion 155 of the orbiting scroll 150 in which the Oldham ring 470 of the fourth embodiment is installed.

The groove is inclined from a point in contact with a lower point provided on the outer peripheral side of the Oldham ring 470 to a point in contact with the upper side provided on the inner peripheral side of the Oldham ring 470 on one inner circumferential surface of the orbiting key accommodating portion 155.

As an example, the groove may be inclined from a point on the lower side provided on the inner periphery side of the orbiting key accommodating portion 155 provided in the orbiting end plate portion 151 to a point on the upper side provided on the outer periphery side of the orbiting key accommodating portion 155.

FIG. 12B shows an example in which an inclined oil supply groove 155*a* is provided on the inner periphery of each of the orbiting key accommodating portions 155 spaced apart from each other by 180 degrees in the ring body 173.

In addition, in FIG. 12*b*, an example of a plurality of oil supply grooves 171*a* disposed to be inclined from the inner periphery of one orbiting key accommodating portion 155 and arranged to be spaced apart from each other is shown.

The oil supply groove 155*a* may be provided on at least one side surface of the key accommodating portion, the oil supply groove 155*a* may be inclined, the outer peripheral side of the Oldham ring is a lower end, and the inner peripheral side of the Oldham ring is an upper end.

FIG. 12B shows an example in which the oil supply groove 155*a* is inclined on the side of the orbiting key accommodating portion 155 of the orbiting scroll, is disposed to be spaced apart from each other, and is provided from the lower end of the outer periphery of the Oldham ring to the upper end of the inner periphery of the Oldham ring.

The inclined direction is a direction rising from the inner periphery of the orbiting key accommodating portion 155, and the oil that has received centrifugal force by the orbiting rotation of the orbiting scroll 150 may move to the inside of the inner periphery of the orbiting key accommodating portion 155, and at the same time, an upward flow of oil in contact with the orbiting key 171 of the Oldham ring 470 may be promoted.

In addition, the oil supply groove 155*a*-1 is provided on at least one side surface of the key accommodating portion, the oil supply groove 155*a* may be provided in a radial direction.

Figure 12C:
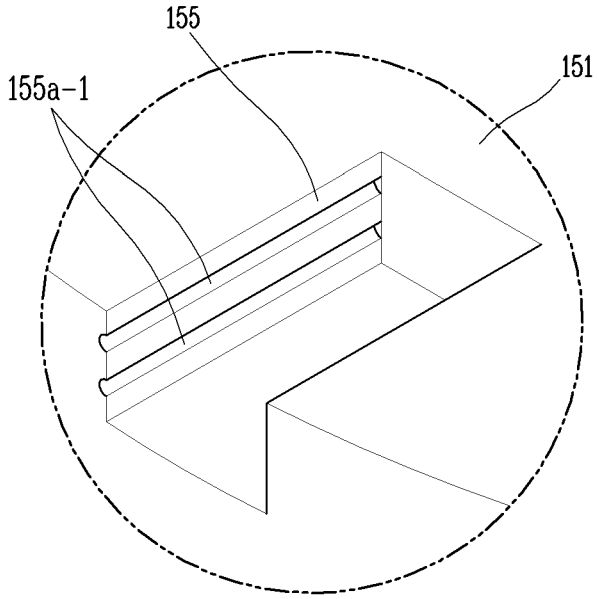
FIG. 12C is a perspective view showing a bottom surface of an orbiting scroll of another example on which the Oldham ring of the fourth embodiment is installed.

FIG. 12C shows an example in which the oil supply grooves 155*a*-1 are provided in the radial direction from the side surface of the orbiting key accommodating portion 155 of the orbiting scroll 150 and arranged to be spaced apart from each other.

When the oil supply groove 155*a*-1 is provided in the radial direction, it may be a structure advantageous to oil retention in the orbiting key accommodating portion 155.

Due to this structure, unlike the previous embodiments, even if there is no oil supply groove in the orbiting key 471 of the Oldham ring 470, the flow of oil in the orbiting key 471 is promoted by the oil supply groove 155*a* on the inner periphery of the orbiting key accommodating portion 155 in contact therewith.

In other words, as the oil supply groove 155*a* inclined in the vertical direction is provided on the inner periphery of the orbiting key accommodating portion 155 of the orbiting scroll 150, oil in contact with the Oldham ring 470 rises through the oil supply groove 155*a* on the inner periphery of the orbiting key accommodating portion 155 according to movement of the Oldham ring 470, the flow becomes more active in the orbiting key 171 of the Oldham ring 470 in contact therewith, the supply to the orbiting key 171 becomes smoother, and the number of parts in contact with oil on each surface of the orbiting key 171 increases, so that reliability may be improved.

In particular, like the Oldham rings 170, 270, and 370 in other embodiments, the Oldham ring 470 may further include a ring body 173. The ring body 173 may be provided in an annular shape, and the orbiting key 171 may be provided to protrude from one surface of the ring body 173 toward the orbiting key accommodating portion 155.

FIG. 7 shows an example in which the orbiting key 171 protrudes from the upper surface of the annular ring body 173 in a direction toward the orbiting end plate portion 151 of the orbiting scroll 150. In addition, an example in which two orbiting keys 171 have a shape of a rectangular parallelepiped and are spaced apart by 180 degrees apart is shown.

Unlike the Oldham rings 170, 270, and 370 in the first to third embodiments, the Oldham ring 470 of the fourth embodiment is different in that the oil supply groove 171*a* is not formed in the orbiting key 171. Meanwhile, in the fourth embodiment, like the Oldham rings 270 and 370 of the second to third embodiments, an oil supply hole 472*b* may be provided. In addition, an oil supply surface portion 473*a* may be provided to protrude on the outer periphery of the ring body 173.

The oil supply surface portion 473*a* has an inclined surface 473*b*, the inclined surface 473*b* is provided to be inclined so that the oil introduced into the lower part of the Oldham ring 470 may flow to the upper part.

The inclined surface 473*b* may be parallel to the formation direction of the oil supply hole 472*b*, for example.

The oil supply surface portion 473*a* may have a triangular shape having a predetermined width, as shown in FIG. 12A.

In addition, although not clearly shown in the drawings, the oil supply surface portion 473*a* may be provided not only on the outer periphery of the ring body 473 provided with the orbiting key 471, but also on the inner periphery of the ring body 473.

Due to this, the oil may flow upwards in both the outer periphery and the inner periphery of the oil supply surface portion 473*a*.

In addition, the orbiting key 471 may have a protruding side portion 471*b* that further protrudes in a direction toward at least one of the outer periphery and the inner periphery of the ring body 473. The oil supply surface portion 473*a* may be connected to the protruding side portion 471*b* to provide oil to the oil supply groove 471*a* through the upper portion of the inclined surface 473*b*. FIG. 12A shows the protruding side portion 471*b* protruding in the direction toward the outer periphery of the ring body 473 and the oil supply surface portion 473*a* connected thereto. The oil supply groove 471*a* may be provided to extend to a side end portion to be connected to the inclined surface 473*b* of the protruding side portion 471*b*.

Accordingly, the oil rising on the inclined surface 473*b* of the oil supply surface portion 473*a* may be more promoted to the upper part of the orbiting key 471 of the oil through the oil supply groove 471*a* extending to the protruding side portion 471*b*.

The oil accommodated in the Oldham ring accommodating portion 131*a* of the main frame 130 in the lower part of the Oldham ring 470 is induced to flow upwardly to be supplied to the upper surface of the ring body 473 from the outer periphery of the ring body 473 riding the inclined surface 473*b* by the oil supply surface portion 473*a* having the inclined surface 473*b*.

In addition, as the supply of oil to the upper surface of the ring body 473 is induced, the supply of oil to the inclined oil supply groove 171*a* provided in the vertical direction on one surface of the inner periphery of the orbiting key accommodating portion 155 becomes more active, the supply to the orbiting key 471 in contact therewith becomes smoother, and the number of parts in contact with oil on each surface of the orbiting key 471 increases, so that reliability may be improved.

Also, in the Oldham ring 470 shown in FIG. 12A, the oil supply hole 472*b* may be inclined in the ring body 473, and the oil supply hole 472*b* may pass through the upper and lower ends of the ring body 473 to be inclined.

In addition, the oil supply hole 472*b* may be provided so that the upper end is adjacent to the side of the orbiting key 471.

As shown in FIG. 12A, an example in which the oil supply hole 472*b* penetrates the upper surface of the ring body 473 so as to be adjacent to the left surface of the orbiting key 471, and maintains a predetermined angle, and the oil supply hole 472*b* is inclined is shown. In addition, an example in which the oil supply hole 472*b* is provided on the left and right sides of the orbiting key 471 to enable the flow of oil in both directions is shown in FIG. 13.

Due to the structure in which the oil supply hole 472*b* is inclined in the ring body 473 and penetrates the upper and lower ends of the ring body 473, the oil stored in the Oldham ring accommodating portion 131*a* may flow from the lower surface of the Oldham ring 470 to the upper surface through the oil supply hole 472*b*, while the Oldham ring 470 is moved with respect to the main frame 130.

In addition, as the supply of oil to the inclined oil supply groove 171*a* formed in the vertical direction on the inner periphery of the orbiting key accommodating portion 155 of the orbiting scroll 150 becomes more active, the supply of oil to the orbiting key 471 in contact with the inner periphery of the orbiting key accommodating portion 155 becomes smoother, and the number of parts in contact with oil on each side of the orbiting key 471 increases, so that reliability may be improved.

In particular, referring to the Oldham ring 470 illustrated in FIG. 12A, the inclined surface 473*b* and the oil supply hole 472*b* are provided side by side, so that when the Oldham ring 470 slides with respect to the main frame 130, oil at the bottom of the Oldham ring 470 may flow to the upper surface of the ring body 473 along the inclined end of the inclined surface 473*b* and the inclination angle of the oil supply hole 472*b* along the movement direction.

In the scroll compressor 100 of the present disclosure, the oil supply surface portion 473*a* provided with the inclined surface 473*b* is configured in the ring body 473 and the oil supply hole 472*b* is provided in the ring body 473 as described above, and thus, it is possible to improve the actual load efficiency according to the low pressure ratio operation by securing the low pressure ratio operation reliability.

Meanwhile, referring to FIGS. 7 and 8 and FIG. 12A, the Oldham ring 470 may further include a main key 175. In addition, the main frame 130 may be provided with a main key accommodating portion 131*b* for accommodating the main key 175 to be slidably inserted.

The main key 175 may be provided to protrude downward from the lower surface of the ring body 473 on the opposite side where the orbiting key 471 is provided, for example. In addition, as shown in FIGS. 7 and 8, two main keys 175 may be spaced apart at a 180 degree interval and may be alternately disposed, while maintaining a 90 degree interval with the orbiting key 471 in the circumferential direction.

The main key 175 may be provided in the shape of a rectangular parallelepiped, similar to the orbiting key 471. In addition, the main key accommodating portion 131*b* may be radially formed to accommodate the main key 175 in the main frame 130 to slide in the radial direction. An example of the main key accommodating portion 131*b* formed in the radial direction of the main frame 130 is shown, and in the drawing, the main key accommodating portion 131*b* is shown in the upper part and the lower part in the form of an elliptical long slot.

Meanwhile, referring to FIGS. 7 and 8, a support portion 477 may be provided between the two orbiting keys 471 on the upper surface of the ring body 473, and a support portion 477 may also be provided between two main keys 475 on the lower surface of the ring body 473. The support portion 477 of the upper surface of the ring body 473 may be in contact with the orbiting scroll 150, and the support portion 477 of the upper surface of the ring body 473 may be in contact with the main frame 430. The Oldham ring may slide, while being supported between the main frame 430 and the orbiting scroll 150 by the support portions 477 respectively provided on the upper and lower surfaces of the ring body 473.

The Oldham ring 470 prevents rotation of the orbiting scroll 150 by the structure in which the main key 175 slides on the main key accommodating portion 131*b* and the orbiting key 471 slides on the orbiting key accommodating portion 155.

Hereinafter, among the scroll compressors 200 of the present disclosure, the bottom compression type scroll compressor 200 in which the compression unit is disposed below the driving motor 220 will be described below.

The scroll compressor 200 of the present disclosure includes a casing 210, a main frame 230, a rotating shaft 225, an orbiting scroll 250, a fixed scroll 240, and an Oldham ring 570.

In addition, the Oldham ring 570 includes a ring body 573 and a key portion.

The ring body 573 is provided in an annular shape, is provided between the main frame 230 and the orbiting scroll 250, and is supported in the axial direction of the rotating shaft 225.

The key portion extends in the axial direction from the ring body 573 and is slidably inserted into the key accommodating portion provided in the orbiting scroll 250, the main frame 230, or the fixed scroll 240.

The key portion may include a main key 575 to be described later. In addition, the key portion may include an orbiting key 571.

The key accommodating portion may include a main key accommodating portion 231*b* to be described later. In addition, the key accommodating portion may include an orbiting key accommodating portion 255 to be described later.

The ring body 173 or the key portion is provided with an oil supply passage, the oil supply passage is configured to guide the oil accumulated in the member supported by the ring body 173 between the key portion and the key accommodating portion.

The oil supply passage may be at least one of the oil supply groove 171*a*, the oil supply hole 272*b* and the oil supply surface portion 373*a*, which will be described later.

A plurality of scrolls are configured to engage with each other. Also, the plurality of scrolls include orbiting scrolls 250.

In the orbiting scroll 250, at least one of the scrolls is coupled to the rotating shaft 225 to perform an orbiting motion.

The Oldham ring 570 is installed on the orbiting scroll 250, is slidably coupled to the orbiting scroll 250, and induces the orbiting motion of the orbiting scroll 250.

The main frame 230 is installed on the opposite side of the orbiting scroll 250 with the Oldham ring 570 interposed therebetween, and accommodates the orbiting scroll 250 to perform an orbiting motion.

At least one main key accommodating portion 231*b* is provided in the main frame 230. In addition, the Oldham ring 570 is provided with at least one main key 575 that is slidably inserted into the main key accommodating portion 231*b*.

In addition, an oil supply groove 535*a* is provided to be inclined from a lower side to an upper side on at least one side of the main key 575 or at least one inner circumferential surface of the main key accommodating portion 231*b* so that oil may flow from a lower end to an upper end of the main key 575.

In relation to the present disclosure, the structure enabling more active and direct oil supply with the key of the Oldham ring 570 will be described in more detail later.

Figure 14:
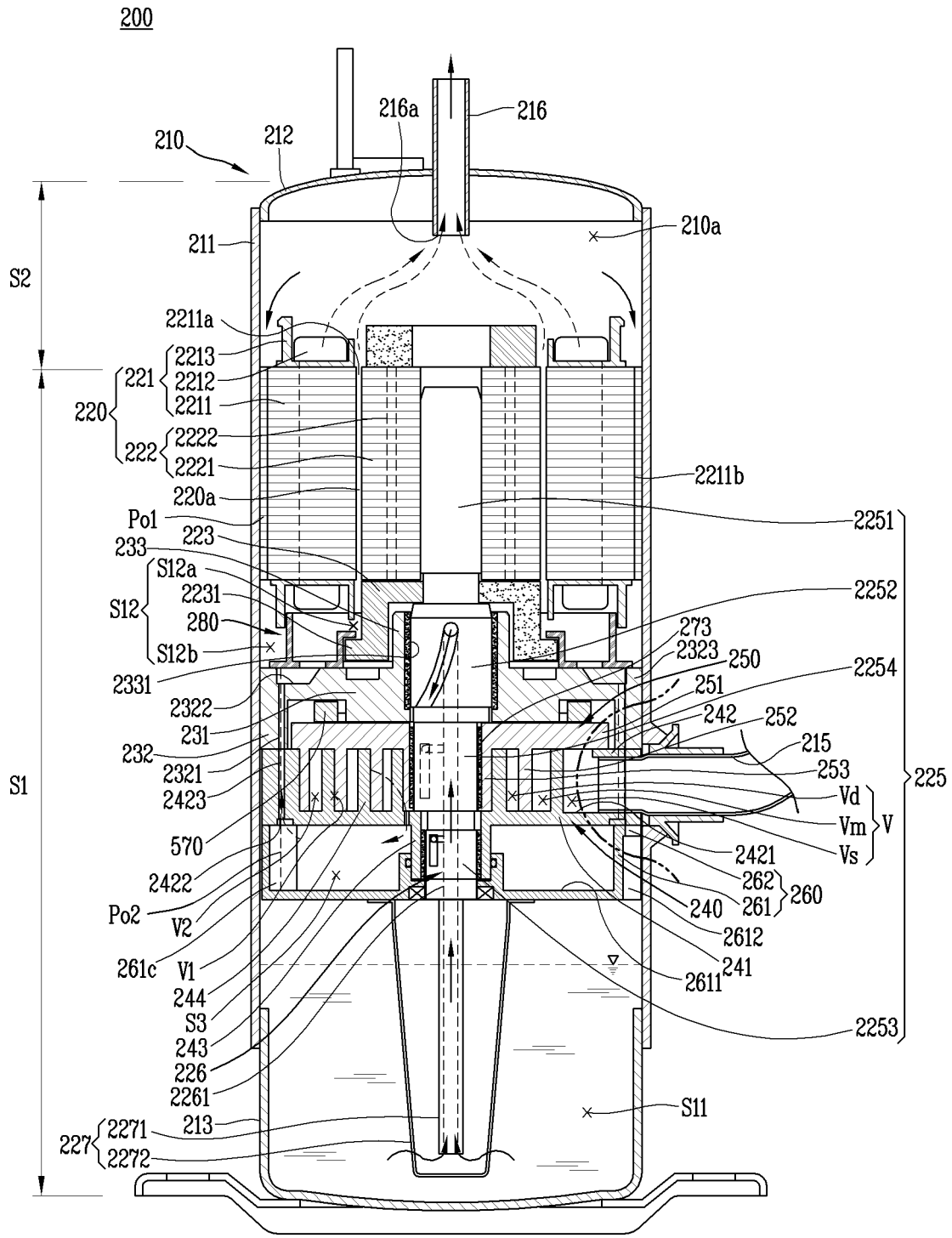
FIG. 14 is a cross-sectional view showing a bottom compression type scroll compressor of the present disclosure.

FIG. 14 is a cross-sectional view showing a bottom compression type scroll compressor 200 of the present disclosure.

Referring to FIG. 14, in a bottom compression type scroll compressor 200 (hereinafter, abbreviated as scroll compressor 200) according to the present embodiment, a driving motor 220 forming an electric part in the upper half of a casing 210 is installed, and the main frame 230, the fixed scroll 240, the orbiting scroll 250, and the discharge cover 260 are sequentially installed on the lower side of the driving motor 220. In general, the driving motor 220 forms an electric part, and the main frame 230, the fixed scroll 240, the orbiting scroll 250, and the discharge cover 260 form a compression unit.

The electric part is coupled to the upper end of the rotating shaft 225 to be described later, and the compression unit is coupled to the lower end of the rotating shaft 225. Accordingly, the compressor forms the bottom compression type structure described above, and the compression unit is connected to the electric part by the rotating shaft 225 and is operated by the rotational force of the electric part.

Referring to FIG. 14, in the casing 210 of the scroll compressor 200 according to the present embodiment, a driving motor 220, a main frame 230, a fixed scroll 240, an orbiting scroll 250, and a discharge cover 260 are installed. The casing 210 may include a cylindrical shell 211, an upper shell 212, and a lower shell 213. The cylindrical shell 211 may have a cylindrical shape in which both upper and lower ends are opened, the upper shell 212 may be coupled to cover the opened upper end of the cylindrical shell 211, and the lower shell 213 may be the coupled to cover the opened lower end of the cylindrical shell 211.

Accordingly, the internal space 210*a* of the casing 210 may be sealed. The sealed internal space 210*a* of the casing 210 may be divided into a lower space S1 and an upper space S2 based on the driving motor 220.

The lower space S1 may be a space defined below the driving motor 220. The lower space S1 may be further divided into an oil storage space S11 and a discharge space S12 with the compression unit therebetween.

The oil storage space S11 may be a space defined below the compression unit to store oil or mixed oil in which liquid refrigerant is mixed. The discharge space S12 may be a space defined between an upper surface of the compression unit and a lower surface of the driving motor 220. Refrigerant compressed in the compression unit or mixed refrigerant in which oil is contained may be discharged into the discharge space S12.

The upper space S2 may be a space defined above the driving motor 220 to form an oil separating space in which oil is separated from refrigerant discharged from the compression unit. A refrigerant discharge pipe 216 may communicate with the upper space S2.

The driving motor 220 and the main frame 230 may be fixedly inserted into the cylindrical shell 211. An outer circumferential surface of the driving motor 220 and an outer circumferential surface of the main frame 230 may be respectively provided with an oil recovery passages Po1 and Po2 each spaced apart from an inner circumferential surface of the cylindrical shell 211 by a predetermined distance. This will be described again later together with the oil recovery passage.

A refrigerant suction tube 215 may be coupled through a side surface of the cylindrical shell 211. Accordingly, the refrigerant suction tube 215 may be coupled through the cylindrical shell 211 forming the casing 210 in a radial direction.

Although not illustrated in the drawings, the refrigerant suction tube 215 may be provided in an L-like shape. One end of the refrigerant suction tube 115 may be inserted through the cylindrical shell 211 to directly communicate with a suction port 2421 of the fixed scroll 240, which configures the compression unit. Accordingly, refrigerant may be introduced into a compression chamber V through the refrigerant suction tube 215.

Another end of the refrigerant suction tube 215 may be connected to an accumulator (not illustrated) which defines a suction passage outside the cylindrical shell 211. The accumulator (not illustrated) may be connected to an outlet side of the evaporator (not illustrated) through a refrigerant pipe. Accordingly, while refrigerant flows from the evaporator to the accumulator, liquid refrigerant may be separated in the accumulator, and only gaseous refrigerant may be directly introduced into the compression chamber V through the refrigerant suction tube 215.

A terminal bracket (not shown) may be coupled to an upper portion of the cylindrical shell 211 or the upper shell 212, and a terminal (not shown) for transmitting external power to the driving motor 220 may be coupled through the terminal bracket.

An inner end 216*a* of the refrigerant discharge tube 216 may be coupled through an upper portion of the upper shell 212 to communicate with the internal space 210*a* of the casing 210, specifically, the upper space S2 defined above the driving motor 220.

The refrigerant discharge tube 216 may correspond to a passage through which compressed refrigerant discharged from the compression unit to the internal space 210*a* of the casing 210 is externally discharged toward a condenser (not illustrated). The refrigerant discharge tube 216 may be disposed coaxially with the rotating shaft 225 to be described later. Accordingly, a venturi tube 291 to be described later disposed in parallel with the refrigerant discharge tube 216 may be eccentrically disposed with respect to an axial center of the rotating shaft 225.

The refrigerant discharge tube 216 may be provided therein with an oil separator (not shown) for separating oil from refrigerant discharged from the compressor 200 to the condenser, or a check valve (not shown) for suppressing refrigerant discharged from the compressor 200 from flowing back into the compressor 200.

One end portion of an oil circulation tube (not illustrated) may be coupled through a lower end portion of the lower shell 213. Both ends of the oil circulation tube may be open, and another end portion of the oil circulation tube may be coupled through the refrigerant suction tube 215. An oil circulation valve (not illustrated) may be installed in a middle portion of the oil circulation tube.

The oil circulation valve may be open or closed according to an amount of oil stored in the oil storage space S11 or according to a set condition. For example, the oil circulation valve may be open to circulate oil stored in the oil storage space to the compression unit through the suction refrigerant pipe at the beginning of the operation of the compressor, while being closed to prevent an excessive outflow of oil within the compressor during a normal operation.

Hereinafter, the driving motor 220 constituting the motor unit will be described with reference to FIG. 14. The driving motor 220 according to this implementation may include a stator 221 and a rotor 222. The stator 221 may be fixed onto the inner circumferential surface of the cylindrical shell 211, and the rotor 222 may be rotatably disposed in the stator 221.

The stator 221 may include a stator core 2211 and a stator coil 2212.

The stator core 2211 may be provided in an annular shape or a hollow cylindrical shape and may be shrink-fitted onto the inner circumferential surface of the cylindrical shell 211.

A rotor accommodating portion 2211*a* may be provided in a circular shape through a central portion of the stator core 2211 such that the rotor 222 may be rotatably inserted therein. A plurality of stator-side return grooves 2211*b* may be recessed or cut out in a D-cut shape at an outer circumferential surface of the stator core 2211 along the axial direction and disposed at preset distances along a circumferential direction.

A plurality of teeth (not illustrated) and slots (not illustrated) may be alternately formed on an inner circumferential surface of the rotor accommodating portion 2211*a* in the circumferential direction, and the stator coil 2212 may be wound on each tooth by passing through the slots at both sides of the tooth.

More precisely, the slots may be spaces between circumferentially neighboring stator coils. Each slot may define an inner passage 220*a*, and a gap passage 220*b* may be defined between an inner circumferential surface of the stator core 2211 and an outer circumferential surface of the rotor core 2221. Each of the oil return grooves 2211*d* may define an outer passage 220*c*. The inner passages 220*a* and the gap passage 220*b* may define a passage through which refrigerant discharged from the compression unit moves to the upper space S2, and the outer passages 220*c* may define a first oil recovery passage Po1 through which oil separated in the upper space S2 is returned to the oil storage space S11.

The stator coil 2212 may be wound around the stator core 2211 and may be electrically connected to an external power source through a terminal (not illustrated) that is coupled through the casing 210. An insulator 2213, which is an insulating member, may be inserted between the stator core 2211 and the stator coil 2212.

The insulator 2213 may be provided at an outer circumferential side and an inner circumferential side of the stator coil 2212 to accommodate a bundle of the stator coil 1212 in the radial direction, and may extend to both sides in the axial direction of the stator core 2211.

The rotor 222 may include a rotor core 2221 and permanent magnets 2222.

The rotor core 2221 may be provided in a cylindrical shape to be accommodated in the rotor accommodating portion 2211*a* defined in the central portion of the stator core 2211.

Specifically, the rotor core 2221 may be rotatably inserted into the rotor accommodating portion 2211*a* of the stator core 2211 with a predetermined gap 220*a* therebetween. The permanent magnets 2222 may be embedded in the rotor core 2221 at preset intervals along the circumferential direction.

A balance weight 223 may be coupled to a lower end of the rotor core 2221. Alternatively, the balance weight 223 may be coupled to a main shaft portion 2251 of the rotating shaft 225 to be described later. This implementation will be described based on an example in which the balance weight 223 is coupled to the rotating shaft 225. The balance weight 223 may be disposed on each of a lower end side and an upper end side of the rotor, and the two balance weights 123 may be installed symmetrically to each other.

The rotating shaft 225 may be coupled to the center of the stator core 2211. An upper end portion of the rotating shaft 225 may be press-fitted into the rotor 222, and a lower end portion may be rotatably inserted into the main frame 230 to be supported in the radial direction.

The main frame 230 may be provided with a main bearing 271 configured as a bush bearing to support the lower end portion of the rotating shaft 225. Accordingly, a portion, which is inserted into the main frame 230, of the lower end portion of the rotating shaft 225 may smoothly rotate inside the main frame 230.

The rotating shaft 225 may transfer a rotational force of the driving motor 220 to the orbiting scroll 250 constituting the compression unit. Accordingly, the orbiting scroll 250 eccentrically coupled to the rotating shaft 225 may perform an orbiting motion with respect to the fixed scroll 240.

Referring to FIG. 14, the rotating shaft 225 according to the implementation may include a main shaft portion 2251, a first bearing portion 2252, a fixing bearing portion 2253, and an eccentric portion 2254.

The main shaft portion 2251 may be an upper portion of the rotating shaft 225 and may be provided in a cylindrical shape. The main shaft portion 2251 may be partially press-fitted into the stator core 2211.

The first bearing portion 2252 may be a portion extending from a lower end of the main shaft portion 2251. The first bearing portion 2252 may be inserted into a main bearing hole 2331 of the main frame 230 so as to be supported in the radial direction.

The fixing bearing portion 2253 may be a lower portion of the rotating shaft 225. The fixing bearing portion 2253 may be inserted into a sub bearing hole 2431 of a fixed scroll 240 to be described later so as to be supported in the radial direction. A central axis of the fixing bearing portion 2253 and a central axis of the first bearing portion 2252 may be aligned on the same line. That is, the first bearing portion 2252 and the fixing bearing portion 2253 may have the same central axis.

The eccentric portion 2254 may be provided between a lower end of the first bearing portion 2252 and an upper end of the fixing bearing portion 2253. The eccentric portion 2254 may be inserted into a rotating shaft coupling portion 253 of the orbiting scroll 250 to be described later.

The eccentric portion 2254 may be eccentric with respect to the first bearing portion 2252 or the fixing bearing portion 2253 in the radial direction. That is, a central axis of the eccentric portion 2254 may be eccentric with respect to the central axis of the first bearing portion 2252 and the central axis of the fixing bearing portion 2253. Accordingly, when the rotating shaft 225 rotates, the orbiting scroll 250 may perform an orbiting motion with respect to the fixed scroll 240.

Meanwhile, an oil supply passage 226 for supplying oil to the first bearing portion 2252, the fixing bearing portion 2253, and the eccentric portion 2254 may be provided in a hollow shape in the rotating shaft 225. The oil supply passage 226 may include an inner oil passage 2261 defined in the rotating shaft 225 along the axial direction.

As the compression unit is located below the motor unit 20, the inner oil passage 2261 may be provided in a grooving manner from the lower end of the rotating shaft 225 approximately to a lower end or a middle height of the stator 221 or up to a position higher than an upper end of the first bearing portion 2252. Although not illustrated, the inner oil passage 2261 may alternatively be formed through the rotating shaft 225 in the axial direction.

An oil pickup 227 for pumping up oil filled in the oil storage space S11 may be coupled to the lower end of the rotating shaft 225, namely, a lower end of the fixing bearing portion 2253. The oil pickup 227 may include an oil supply tube 2271 inserted into the inner oil passage 2261 of the rotating shaft 225, and a blocking member 2272 accommodating the oil supply tube 2271 to block an introduction of foreign materials. The oil supply tube 2271 may extend downward through the discharge cover 260 to be immersed in the oil filled in the oil storage space S11.

The rotating shaft 225 may be provided with a plurality of oil supply holes communicating with the inner oil passage 2261 to guide oil moving upward along the inner oil passage 2261 toward the first and fixing bearing portions 2252 and 2253 and the eccentric portion 2254.

Referring to FIG. 14, the compression unit according to the present embodiment includes a main frame 230, a fixed scroll 240, an orbiting scroll 250, a discharge cover 260, and a flow path guide 280 (FIG. 14).

The main frame 230 includes a frame end plate portion 231, a frame side wall portion 232, and a main bearing accommodating portion 233.

The frame end plate portion 231 is provided in an annular shape and is installed below the driving motor 220. The frame side wall portion 232 extends from the edge of a lower surface of the frame end plate portion 231 in a cylindrical shape, and the outer circumferential surface of the frame side wall portion 232 is fixed to the inner circumferential surface of the cylindrical shell 211 by hot pressing or by welding. Accordingly, the oil storage space S11 and the discharge space S12 constituting the lower space S1 of the casing 210 are separated by the frame end plate portion 231 and the frame side wall portion 232.

Figure 15:
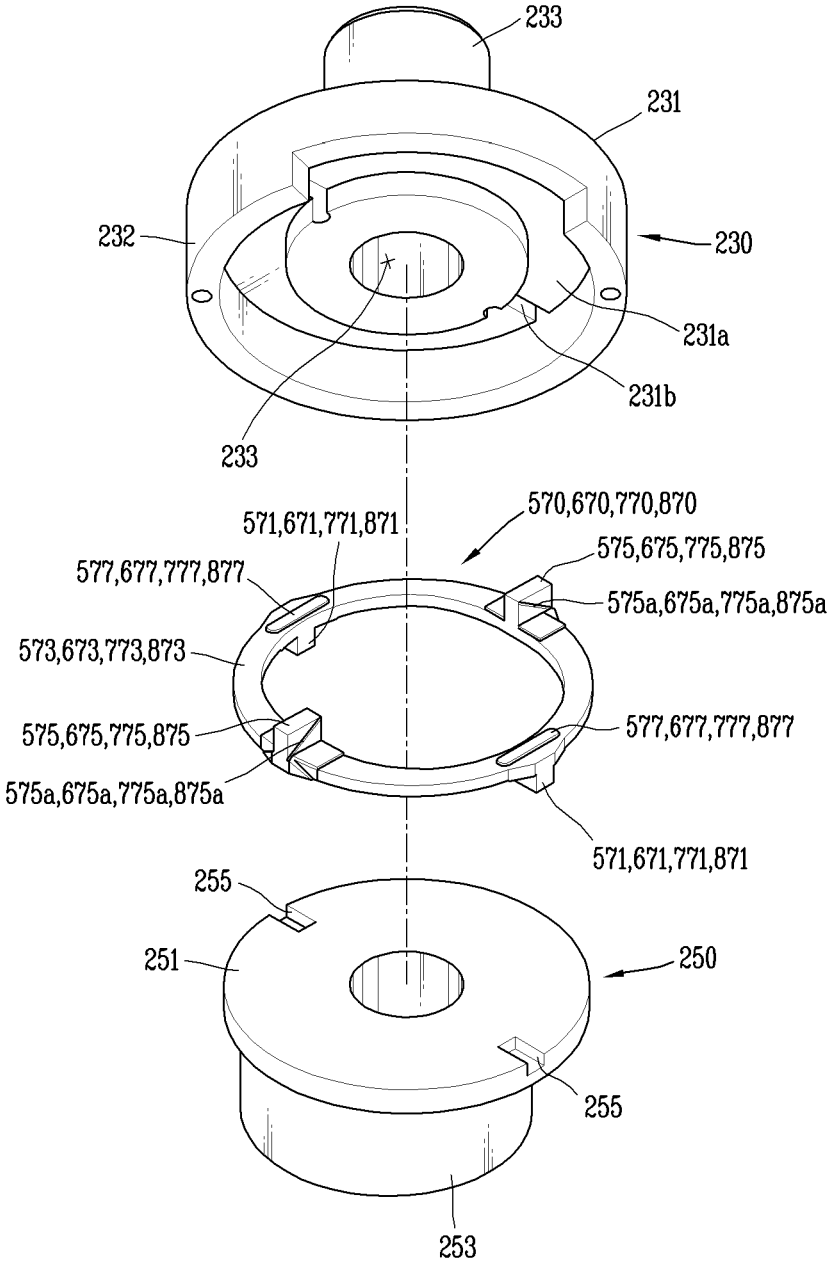
FIG. 15 is an exploded perspective view illustrating a main frame, an Oldham ring, and an orbiting scroll in FIG. 14.
Figure 16:
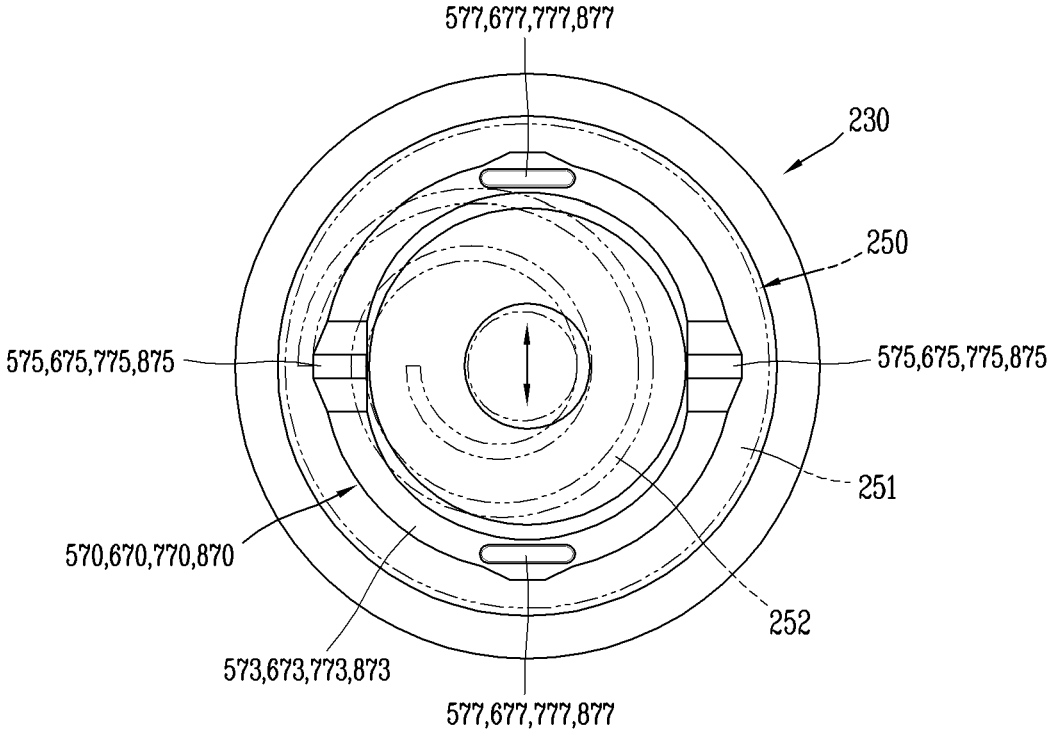
FIG. 16 is a plan view showing an example in which an Oldham ring is installed in an orbiting scroll and an Oldham ring accommodating portion of a main frame.
Figure 17:
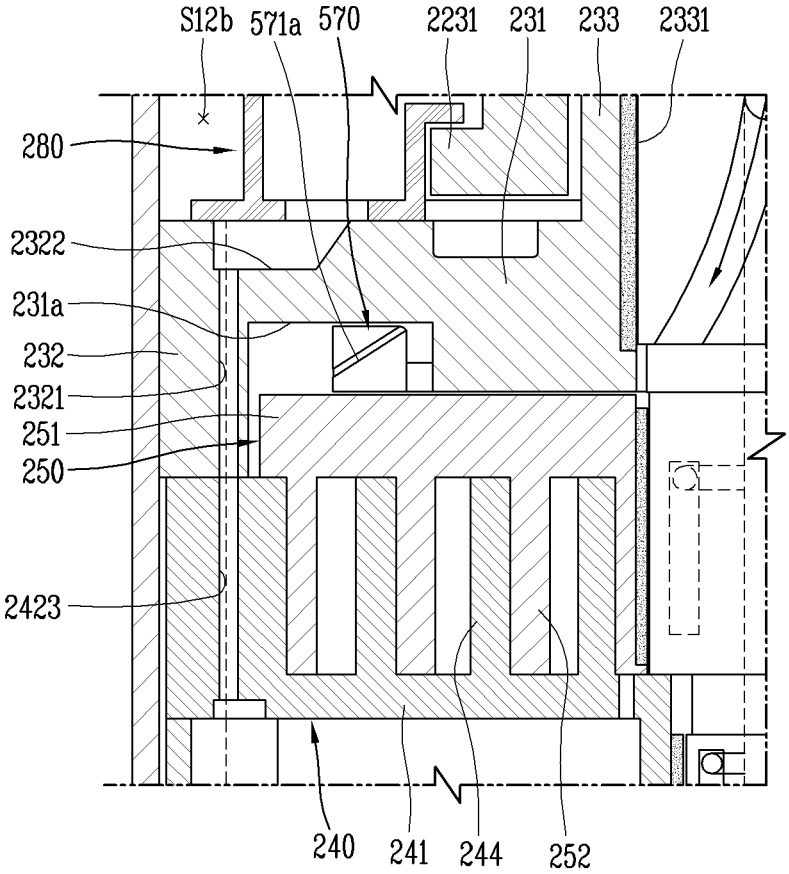
FIG. 17 is an enlarged cross-sectional view of a portion in which an Oldham ring is installed in a compression unit in FIG. 14.
Figure 18:
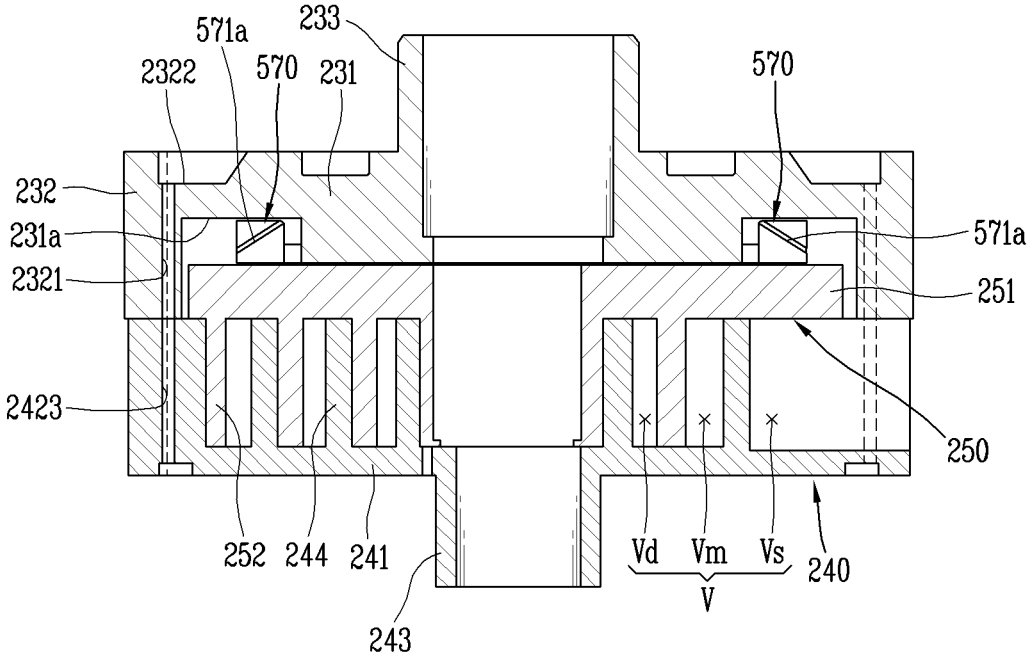
FIG. 18 is a cross-sectional view showing an Oldham ring installed between a main frame and an orbiting scroll.

In addition, referring to FIGS. 14 and 15, an Oldham ring accommodating portion 231*a* is provided on a bottom surface of the frame end plate portion 231, and a main key accommodating portion 231*b* may be provided in the Oldham ring accommodating portion 231*a*. Two main key accommodating portions 231*b* formed in the Oldham ring accommodating portion 231*a* may be provided with a phase difference of approximately 180° along the circumferential direction. The main key accommodating portion 231*b* is provided as a groove having a predetermined depth and width and allows the main key 575 to be slidably accommodated.

In FIG. 14 and the like, the aforementioned top compression type scroll compressor 200 has a structure in which the main frame 230, the orbiting scroll 250, and the fixed scroll 240 are sequentially disposed on the driving motor 220, so that the Oldham ring accommodating portion 231*a* is disposed on the upper surface of the main frame 230.

Meanwhile, the bottom compression type scroll compressor 200 of FIG. 14 has a structure in which the main frame 230, the orbiting scroll 250, and the fixed scroll 240 are sequentially disposed below the driving motor 220, and compared to the top compression type scroll compressor 200, the main frame 230 is arranged upside down, and thus, the Oldham ring accommodating portion 231*a* is provided on a bottom surface of the main frame 230.

For example, the Oldham ring accommodating portion 231*a* may be provided in an annular shape to accommodate the ring-shaped Oldham ring 570. A width of the annular shape of the Oldham ring accommodating portion 231*a* is preferably wider than the width of the ring body 573 of the Oldham ring 570 to accommodate the Oldham ring 570 without interference.

Meanwhile, unlike the top compression type scroll compressor 200, in the bottom compression type scroll compressor 200, the Oldham ring accommodating portion 231*a* is disposed above the Oldham ring 570, so the oil sucked from the oil storage space cannot be accommodated in the Oldham ring accommodating portion 231*a* and oil may be provided to the oil supply groove 575*a* and the oil supply hole 572*b* of the Oldham ring 570 through between the main frame 230 and the orbiting scroll 250.

The main key accommodating portion 231*b* may be provided to cross the Oldham ring accommodating portion 231*a* in a radial direction with respect to a circumferential direction in which the ring body 573 of the Oldham ring 570 is disposed. As will be described later, as the main key 575 is accommodated in the main key accommodating portion

231*b* and moved, the Oldham ring 570 may slide in the radial direction in which the main key accommodating portion 231*b* is provided.

The main key accommodating portion 231*b* is provided by a length longer than the main key 575 in the direction in which the main key 575 of the Oldham ring 570 slides so that the main key 575 may move by a predetermined distance.

The main key 575 of the Oldham ring 570, which will be described later, may be slidably inserted into the main key accommodating portion 231*b* in the radial direction. In this case, a liner forming a wear preventing member may be inserted into the main key accommodating portion 231*b* or the main key 575 of the Oldham ring 570 inserted into the main key accommodating portion 231*b* may be formed of different material (dissimilar material).

For example, when the main frame 230 is formed of the same material as the main key 575 of the Oldham ring 570, a liner formed of a material different from the main frame 230 or the Oldham ring 570 may be provided so that wear between the main frame 230 and the Oldham ring 570 may be suppressed. Alternatively, the main key 575 may be post-assembled to the ring body 573 constituting the Oldham ring 570, and the main key 575 may be formed of a different material from the main frame 230. However, as in this embodiment, the main frame 230 and the ring body 573 of the Oldham ring 570 are formed of different materials (for example, the main frame 230 is formed of cast iron, and the first key of the Oldham ring 570 is formed of an aluminum material), there is no need to install a separate liner in the main key accommodating portion 231*b*.

An orbiting key accommodating portion 255 is provided on one side of the orbiting end plate portion 251, that is, on the opposite side of the orbiting wrap 252, and an orbiting key 571 forming a portion of the Oldham ring 570 to be described later may be installed in the orbiting key accommodating portion 255. Two orbiting keys 571 may be provided with a phase difference of approximately 180° in the circumferential direction in the Oldham ring 570.

In the bottom compression type scroll compressor 200, the orbiting key 571 or the orbiting key accommodating portion 255 is not provided with an oil supply groove 575*a* that enables oil to flow to the orbiting key 571. Meanwhile, an oil supply groove 231*c* is provided in the main key 575 or the main key accommodating portion 231*b*.

A structure in which the oil supply grooves 575*a* and 231*c* are provided in the main key 575 or the main key accommodating portion 231*b* will be described again later together with the Oldham ring 570.

A frame discharge hole (hereinafter, a second discharge hole) 2321 forming a portion of a discharge passage may be provided through the frame side wall 232 in the axial direction. The second discharge hole 2321 may be provided to correspond to a scroll discharge hole (first discharge hole) 2422 of the fixed scroll 240 to be described later, to define a refrigerant discharge passage (no reference numeral given) together with the first discharge hole 2422.

The second discharge hole 2321 may be elongated in the circumferential direction, or may be provided in plurality disposed at preset intervals along the circumferential direction. Accordingly, the second discharge hole 2321 may secure a volume of a compression chamber relative to the same diameter of the main frame 230 by maintaining a minimum radial width with securing a discharge area. This may equally be applied to the first discharge hole 2422 that is provided in the fixed scroll 240 to define a portion of the discharge passage.

A discharge guide groove 2322 to accommodate the plurality of second discharge holes 2321 may be provided in an upper end of the second discharge hole 2321, namely, an upper surface of the frame end plate 231. At least one discharge guide groove 2322 may be provided according to positions of the second discharge holes 2321. For example, when the second discharge holes 2321 form three groups, the number of discharge guide grooves 2322 may be three to accommodate the three groups of second discharge holes 2321, respectively. The three discharge guide grooves 2322 may be located on the same line in the circumferential direction.

The discharge guide groove 2322 may be provided wider than the second discharge hole 2321. For example, the second discharge hole 2321 may be provided on the same line in the circumferential direction together with a first oil return groove 2323 to be described later. Therefore, when a flow path guide 280 to be described later is provided, the second discharge hole 2321 having a small cross-sectional area may be difficult to be located at an inner side of the flow path guide 280. With this reason, the discharge guide groove 2322 may be provided at an end portion of the second discharge hole 2321 while an inner circumferential side of the discharge guide groove 2322 extends radially up to the inner side of the flow path guide 280.

Accordingly, the second discharge hole 2321 may be located adjacent to the outer circumferential surface of the main frame 230 by reducing an inner diameter of the second discharge hole 2321, and simultaneously may be prevented from being located at an outer side of the flow path guide 280, namely, adjacent to the outer circumferential surface of the stator 221.

A frame oil return groove (hereinafter, first oil return groove) 2323 that defines a portion of a second oil recovery passage Po2 may be provided axially through an outer circumferential surface of the frame end plate 231 and an outer circumferential surface of the frame side wall 232 that define the outer circumferential surface of the main frame 230. The first oil return groove 2323 may be provided by only one or may be provided in plurality disposed in the outer circumferential surface of the main frame 230 at preset intervals in the circumferential direction. Accordingly, the discharge space S12 of the casing 210 may communicate with the oil storage space S11 of the casing 210 through the first oil return groove 2323.

The first oil return groove 2323 may be provided to correspond to a scroll oil return groove (hereinafter, second oil return groove) 2423 of the fixed scroll 240, which will be described later, and define the second oil recovery passage together with the second oil return groove 2423 of the fixed scroll 240.

The main bearing accommodating portion 233 may protrude upward from an upper surface of a central portion of the frame end plate 231 toward the driving motor 220. The main bearing accommodating portion 233 may be provided with a main bearing hole 2331 formed therethrough in a cylindrical shape along the axial direction. The first bearing portion 2252 of the rotating shaft 225 may be inserted into the main bearing hole 2331 to be supported in the radial direction.

Hereinafter, the fixed scroll 240 will be described with reference to FIG. 14. The fixed scroll 240 according to the implementation may include a fixed end plate 241, a fixed side wall 242, a sub bearing portion 243, and a fixed wrap 244.

The fixed end plate 241 may be provided in a disk shape having a plurality of concave portions on an outer circumferential surface thereof, and a sub bearing hole 2431 defining the sub bearing portion 243 to be described later may be provided through a center of the fixed end plate portion 141 in the vertical direction. Discharge ports 2411 and 1412 may be provided around the sub bearing hole 2431. The discharge ports 1411 and 1412 may communicate with a discharge pressure chamber Vd so that compressed refrigerant is moved into the discharge space S12 of the discharge cover 260 to be explained later.

Although not shown, only one discharge port may be provided to communicate with both of a first compression chamber V1 and a second compression chamber V2 to be described later. In the implementation, however, a first discharge port (no reference numeral given) may communicate with the first compression chamber V1 and a second discharge port (no reference numeral given) may communicate with the second compression chamber V2. Accordingly, refrigerant compressed in the first compression chamber V1 and refrigerant compressed in the second compression chamber V2 may be independently discharged through the different discharge ports.

The fixed side wall 242 may extend in an annular shape from an edge of an upper surface of the fixed end plate 241 in the vertical direction. The fixed side wall 242 may be coupled to face the frame side wall 232 of the main frame 230 in the vertical direction.

A scroll discharge hole (hereinafter, first discharge hole) 2422 may be provided through the fixed side wall 242 in the axial direction. The first discharge hole 2422 may be elongated in the circumferential direction, or may be provided in plurality disposed at preset intervals along the circumferential direction. Accordingly, the first discharge hole 2422 may secure a volume of a compression chamber relative to the same diameter of the fixed scroll 240 by maintaining a minimum radial width with securing a discharge area.

The first discharge hole 2422 may communicate with the second discharge hole 2321 in a state in which the fixed scroll 240 is coupled to the cylindrical shell 211. Accordingly, the first discharge hole 2422 may define a refrigerant discharge passage together with the second discharge hole 2321.

A second oil return groove 2423 may be provided in an outer circumferential side wall 242. The second oil return groove 2423 may communicate with the first oil return groove 2323 provided at the main frame 230 to guide oil returned along the first oil return groove 2323 to the oil storage space S11. Accordingly, the first oil return groove 2323 and the second oil return groove 2423 may define the second oil recovery passage Po2 together with an oil return groove 2612 of the discharge cover 260 to be described later.

The fixed side wall 242 may be provided with a suction port 2421 formed through the fixed side wall 242 in the radial direction. An end portion of the refrigerant suction tube 215 inserted through the cylindrical shell 211 may be inserted into the suction port 2421. Accordingly, refrigerant may be introduced into a compression chamber V through the refrigerant suction tube 215.

The sub bearing portion 243 may extend in the axial direction from a central portion of the fixed end plate 241 toward the discharge cover 260. A sub bearing hole 2431 having a cylindrical shape may be provided through a center of the sub bearing portion 243 in the axial direction, and the fixing bearing portion 2253 of the rotating shaft 225 may be inserted into the sub bearing hole 2431 to be supported in the radial direction. Therefore, the lower end (or the fixing bearing portion) of the rotating shaft 225 may be radially supported by being inserted into the sub bearing portion 243 of the fixed scroll 240, and the eccentric portion 2254 of the rotating shaft 225 may be supported in the axial direction by an upper surface of the fixed end plate 241 defining the surrounding of the sub bearing portion 243.

A fixed wrap 244 may extend from the upper surface of the fixed end plate 241 toward the orbiting scroll 250 in the axial direction. The fixed wrap 244 may be engaged with an orbiting wrap 252 to be described later to define the compression chamber V. The fixed wrap 244 will be described later together with the orbiting wrap 252.

Hereinafter, the orbiting scroll 250 will be described with reference to FIG. 14. The orbiting scroll 250 according to the present embodiment includes an orbiting end plate portion 251, an orbiting wrap 252, and a rotating shaft coupling portion 253.

The orbiting end plate portion 251 has a disk shape and is accommodated in the main frame 230. An upper surface of the orbiting end plate portion 251 may be supported in the axial direction with a back pressure sealing member (no reference numeral given) interposed therebetween by the main frame 230.

An orbiting key 571 forming a portion of the Oldham ring 570 to be described later may be installed on one surface of the orbiting end plate portion 251, that is, on the opposite surface of the orbiting wrap 252. Two orbiting keys 571 may be provided with a phase difference of approximately 180° in the circumferential direction in the Oldham ring 570.

Referring to FIGS. 14 and 15, an example in which the Oldham ring 570 is installed on the upper surface of the orbiting end plate portion 251 is shown.

The orbiting key 571 may extend in the axial direction toward the Oldham ring 570 so as to be slidably inserted into the orbiting key accommodating portion 255 of the Oldham ring 570 to be described later in a radial direction. The orbiting key 571 will be described again later with the Oldham ring 570.

The orbiting wrap 252 may extend from a lower surface of the orbiting end plate 251 toward the fixed scroll 240. The orbiting wrap 252 may be engaged with the fixed wrap 244 to define the compression chamber V.

The orbiting wrap 252 may be provided in an involute shape together with the fixed wrap 244. However, the orbiting wrap 252 and the fixed wrap 244 may be provided in various shapes other than the involute shape.

For example, the orbiting wrap 252 may be provided in a substantially elliptical shape in which a plurality of arcs having different diameters and origins are connected and the outermost curve may have a major axis and a minor axis. The fixed wrap 244 may also be formed in a similar manner.

An inner end portion of the orbiting wrap 252 may be provided at a central portion of the orbiting end plate 251, and the rotating shaft coupling portion 253 may be provided through the central portion of the orbiting end plate 251 in the axial direction.

The eccentric portion 2254 of the rotating shaft 225 may be rotatably inserted into the rotating shaft coupling portion 253. An outer circumferential part of the rotating shaft coupling portion 253 may be connected to the orbiting wrap 252 to define the compression chamber V together with the fixed wrap 244 during a compression process.

The rotating shaft coupling portion 253 may be provided at a height at which it overlaps the orbiting wrap 252 on the same plane. That is, the rotating shaft coupling portion 253 may be disposed at a height at which the eccentric portion 2254 of the rotating shaft 225 overlaps the orbiting wrap 252 on the same plane. Accordingly, repulsive force and compressive force of refrigerant may cancel each other while being applied to the same plane based on the orbiting end plate 251, and thus inclination of the orbiting scroll 250 due to interaction between the compressive force and the repulsive force may be suppressed.

The rotating shaft coupling portion 253 may include a coupling side portion 253*a* that is in contact with the outer periphery of the orbiting bearing 273 to support the orbiting bearing 273.

In addition, the rotating shaft coupling portion 253 may further include a coupling end (not shown) that is in contact with one end of the orbiting bearing 273 to support the orbiting bearing 273.

Meanwhile, the compression chamber V is provided in a space formed by the fixed end plate portion 241, the fixed wrap 244, the orbiting end plate portion 251, and the orbiting wrap 252. Also, the compression chamber V may include a first compression chamber V1 formed between the inner surface of the fixed wrap 244 and the outer surface of the orbiting wrap 252 with respect to the fixed wrap 244 and a second compression chamber V2 formed between the outer surface of the fixed wrap 244 and the inner surface of the orbiting wrap 252.

The Oldham ring 570 may be installed between the main frame 230 and the orbiting scroll 250. Of course, in some cases, the Oldham ring 570 may be provided on the fixed scroll 240 and the orbiting scroll 250. However, in the present disclosure, an example in which the Oldham ring 570 is installed between the main frame 230 and the orbiting scroll 250 will be mainly described.

For example, the Oldham ring 570 may be slidably coupled to each of the main frame 230 and the orbiting scroll 250. Accordingly, the Oldham ring 570 limits the rotational movement of the orbiting scroll 250 so that the orbiting scroll 250 performs an orbiting motion with respect to the main frame 230. The Oldham ring 570 will be described in more detail later.

Hereinafter, the discharge cover 260 will be described with reference to FIG. 14. The discharge cover 260 includes a cover housing portion 261 and a cover flange portion 262.

The cover housing portion 261 may have a cover space 2611 defining the discharge space S3 together with the lower surface of the fixed scroll 240.

An outer circumferential surface of the cover housing portion 261 may come in close contact with the inner circumferential surface of the casing 210. Here, a portion of the cover housing portion 161 may be spaced apart from the casing 110 in the circumferential direction to define an oil return groove 2612. The oil return groove 2612 may define a third oil return groove together with an oil return groove 2621 formed in an outer circumferential surface of the cover flange portion 262. The third oil return groove 1612 of the discharge cover 260 may define the second oil recovery passage Po2 together with the first oil return groove of the main frame 230 and the second oil return groove of the fixed scroll 240.

At least one discharge hole accommodating groove 2613 may be provided in an inner circumferential surface of the cover housing portion 261 in the circumferential direction. The discharge hole accommodating groove 2613 may be recessed outward in the radial direction, and the first discharge hole 2422 of the fixed scroll 240 defining the discharge passage may be located inside the discharge hole accommodating groove 2613. Accordingly, an inner surface of the cover housing portion 261 excluding the discharge hole accommodating groove 2613 may be brought into close contact with an outer circumferential surface of the fixed scroll 240, namely, an outer circumferential surface of the fixed end plate 241 so as to configure a type of sealing part.

An entire circumferential angle of the discharge hole accommodating groove 2613 may be provided to be smaller than or equal to an entire circumferential angle with respect to an inner circumferential surface of the discharge space S3 except for the discharge hole accommodating groove 2613. In this manner, the inner circumferential surface of the discharge space S3 except for the discharge hole accommodating groove 2613 may secure not only a sufficient sealing area but also a circumferential length for forming the cover flange portion 262.

The cover flange portion 262 may extend radially from a portion defining the sealing part, namely, an outer circumferential surface of a portion, excluding the discharge hole accommodating groove 2613, of an upper surface of the cover housing portion 261.

The cover flange portion 262 may be provided with coupling holes (no reference numeral given) for coupling the discharge cover 260 to the fixed scroll 240 with bolts, and a plurality of oil return grooves 2621 may be provided in a radially recessed manner at preset intervals along the circumferential direction between the adjacent coupling holes. The oil return groove 1621 may define the third oil return groove together with the oil return groove 2612 of the cover housing portion 261.

Referring to FIG. 1, the flow path guide 280 may be installed between the motor unit and the compression unit, for example, in the discharge space S12. Specifically, the flow path guide 280 may be disposed at the upper end of the main frame 230 that faces the lower end of the driving motor 220.

The flow path guide 280 may divide the discharge space S12 into a refrigerant discharge flow path and an oil return flow path. Accordingly, refrigerant discharged from the compression unit to the discharge space S12 may move to the upper space S2 through the inner passages 220*a* and the gap passage 220*b*. Oil separated from the refrigerant in the upper space S2 may be returned to the oil storage space S11 through the outer passages 220*c*.

The flow path guide 280 may be provided in a single annular shape or may be provided in a shape defined by a plurality of arcuate parts. Hereinafter, an example in which the flow path guide 280 is provided in a single annular shape will be mainly described, but even when it is provided in a shape defined by a plurality of arcuate parts, the basic configuration for separating refrigerant and oil and operating effects thereof may be similar.

For example, the flow path guide 280 may include a bottom portion, an outer wall portion, and an inner wall portion.

The bottom portion is provided in an annular shape and fixed to the upper surface of the main frame 230. A discharge passage cover portion may extend in the radial direction on an outer circumferential surface of the bottom portion, and a discharge passage hole may be penetrated through the discharge passage cover portion so as to overlap a discharge guide groove of the main frame 230.

The outer wall portion extends toward the insulator 2213 from the substantially outer circumferential surface of the bottom portion. The outer wall portion may be inserted into the inside or outside the insulator 2213 to overlap the insulator 2213. The outer wall portion may be provided in an annular shape extending along the circumferential direction or may be provided in an arc shape.

When the outer wall portion is provided in an annular shape, the diameter of the outer wall portion may be smaller or larger than the diameter of the insulator 2213, or an upper end of the outer wall portion may be provided to be spaced apart from the lower end of the insulator 2213. Accordingly, a gap is generated between the outer wall portion and the insulator 2213, and the refrigerant (liquid refrigerant) discharged to the inside of the outer wall portion may move to an external space S12*b* where a second end of a liquid refrigerant discharge pipe 292, which will be described later, is located, and, through this, the liquid refrigerant may be quickly discharged to the outside of the compressor through the liquid refrigerant discharge unit.

Although not shown in the drawings, when a communication path such as a gap is not formed between the annular outer wall portion and the insulator 2213, a communication groove (not shown) connecting an internal space S12*a* and an external space may be provided on the bottom portion or an upper surface of the main frame 230 facing the same.

The inner wall portion extends toward the insulator 2213 from the substantially inner circumferential surface of the bottom portion. The inner wall portion may extend in the axial direction, and may be bent to extend to surround a balance weight 223 as shown in the drawing.

As described above, the scroll compressor 200 of the present disclosure is a bottom compression type scroll compressor 200 in which the compression unit is disposed below the driving motor 220, as shown in FIG. 14.

The scroll compressor 200 according to the present embodiment as described above operates as follows.

That is, when power is applied to the driving motor 220, rotational force is generated in the rotor 222 and the rotating shaft 225 to rotate, and the orbiting scroll 250 eccentrically coupled to the rotating shaft 225 performs an orbiting motion with respect to the fixed scroll 240 by the Oldham ring 570.

Then, the volume of the compression chamber V gradually decreases from a suction pressure chamber Vs formed on the outside of the compression chamber V to the intermediate pressure chamber Vm continuously formed toward the center and toward the discharge pressure chamber Vd in the central portion.

Then, the refrigerant moves to a condenser (not shown), an expander (not shown), and an evaporator (not shown) of a refrigeration cycle, and then moves to an accumulator (not shown), and this refrigerant is moved toward the suction pressure chamber Vs forming the compression chamber V through the refrigerant suction pipe 215.

Then, the refrigerant sucked into the suction pressure chamber Vs is compressed while moving to the discharge pressure chamber Vd through the intermediate pressure chamber Vm along a movement trace of the compression chamber V, and the compressed refrigerant is discharged to a discharge space S12 of the discharge cover 260 through the discharge ports 2411 and 1412 from the discharge pressure chamber Vd.

Then, the refrigerant (oil is mixed with the refrigerant to form a mixed refrigerant, but mixed refrigerant or refrigerant may be used together in the description) discharged to the discharge space S12 of the discharge cover 260 is moved to the discharge space S12 formed between the main frame 230 and the driving motor 220 through the discharge hole accommodating groove 2613 and the first discharge hole 2422 of the fixed scroll 240. The mixed refrigerant passes through the driving motor 220 and moves to the upper space S2 of the casing 210 formed on the upper side of the driving motor 220.

The mixed refrigerant moved to the upper space S2 is separated into refrigerant and oil in the upper space S2, and the refrigerant (or a partial mixed refrigerant from which oil is not separated) is discharged to the outside of the casing through the refrigerant discharge pipe 216 and moves to the condenser of the refrigeration cycle.

Meanwhile, the oil separated from the refrigerant in the upper space S2 (or mixed oil mixed with liquid refrigerant) moves toward the lower space S1 through a first oil recovery passage Po1 between the inner circumferential surface of the casing 210 and the stator 221, and the oil moved to the lower space S1 is recovered to the oil storage space S11 provided below the compression unit through a second oil recovery passage Po2 formed between the inner circumferential surface of the casing 210 and the outer circumferential surface of the compression unit.

This oil is supplied to each bearing surface (no reference numeral given) through the oil supply passage 226, and a portion thereof is supplied to the compression chamber V.

In addition, as oil is provided between the main frame 230 and the orbiting scroll 250 to induce the supply of oil to the upper surface of the ring body 573, the supply of oil to the inclined oil supply groove 575*a* provided in the vertical direction becomes more active, the supply of oil to the main key 575 becomes smoother, and the number of parts in contact with oil on each surface of the main key 575 increases, thereby improving reliability.

A series of processes in which The oil supplied to the bearing surface and the compression chamber V is discharged to the discharge cover 260 together with the refrigerant and recovered is repeated.

At this time, as a flow path guide 280 for separating the refrigerant discharge passage and the oil recovery passage is installed between the lower end of the driving motor 220 and the upper end of the main frame 230 constituting the discharge space S12, mixing of the refrigerant discharged from the compression unit and moving to the upper space S2 and the oil moving from the upper space S2 to the lower space S1 may be suppressed.

The scroll compressor 200 of the present disclosure includes a plurality of scrolls, an Oldham ring 570, and a main frame 230.

A plurality of scrolls are engaged with each other. Also, the plurality of scrolls include orbiting scrolls 250.

As at least one scroll is coupled to the rotating shaft 225, the orbiting scroll 250 performs an orbiting motion.

In addition, the plurality of scrolls may further include the aforementioned fixed scroll 240.

The Oldham ring 570 is installed on the orbiting scroll 250, is slidably coupled to the orbiting scroll 250, and induces the orbiting motion of the orbiting scroll 250.

The main frame 230 is installed on the opposite side of the orbiting scroll 250 with the Oldham ring 570 interposed therebetween, and accommodates the orbiting scroll 250 to perform an orbiting motion.

At least one main key accommodating portion 231*b* is provided in the main frame 230. In addition, the Oldham ring 570 is provided with at least one main key 575 that is slidably inserted into the main key accommodating portion 231*b*.

In addition, at least one side surface of the main key 575 or at least one inner circumferential surface of the main key accommodating portion 231*b* is provided with an oil supply groove 575*a* inclined from the lower side to the upper side to enable oil to flow from a lower end to an upper end of the main key 575.

In other words, the oil supply groove 575*a* may be provided on at least one side surface of the main key 575, or the oil supply groove 231*c* may be provided on at least one inner circumferential surface of the main key accommodating portion 231*b*.

The oil supply grooves 575*a* and 231*c* are provided in the main key 575 or the main key accommodating portion 231*b* to enable the flow of oil from the lower end to the upper end of the main key 575.

In addition, in the scroll compressor 200 of the present disclosure, as will be described later, since oil is more smoothly supplied to the main key 575 by an oil supply surface portion 773*a* in which an inclined surface 773*b* is provided and according to a movement of the Oldham ring 570 by the application of the oil supply surface portion 773*a*, reliability may be improved.

In addition, in the scroll compressor 200 of the present disclosure, since oil is more smoothly supplied to the main key 575 by the inclined oil supply hole 672*a* and according to the movement of the Oldham ring 570 by applying the oil supply groove 575*a* to the main key 575, the reliability may be improved.

The main key accommodating portion 231*b* is provided in the main frame 230, and the main key 575 is provided in the Oldham ring 570.

Among the keys provided in the Oldham ring 570, a key slidably inserted into the main frame 230 may be referred to as a main key 575, and a groove into which the main key 575 is inserted is referred to as the main key accommodating portion 231*b*. Also, as will be described later, among the keys provided in the Oldham ring 570, a key slidably inserted into the orbiting scroll 250 may be referred to as an orbiting key 571, and a groove into which the orbiting key 571 is inserted is referred to as the orbiting key accommodating portion 255. However, the present disclosure is not necessarily limited thereto, and the orbiting key 571 and the main key 575 may be referred to as a first key and a second key (or reverse order is possible), respectively, and the orbiting key accommodating portion 255 and the main key accommodating portion 231*b* may be referred to as a first keyway and a second keyway (or reverse order is possible), respectively.

Figure 19:
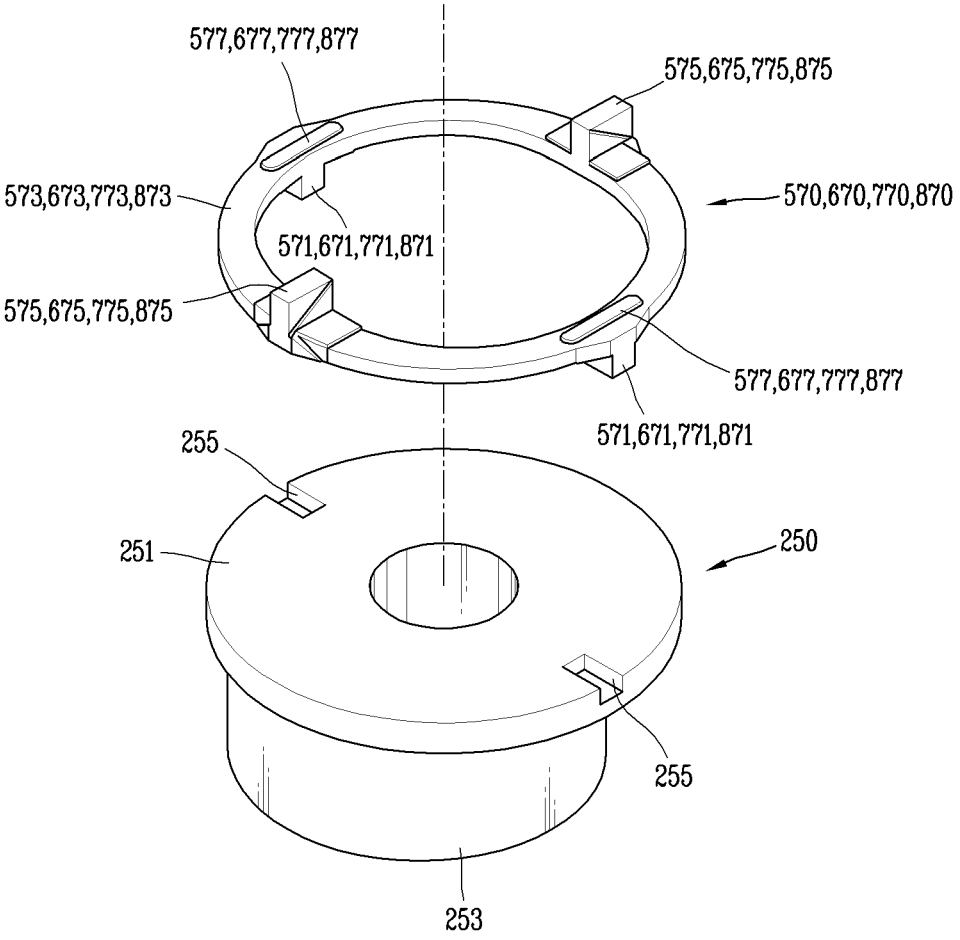
FIG. 19 is an exploded perspective view showing an orbiting scroll and an Oldham ring.
Figure 20:
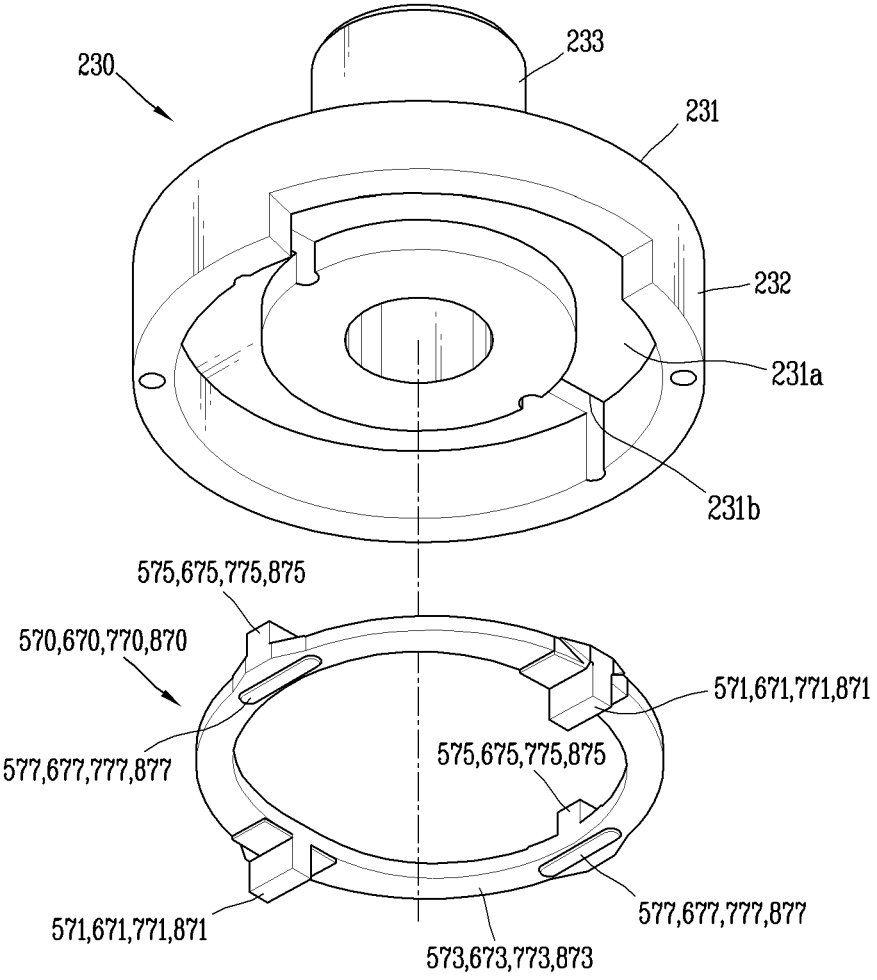
FIG. 20 is an exploded perspective view showing a main frame and an Oldham ring.
Figure 21A:
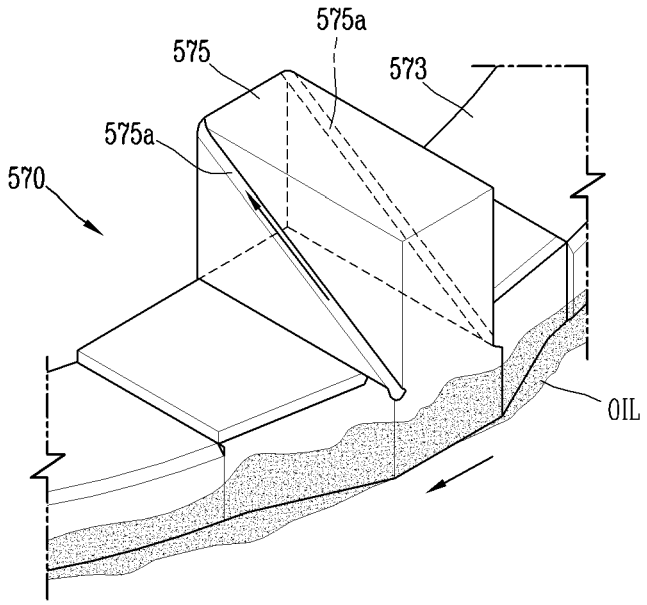
FIG. 21A is a perspective view showing an Oldham ring of a fifth embodiment.
Figure 23:
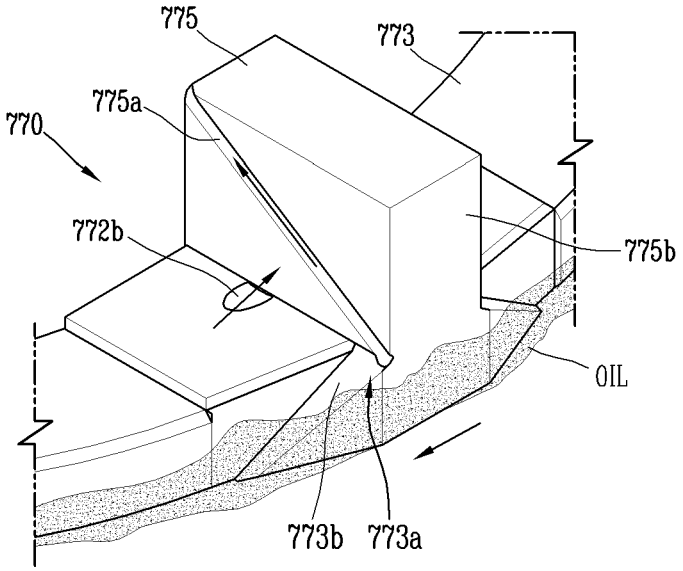
FIG. 23 is a perspective view showing an Oldham ring of a seventh embodiment.
Figure 24A:
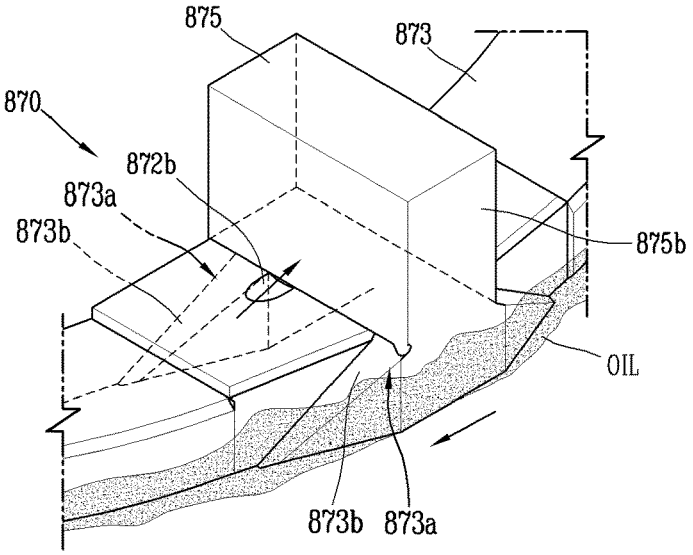
FIG. 24A is a perspective view showing an Oldham ring of an eighth embodiment.
Figure 24B:
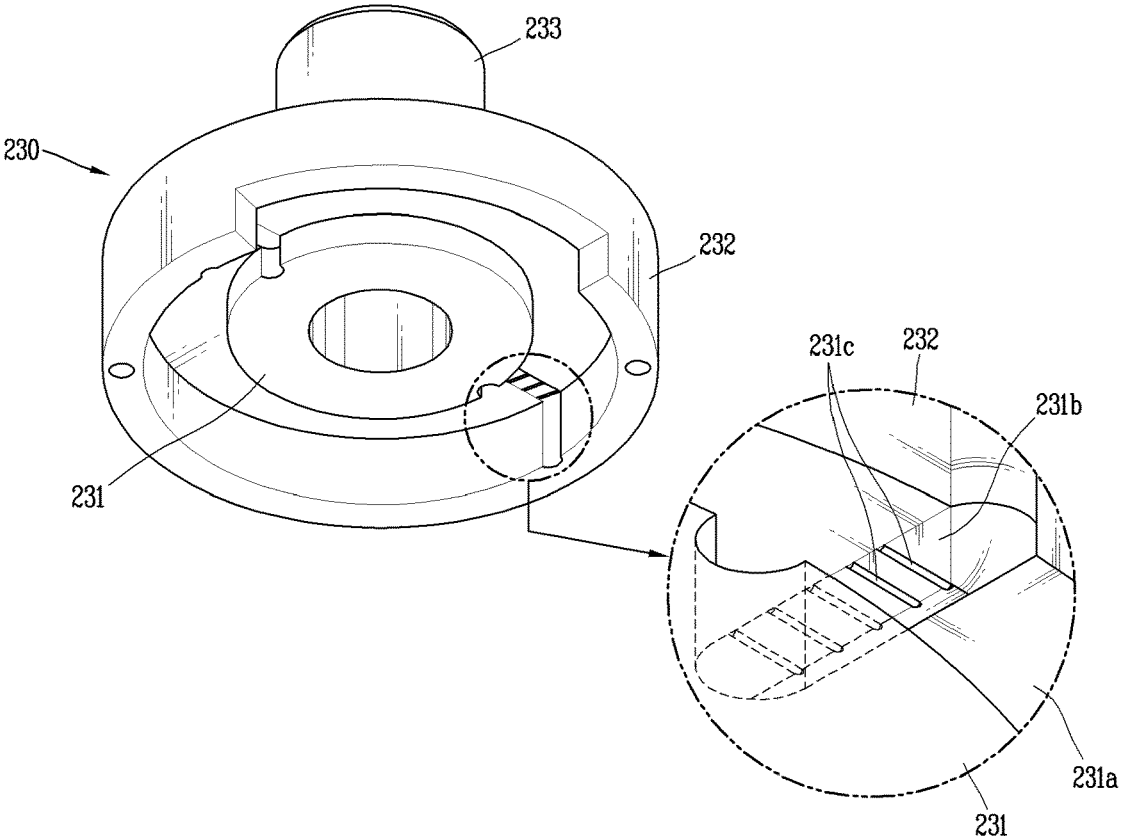
FIG. 24B is a perspective view showing a bottom of a main frame on which the Oldham ring of the eighth embodiment is installed.

FIG. 19 is an exploded perspective view showing the orbiting scroll 250 and the Oldham ring 570 in FIG. 14, and FIG. 20 is an exploded perspective view showing the main frame 230 and the Oldham ring 570 in FIG. 14, FIG. 21A is a perspective view showing the Oldham ring 570 according to a fifth embodiment. In addition, FIG. 22 is a perspective view showing an Oldham ring 670 of a sixth embodiment, FIG. 23 is a perspective view showing an Oldham ring 770 of a seventh embodiment, and FIG. 24A is a perspective view showing an Oldham ring 870 of an eighth embodiment. FIG. 24B is a perspective view showing the bottom of the main frame 230 on which the Oldham ring 870 of the eighth embodiment is installed.

Hereinafter, the Oldham rings 570, 670, 770, and 870 of the fifth to eighth embodiments of the present disclosure will be described with reference to FIGS. 19 to 24B.

FIG. 21A shows an example of an Oldham ring 570, which will be referred to as the Oldham ring 570 of the fifth embodiment. Hereinafter, the Oldham ring 570 of the fifth embodiment will be described with reference to FIG. 21A.

FIG. 20 shows an example in which the main key accommodating portion 231*b* is provided in the Oldham ring accommodating portion 231*a* of the frame end plate portion 231 of the main frame 230, and the main key 575 is provided in the Oldham ring 570 adjacent thereto.

In the present disclosure, an example in which the main key accommodating portion 231*b* is provided in the main frame 230 and the main key 575 is provided in the Oldham ring 570 will be mainly described.

However, the present disclosure is not necessarily limited thereto, and an example in which the main key accommodating portion 231*b* is provided in the Oldham ring 570 and the main key 575 is provided in the main frame 230 is not completely excluded.

In addition, an oil supply groove 575*a* extending obliquely from the lower side to the upper side is provided on one surface of the main key 575. The oil supply groove 575*a* enables the flow of oil from the lower end to the upper end of the main key 575.

The oil supply groove 575*a* may be provided on both sides of the key portion provided between the outer surface of the key portion provided in the circumferential direction and the inner surface of the key portion provided in the circumferential direction.

As shown in FIG. 21A, the oil supply groove 575A may be provided on both sides provided on opposite sides of each other in the main key 575.

For example, the oil supply groove 575*a* may obliquely extend from a lower point provided on the outer periphery of the Oldham ring 570 to an upper point provided on the inner periphery of the Oldham ring 570 on one surface of the main key 575.

Referring to FIGS. 19 to 21A, an inclined oil supply groove 575*a* may be provided in each of the main keys 575 spaced apart from each other by 180 degrees in the ring body 573.

In addition, in FIG. 21A, an example of the oil supply groove 575*a* formed from one point on the lower right side to one point on the upper left side in one main key 575 is shown.

This inclination direction is a direction that rises toward the inside of the Oldham ring 570, and the oil subjected to centrifugal force may move to the inside of the Oldham ring 570, and at the same time, it may be a structure that promotes an upward flow of oil in contact with the main key 575 of the Oldham ring 570.

As the oil supply groove 575*a* inclined in the vertical direction is provided on one surface of the main key 575 of the Oldham ring 570, the oil in contact with the Oldham ring 570 may more actively flow in the main key 575 through the oil supply groove 575*a*, the supply of the oil to the main key 575 may become smoother, and the number of parts in contact with oil on each side of the main key 575 may increase, so the reliability is improved.

In addition, the Oldham ring 570 may further include a ring body 573. The ring body 573 is provided in an annular shape, and the main key 575 may be provided to protrude from one surface of the ring body 573 toward the main key accommodating portion 231*b*.

Referring to FIG. 20, an example in which the main key 575 protrudes from the upper surface of the annular ring body 573 in the direction toward the Oldham ring accommodating portion 231*a* provided in the frame end plate portion 231 of the main frame 230 is shown. In addition, referring to FIGS. 19 and 20, an example in which two main keys 575 are spaced apart from each other at an interval of 180 degrees in the shape of a rectangular parallelepiped is shown.

The scroll compressor 200 of the present disclosure improves the actual load efficiency according to the low pressure ratio operation by securing the low pressure ratio operation reliability by the structure in which the inclined oil supply groove 575*a* is provided in the main key 575 as described above.

Meanwhile, referring to FIGS. 19 and 20, the Oldham ring 570 may further include an orbiting key 571. In addition, the orbiting scroll 250 may be provided with an orbiting key accommodating portion 255 for accommodating the orbiting key 571 to be slidably inserted.

The orbiting key 571 may be provided to protrude downward from the lower surface of the ring body 573 on the opposite side where the main key 575 is provided, for example. In addition, as shown in FIGS. 19 and 20, two orbiting keys 571 may be spaced apart from each other at a 180 degree interval, and alternately maintaining a 90 degree interval and may be alternately disposed, while maintaining a 90 degree interval with the main key 575 in the circumferential direction.

The orbiting key 571 may be provided in the shape of a rectangular parallelepiped, similar to the main key 575. In addition, the orbiting key accommodating portion 255 may be radially formed to accommodate the orbiting key 571 in the orbiting scroll 250 to slide in the radial direction. An example of the orbiting key accommodating portion 255 formed in the radial direction of the orbiting scroll 250 is shown, and in the drawing, the orbiting key accommodating portion 255 is shown in the upper part and the lower part in the form of a groove having a predetermined width and depth.

Meanwhile, referring to FIGS. 19 and 20, a support portion 577 may be provided between the two main keys 575 on the upper surface (contacting surface with the main frame 230) of the ring body 573, and the support portion 577 may also be provided between the two orbiting keys 571 on the lower surface of the 573 (the contact surface with the orbiting scroll 250). The support portion 577 of the upper surface of the ring body 573 may be in contact with the main frame 230, and the support portion 177 of the upper surface of the ring body 573 may be in contact with the orbiting scroll 250. The Oldham ring may slide in the radial direction while being supported between the main frame 230 and the orbiting scroll 250 by the support portions 577 provided on the upper and lower surfaces of the ring body 573, respectively.

The Oldham ring 570 prevents rotation of the orbiting scroll 250 by the structure in which the orbiting key 571 slides on the orbiting key accommodating portion 255 and the main key 575 slides on the main key accommodating portion 231*b*.

FIGS. 21B to 21E show another example of the Oldham ring of the fifth embodiment of FIG. 21A, which will be described below.

Meanwhile, an oil supply groove 575*a*-1 may be provided in at least one of the outer surface provided in the circumferential direction of the key portion and the inner surface provided in the circumferential direction of the key portion.

Figure 21B:
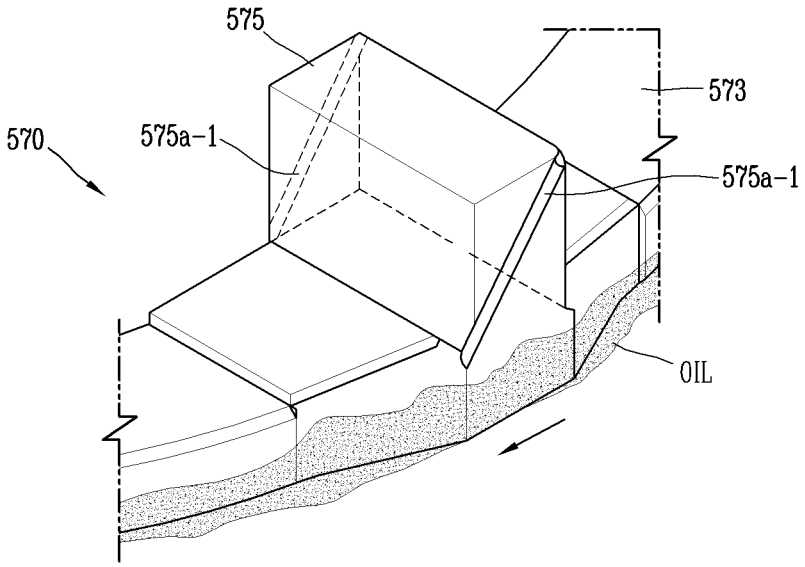
FIG. 21B is a perspective view showing an example in which oil supply grooves are provided on an inner peripheral side and an outer peripheral side. As another example of the Oldham ring of the fifth embodiment.

Referring to FIG. 21B, an example in which the oil supply groove 575*a*-1 is provided on each of the outer surface provided in the circumferential direction of the main key 575 and the inner surface provided in the circumferential direction of the main key 575 is shown.

Meanwhile, the outer and inner surfaces of the main key 575 provided in the circumferential direction may be understood as surfaces facing the same direction as the outer circumference of the Oldham ring and the inner circumference of the Oldham ring, respectively.

This structure may be advantageous in moving the oil stacked on the inner and outer periphery of the Oldham ring 170 upward through the oil supply groove 575*a*-1 in the Oldham ring.

However, the oil supply groove 575*a*-1 may be provided only on the inner surface provided in the circumferential direction of the main key 575.

When the oil supply groove 575*a*-1 is provided only on the inner surface of the main key 575, it may be a structure advantageous for raising the oil stacked on the inside of the Oldham ring.

In addition, the oil supply grooves 575*a*-2 and 575*a*-3 may be provided in a multi-stage structure in which a plurality of oil supply grooves 575*a*-2 and 575*a*-3 are spaced apart from each other on both side surfaces of the key portion.

In addition, the oil supply groove 575*a*-2 on the side disposed in the front with respect to a rotational direction of the rotating shaft 225, among the both sides may be provided to be more than the oil supply groove 575*a*-3 on the side disposed in the rear with respect to the rotational direction of the rotating shaft or may have a wider width.

Figure 21C:
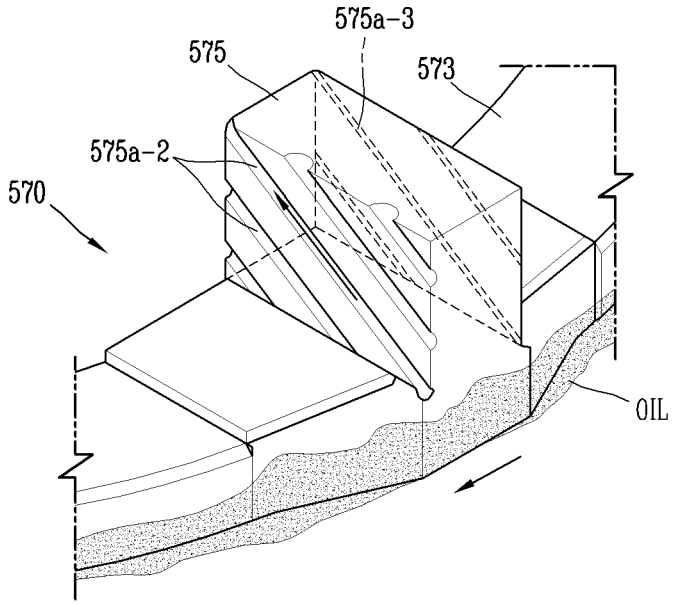
FIG. 21C is a perspective view showing different numbers of oil supply grooves having different widths on both sides as another example of the Oldham ring of the fifth embodiment.

In the present disclosure, both sides may be understood as both sides of the main key 575 provided between the outer and inner circumferences of the Oldham ring 570 (in FIGS. 21A and 21C, the surface on which the oil supply grooves 575*a*, 575*a*-2, and 575*a*-3 are provided).

Referring to FIG. 21C, an example in which the oil supply grooves 575*a*-2 and 575*a*-3 are spaced apart from each other on both sides of the main key 575 is shown. FIG. 21C shows an example in which four oil supply grooves 575*a*-2 are provided on the side of the main key 575 provided in the front based on the rotational direction of the rotating shaft 225 indicated by the arrow in the lower right corner and have a relatively wide width compared to the oil supply groove 575*a*-3 on the side of the main key 575.

In addition, in FIG. 21C, an example in which, based on the rotational direction of the rotating shaft indicated by the arrow, the oil supply groove 575*a*-3 on the side surface of the main key 575 provided on the rear is provided as three pieces (indicated by the dotted line) and has a narrower width, compared with the oil supply groove 575*a*-2 on the side surface of the main key 575 provided at the front is shown.

This structure is a more advantageous structure for oil supply because a large amount of oil flows relatively to the side of the main key 575 disposed in the front with respect to the rotational direction of the rotating shaft.

In addition, the oil supply grooves 575*a* and 575*a*-4 may be provided so that a plurality of oil supply grooves 575*a* and 575*a*-4 cross each other on both sides of the key portion.

Figure 21D:
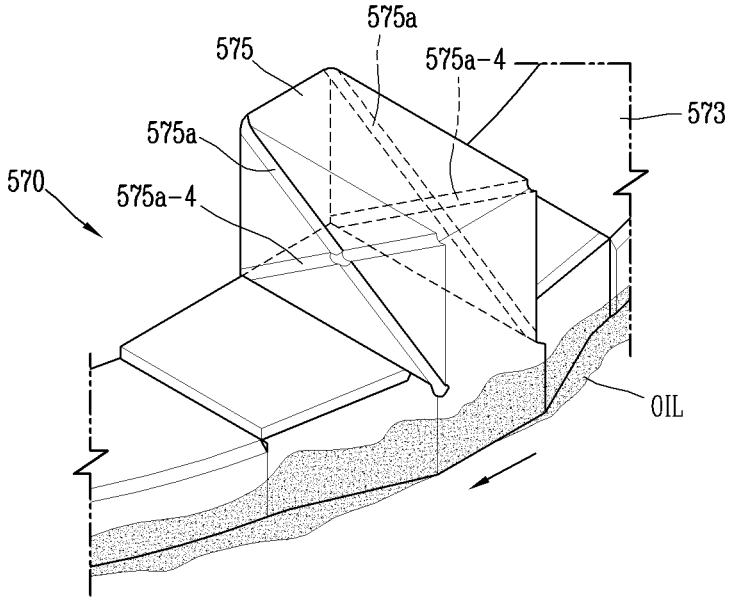
FIG. 21D is a perspective view showing oil supply grooves diagonally crossing each other on both sides as another example of the Oldham ring of the fifth embodiment.

Referring to FIG. 21D, an example in which, on each of both sides of the main key 575, two oil supply grooves 575*a* and 575*a*-4 are provided diagonally to each other to cross each other is shown.

This structure may be advantageous in raising the oil stacked on the inner portion of the Oldham ring 170, compared to the oil supply groove 575*a* described in FIG. 21A.

In addition, the oil supply groove 575*a*-6 may be parallel to an extending direction of the rotating shaft 125. In addition, the oil supply groove 575*a*-5 may be further provided in the radial direction.

Figure 21E:
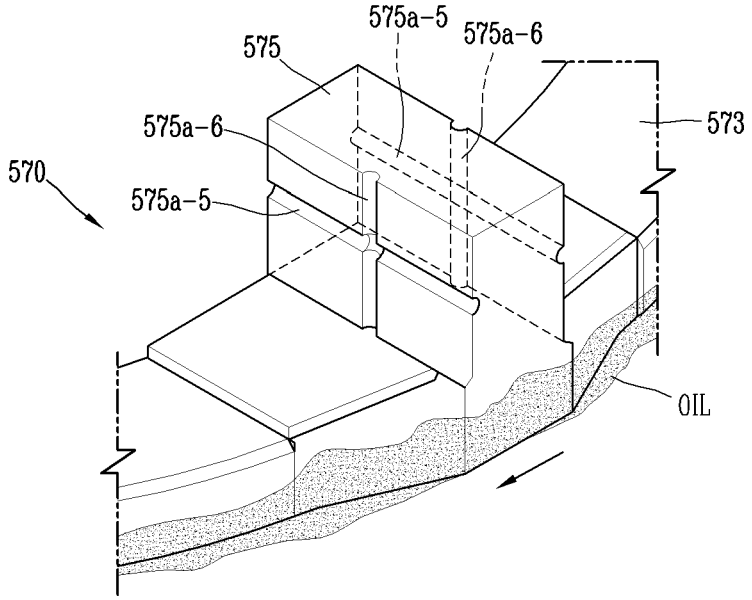
FIG. 21E is a perspective view showing oil supply grooves that cross each other in radial and axial directions on both sides as another example of the Oldham ring of the fifth embodiment.

Referring to FIG. 21E, an example in which the oil supply groove 575*a*-6 is provided in a direction parallel to the extending direction of the rotating shaft 125 (vertical direction), and the oil supply groove 575*a*-5 crossing the oil supply groove 575*a*-6 is provided in the radial direction (horizontal direction) is shown.

With this structure, while the oil flows upward, it may be a structure advantageous for oil retention on the side of the main key 575 of the Oldham ring 570.

Figure 22A:
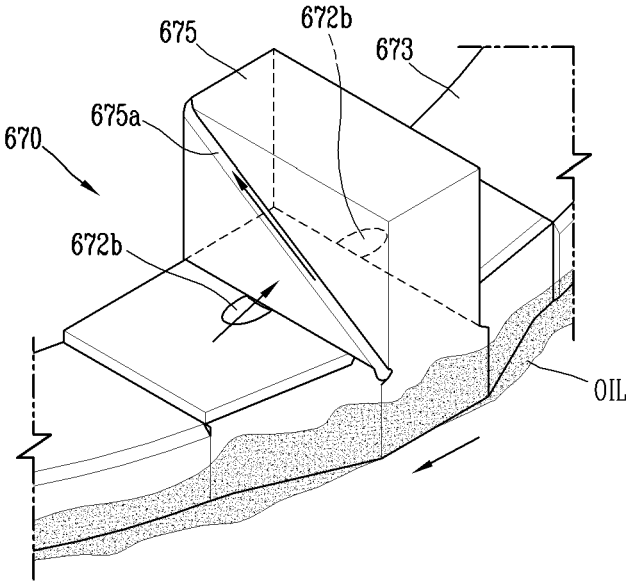
FIG. 22A is a perspective view showing an Oldham ring of a sixth embodiment.

FIG. 22A shows an Oldham ring 670 of another example, which will be referred to as an Oldham ring 670 of a sixth embodiment. Hereinafter, the Oldham ring 670 of the sixth embodiment will be described with reference to FIG. 22A.

Referring to FIG. 22A, the aforementioned oil supply passage may be an oil supply hole 672*b* passing through a surface connected from at least one of both side surfaces of the key portion in the ring body 673.

FIG. 22A shows an example in which the main key accommodating portion 231*b* is provided on the bottom surface of the frame end plate portion 231 of the main frame 230 and the main key 675 is provided in the Oldham ring 670 adjacent thereto.

As described above, in the present disclosure, an example in which the main key accommodating portion 231*b* is provided in the main frame 230 and the main key 675 is provided in the Oldham ring 670 will be mainly described.

However, the present disclosure is not necessarily limited thereto, and an example in which the main key accommodating portion 231*b* is provided in the Oldham ring 670 and the main key 675 is provided in the main frame 230 is not completely excluded.

In addition, an oil supply groove 675*a* extending obliquely from the lower side to the upper side is provided on one surface of the main key 675. The oil supply groove 675*a* enables the flow of oil from the lower end to the upper end of the main key 675.

Of course, FIG. 22*a* shows an example in which the oil supply groove 675*a* is provided only on one side of the main key 675, but the oil supply groove 675*a* may be provided on both sides provided on opposite sides in each main key 675, respectively.

For example, the oil supply groove 675*a* may extend obliquely from a lower point provided on the outer periphery of the Oldham ring 670 to an upper point provided on the inner periphery of the Oldham ring 670.

FIG. 22A shows an example in which an inclined oil supply groove 675*a* is provided in each of the main keys 675 spaced apart from each other by 180 degrees in the ring body 673.

In addition, FIG. 22A shows an example of the oil supply groove 675*a* formed from one point on the lower right side to one point on the upper left side in one main key 675.

This inclination direction is a direction that rises toward the inside of the Oldham ring 670, and the oil subjected to centrifugal force may move to the inside of the Oldham ring 670, and at the same time, it may be a structure that promotes the upward flow of oil in contact with the main key 675 of the Oldham ring 670.

As the oil supply groove 675*a* inclined in the vertical direction is provided on one surface of the main key 675 of the Oldham ring 670, the oil in contact with the Oldham ring 670 actively flows in the main key 675 through the oil supply groove 675*a* according to the movement of the Oldham ring 670, oil supply to the main key 675 may become smoother, and the number of parts in contact with oil on each side of the main key 675 may increase, and thus, reliability may be improved.

In addition, the Oldham ring 670 may further include a ring body 673. The ring body 673 is provided in an annular shape, and the main key 675 may be provided to protrude from one surface of the ring body 673 toward the main key accommodating portion 231*b*.

Referring to FIGS. 20 and 22A, an example in which the main key 675 protrudes in a direction toward the main key accommodating portion 231*b* of the main frame 230 on an upper surface of the annular ring body 673 is shown. In addition, an example in which two main keys 675 are spaced apart from each other by 180 degrees in the shape of a rectangular parallelepiped is shown.

Unlike the Oldham ring 570 of FIG. 21A, the Oldham ring 670 of FIG. 22A is different in that the oil supply hole 672*b* is provided in the ring body 673.

The oil supply hole 672*b* may be inclined in the ring body 673, and the oil supply hole 672*b* may penetrate through upper and lower ends of the ring body 673 to be inclined.

In addition, the oil supply hole 672*b* may be provided so that an upper end is adjacent to the side of the main key 675.

Figure 25:
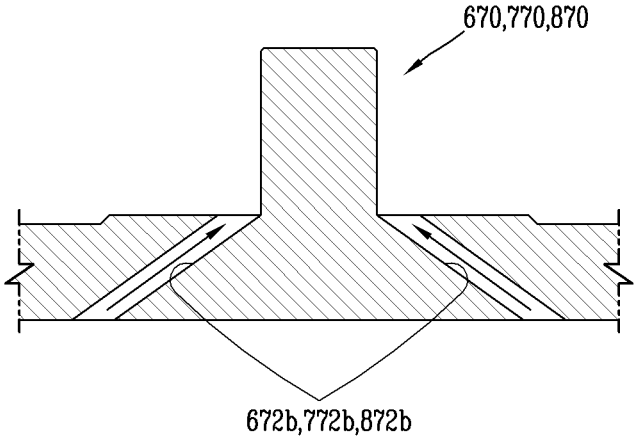
FIG. 25 is a cross-sectional view showing an example in which oil supply holes are provided in a ring body of an Oldham ring on the left and right sides of an orbiting key, respectively.

As shown in FIG. 22A, an example in which the oil supply hole 672*b* penetrates the upper surface of the ring body 673 so as to be adjacent to the left surface of the main key 675 and maintains a predetermined angle, and the oil supply hole 672*b* is inclined is shown. In addition, an example in which the oil supply hole 672*b* is provided on the left and right sides of the main key 675 to enable the flow of oil in both directions is shown in FIG. 25.

Due to the structure in which the oil supply hole 672*b* is inclined in the ring body 673 and penetrates the upper and lower ends of the ring body 673, the oil stored in the Oldham ring accommodating portion 231*a* may flow from the lower surface of the Oldham ring 670 to the upper surface through the oil supply hole 672*b*, while the Oldham ring 670 is moved with respect to the main frame 230.

In addition, as the supply of oil to the inclined oil supply groove 671*a* formed in the vertical direction on one surface of the main key 675 of the Oldham ring 670 becomes more active, the supply to the main key 675 becomes smoother, and the number of parts in contact with oil on each side of the main key 675 increases, so that reliability may be improved.

In addition, the oil supply hole 672*b*-1 disposed on the front side in the rotational direction of the rotating shaft 225 may have a larger diameter than the oil supply hole 672*b*-3 disposed on the rear side.

Figure 22B:
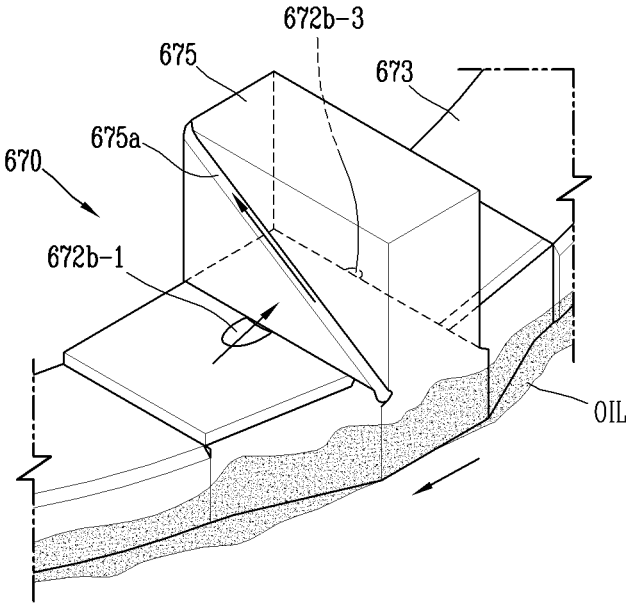
FIG. 22B is a perspective view showing another example of the Oldham ring of the sixth embodiment.
Figure 22C:
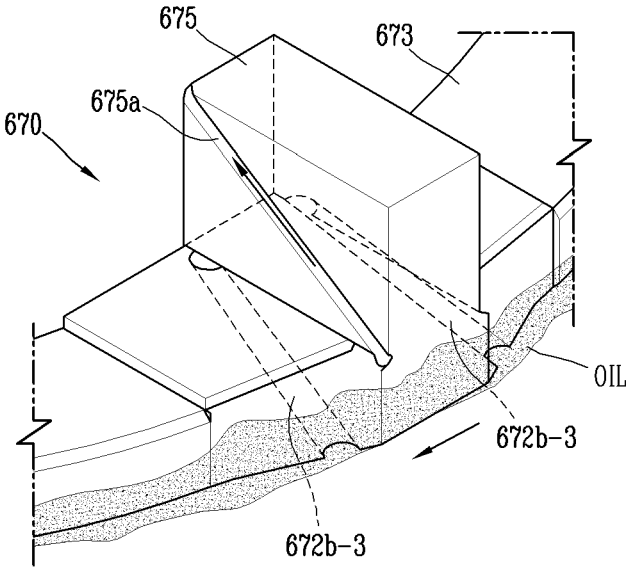
FIG. 22C is a perspective view showing another example of the Oldham ring of the sixth embodiment.

Referring to FIG. 22B, an example in which the oil supply hole 672*b*-1 disposed on the front side in the rotational direction (rotational direction of the Oldham ring) of the rotating shaft indicated by the arrow at the lower right has a larger diameter than the oil supply hole 672*b*-3 disposed on the rear side is shown.

However, the present disclosure is not limited to the structure of FIG. 22, and the oil supply hole 672*b*-1 may be disposed only on the front side in the rotational direction of the rotating shaft 225.

With this structure, a relatively large amount of oil may rise by the rotational force of the Oldham ring 670 on the front side of the rotational direction of the rotating shaft 225.

Referring to FIGS. 10A and 10B, an example in which the oil supply holes 672*b* and 672*b*-1 are provided in the circumferential direction is shown.

Meanwhile, the oil supply hole 672*b*-3 may be provided in the radial direction.

FIG. 10C shows an example in which the oil supply holes 672*b*-3 are provided to penetrate through the upper and lower surfaces of the ring body 673 adjacent to both sides of the orbiting key 671 in the radial direction.

With this structure, the oil on the outer circumferential bottom surface of the Oldham ring 670 may rise in the radial direction along the oil supply hole 672*b*-3.

In the scroll compressor 200 of the present disclosure, with the structure in which the oil supply hole 672*b* is provided in the ring body 673 as described above, the actual load efficiency according to the low pressure ratio operation may be improved by securing the low pressure ratio operation reliability.

Meanwhile, referring to FIGS. 19, 20 and 22A, the Oldham ring 570 may further include an orbiting key 571. In addition, the orbiting end plate portion 251 of the orbiting scroll 250 may be provided with an orbiting key accommodating portion 255 for accommodating the orbiting key 571 to be slidably inserted.

The orbiting key 571 may be provided to protrude downward from the lower surface of the ring body 673 on the opposite side where the main key 675 is provided, for example. In addition, as shown in FIGS. 19 and 20 and 22A, two orbiting keys 571 may be spaced apart from each other at a 180 degree interval and may be alternately arranged, while maintaining a 90 degree interval with the main key 575 in the circumferential direction.

The orbiting key 571 may be provided in the shape of a rectangular parallelepiped, similar to the main key 675. In addition, the orbiting key accommodating portion 255 may be radially formed to accommodate the orbiting key 571 in the orbiting scroll 250 to slide in the radial direction. FIG. 19 shows an example of the orbiting key accommodating portion 255 provided in a radial direction of the orbiting scroll 250, and in the drawing, an example in which the orbiting key accommodating portion 255 is formed to have a predetermined width and depth in upper and lower portions in the drawing is shown.

Meanwhile, referring to FIGS. 19 and 20, a support portion 677 may be provided between the two main keys 675 on the upper surface (contact surface with the main frame 230) of the ring body 673, and the support portion 677 may also be provided between two orbiting keys 671 on the lower surface of the 673 (the contact surface with the orbiting scroll 250). The support portion 677 of the upper surface of the ring body 673 may be in contact with the main frame 230, and the support portion 177 of the upper surface of the ring body 673 may be in contact with the orbiting scroll 250. The Oldham ring may slide in the radial direction while being supported between the main frame 230 and the orbiting scroll 250 by the support portions 677 provided on the upper and lower surfaces of the ring body 673, respectively.

The Oldham ring 670 has a structure in which the orbiting key 671 slides on the orbiting key accommodating portion 255 and the main key 675 slides on the main key accommodating portion 231*b*, so that rotation is prevented.

FIG. 23 shows an Oldham ring 770 of another example, which will be referred to as an Oldham ring 770 of a seventh embodiment. Hereinafter, the Oldham ring 770 of the seventh embodiment will be described with reference to FIG. 23.

FIG. 20 shows an example in which the main key accommodating portion 231*b* is provided on the bottom surface of the frame end plate portion 231 of the main frame 230 and the main key 775 is provided in the Oldham ring 770 adjacent thereto.

As described above, in the present disclosure, an example in which the main frame 230 is provided with the main key accommodating portion 231*b* and the Oldham ring 770 is provided with the main key 775 is mainly described.

However, the present disclosure is not necessarily limited thereto, and an example in which the main key accommodating portion 231*b* is provided in the Oldham ring 770 and the main key 775 is provided in the main frame 230 is not completely excluded.

In addition, an oil supply groove 775*a* extending obliquely from the lower side to the upper side is provided on one surface of the main key 775. The oil supply groove 775*a* enables the flow of oil from the lower end to the upper end of the main key 775.

For example, the oil supply groove 775*a* may extend from a lower point provided on the outer periphery of the Oldham ring 770 to an upper point provided on the inner periphery of the Oldham ring 770.

Referring to FIGS. 19, 20 and 23, an example in which an inclined oil supply groove 775*a* is provided in each of the main keys 775 spaced apart from each other by 180 degrees in the ring body 773 is shown.

In addition, FIG. 23 shows an example of the oil supply groove 775*a* provided from one point on the lower right side to one point on the upper left side in one main key 775.

This inclination direction is a direction that rises toward the inside of the Oldham ring 770, and the oil subjected to centrifugal force may move to the inside of the Oldham ring 770, and at the same time, it may be a structure that promotes the upward flow of oil in contact with the main key 775 of the Oldham ring 770.

As the oil supply groove 775*a* inclined in the vertical direction is provided on one surface of the main key 775 of the Oldham ring 570, the oil in contact with the Oldham ring 770 actively flows in the main key 775 through the oil supply groove 771*a* according to the movement of the Oldham ring 770, oil supply to the main key 775 may become smoother, and the number of parts in contact with oil on each side of the main key 775 may increase, and thus, reliability may be improved.

In addition, the Oldham ring 770 may further include a ring body 773. The ring body 773 is provided in an annular shape, and the main key 775 may be provided to protrude from one surface of the ring body 773 toward the main key accommodating portion 231*b*.

FIG. 20 shows an example in which the main key 775 protrudes from the upper surface of the annular ring body 773 in the direction toward the frame end plate portion 231 of the main frame 230. In addition, an example in which two main keys 775 are spaced apart from each other at a 180-degree interval in the shape of a rectangular parallelepiped is shown.

Unlike the Oldham ring 770 in FIGS. 21A and 22A, the Oldham ring 770 of FIG. 23 is different in that an oil supply surface portion 773*a* protrudes from the outer periphery of the ring body 773.

The oil supply surface portion 773*a* has an inclined surface 773*b*, the inclined surface 773*b* is provided to be inclined so that the oil introduced into the lower part of the Oldham ring 770 may flow to the upper part.

The inclined surface 773*b* may be, for example, parallel to the formation direction of the oil supply hole 772*b*.

As shown in FIG. 23, the oil supply surface portion 773*a* may be in the shape of a triangular prism having a predetermined width.

The oil accommodated in the Oldham ring accommodating portion 231*a* in the lower part of the Oldham ring 770 is induced to flow upwardly to be supplied to the upper surface of the ring body 773 from the outer periphery of the ring body 773 riding the inclined surface 773*b* by the oil supply surface portion 773*a* having the inclined surface 773*b*.

In addition, as the supply of oil to the upper surface of the ring body 773 is induced, the supply of oil to the inclined oil supply groove 775*a* provided in the vertical direction on one surface of the main key 775 of the Oldham ring 770 becomes more active, the supply to the main key 775 becomes smoother, and the number of parts in contact with oil on each surface of the main key 775 increases, so that reliability may be improved.

Also in the Oldham ring 770 shown in FIG. 23, the oil supply hole 772*b* may be inclined in the ring body 773, and the oil supply hole 772*b* may pass through the upper and lower ends of the ring body 773 to be inclined.

In addition, the oil supply hole 772*b* may be provided so that the upper end is adjacent to the side of the main key 775.

As shown in FIG. 23, an example in which the oil supply hole 772*b* penetrates the upper surface of the ring body 773 so as to be adjacent to the left surface of the main key 775, and maintains a predetermined angle, and the oil supply hole 772*b* is inclined is shown. In addition, an example in which the oil supply hole 772*b* is provided on the left and right sides of the main key 775 to enable the flow of oil in both directions is shown in FIG. 25.

Due to the structure in which the oil supply hole 772*b* is inclined in the ring body 773 and penetrates the upper and lower ends of the ring body 773, the oil provided to the Oldham ring 770 may flow from the lower surface of the Oldham ring 770 to the upper surface through the oil supply hole 772*b*, while the Oldham ring 770 is moved with respect to the main frame 230.

In addition, as the supply of oil to the inclined oil supply groove 775*a* formed in the vertical direction on one surface of the main key 775 of the Oldham ring 770 becomes more active, the supply to the orbiting key 771 becomes smoother, and the number of parts in contact with oil on each side of the main key 775 increases, so that reliability may be improved.

In particular, in the Oldham ring 770 shown in FIG. 23, the inclined surface 773*b* and the oil supply hole 772*b* are provided side by side, so that when the Oldham ring 770 slides to move with respect to the main frame 230, oil at the bottom of the Oldham ring 770 may flow to the upper surface of the ring body 773 along the inclined end of the inclined surface 773*b* and the inclination angle of the oil supply hole 772*b* along the movement direction.

In addition, the main key 775 may have a protruding side portion 775*b* that further protrudes in a direction toward at least one of the outer periphery and the inner periphery of the ring body 773. The oil supply surface portion 773*a* may be connected to the protrusion side portion 775*b* to provide oil to the oil supply groove 775*a* through the upper portion of the inclined surface 773*b*. In FIG. 23, the protruding side portion 775*b* protruding in the direction toward the outer periphery of the ring body 773 and the oil supply surface portion 773*a* connected thereto are shown. The oil supply groove 775*a* may be provided to extend to the side end so as to be connected to the inclined surface 773*b* of the protruding side portion 775*b*.

Accordingly, the oil rising on the inclined surface 773*b* of the oil supply surface portion 773*a* may be more promoted to the upper part of the main key 775 of the oil through the oil supply groove 775*a* extending to the protruding side portion 775*b*.

In the scroll compressor 200 of the present disclosure, the oil supply surface portion 773*a* provided with the inclined surface 773*b* is configured in the ring body 773 and the oil supply hole 772*b* is provided in the ring body 373 as described above, and thus, it is possible to improve the actual load efficiency according to the low pressure ratio operation by securing the low pressure ratio operation reliability.

Meanwhile, referring to FIGS. 19, 20 and 23, the Oldham ring 770 may further include an orbiting key 771. In addition, the orbiting scroll 250 may be provided with an orbiting key accommodating portion 255 for accommodating the orbiting key 771 to be slidably inserted.

The orbiting key 771 may be provided to protrude downward from the lower surface of the ring body 773 on the opposite side where the main key 775 is provided, for example. In addition, as shown in FIGS. 19 and 20, two orbiting keys 771 may be spaced apart from each other at a 180 degree interval and may be alternately disposed, while maintaining a 90 degree interval with the main key 775 in the circumferential direction.

The orbiting key 771 may be provided in the shape of a rectangular parallelepiped, similar to the main key 775. In addition, the orbiting key accommodating portion 255 may be radially formed to accommodate the orbiting key 771 in the orbiting scroll 250 to slide in the radial direction. An example of the orbiting key accommodating portion 255 formed in the radial direction of the orbiting scroll 250 is shown in FIG. 19, and in the drawing, an example in which the orbiting key accommodating portion 255 in the upper and lower parts is shown in the form of a groove having a predetermined width and depth.

Meanwhile, referring to FIGS. 19 and 20, a support portion 777 may be provided between the two main keys 775 on the upper surface (contact surface with the main frame 230) of the ring body 773, and the support portion 777 may also be provided between the two orbiting keys 771 on the lower surface (contact surface with the orbiting scroll 250) of the ring body 773. The support portion 777 of the upper surface of the ring body 773 may be in contact with the main frame 230, and the support portion 177 of the upper surface of the ring body 773 may be in contact with the orbiting scroll 250. The Oldham ring may slide in a radial direction while being supported between the main frame 230 and the orbiting scroll 250 by the support portions 777 provided on the upper and lower surfaces of the ring body 773, respectively.

The Oldham ring 770 has a structure in which the orbiting key 771 slides on the orbiting key accommodating portion 255 and the main key 775 slides on the main key accommodating portion 231*b*, thereby preventing rotation of the orbiting scroll 250.

FIG. 24A shows an Oldham ring 870 of another example, which will be referred to as the Oldham ring 870 of an eighth embodiment. Hereinafter, the Oldham ring 870 of the eighth embodiment will be described with reference to FIG. 24A.

In FIG. 20, an example in which the main key accommodating portion 231*b* is provided in the Oldham ring accommodating portion 231*a* on the bottom of the frame end plate portion 231 of the main frame 230 and a main key 875 is provided in the Oldham ring 870 adjacent thereto is shown.

As described above, in the present disclosure, an example in which the main key accommodating portion 231*b* is provided in the main frame 230 and the main key 875 is provided in the Oldham ring 870 will be mainly described.

However, the present disclosure is not necessarily limited thereto, and an example in which the main key accommodating portion 231*b* is provided in the Oldham ring 870 and the main key 875 is provided in the main frame 230 are not completely excluded.

Unlike the previous embodiments, the Oldham ring 870 of FIG. 24A does not have an oil supply groove in the main key 875.

Meanwhile, the oil supply groove 231*c* is provided in the main key accommodating portion 231*b* of the main frame 230 in which the Oldham ring 870 of the eighth embodiment is installed.

The oil supply groove 231*c* is formed to be inclined from a point in contact with one point of the lower side provided on an outer periphery side of the Oldham ring 850 to a point in contact with one point on the upper side provided on an inner periphery of the Oldham ring 870 on one inner circumferential surface of the main key accommodating portion 231*b*.

For example, the oil supply groove 875*a* may extend to be inclined from one point of a lower side provided in the inner peripheral side of the main key accommodating portion 231*b* provided in the Oldham ring accommodating portion 231*a* of the bottom surface of the frame end plate portion 231 to one point of an upper side provided on the outer peripheral side of the main key accommodating portion 231*b*.

Referring to FIG. 24B, an example in which the inclined oil supply groove 231*c* is formed on the inner periphery of each of the main key accommodating portion 231*b* spaced apart from each other by 180 degrees on the inner periphery of the main key accommodating portion 231*b* provided in the Oldham ring accommodating portion 231*a* of the bottom surface of the frame end plate portion 231 of the main frame 230 is shown.

In addition, in FIG. 24B, an example of a plurality of oil supply grooves 231*c* inclined on a side surface of the inner periphery of one main key accommodating portion 231*b* and arranged to be spaced apart from each other is shown.

The oil supply groove 231*c* may be provided on at least one side surface of the key accommodating portion, the oil supply groove 231*c* may be inclined, the outer peripheral side of the Oldham ring 870 may be the lower end, and the inner peripheral side of the Oldham ring 870 may be the upper end.

In FIG. 24B, an example in which the oil supply grooves 231*c* are inclined on the side of the main key accommodating portion 231*b* of the main frame 230, arranged to be spaced apart from each other, and provided from a lower end of the outer peripheral side of the Oldham ring 870 to an upper end of the inner peripheral side of the Oldham ring 870 is shown.

This inclined direction is a direction rising from the inner periphery of the main key accommodating portion 231*b*, and the oil subjected to centrifugal force moves along the formation direction of the oil supply groove 231*c* on the inner periphery of the main key accommodating portion 231*b*, and at the same time, may have a structure that more facilitates the upward flow of oil in contact with the main key 875 of the Oldham ring 870.

In addition, the oil supply groove 231*c*-1 is provided on at least one side of the key accommodating portion, the oil supply groove 231*c* may be provided in a radial direction.

Figure 24C:
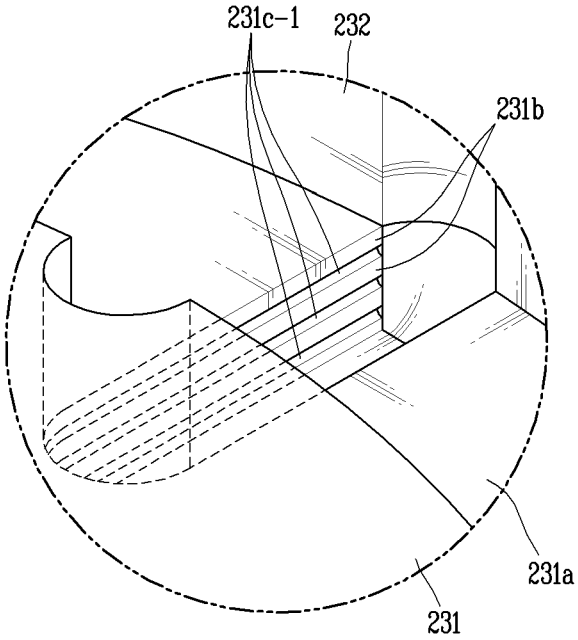
FIG. 24C is a perspective view showing the bottom of the orbiting scroll of another example on which the Oldham ring of the eighth embodiment is installed.

In FIG. 24C, an example in which the oil supply grooves 231*c*-1 are provided in the radial direction on the side of the main key accommodating portion 231*b* of the main frame 230, and spaced apart from each other is shown.

When the oil supply groove 231*c*-1 is provided in the radial direction, it may be a structure advantageous for oil retention in the main key accommodating portion 231*b*.

Due to this structure, unlike the previous embodiments, even if there is no oil supply groove in the main key 875 of the Oldham ring 870, the flow of oil in the main key 875 may be promoted by the oil supply groove 231*c* of the inner periphery of the main key accommodating portion 231*b* in contact therewith.

In other words, as the oil supply groove 231*c* inclined in the vertical direction is provided on the inner periphery of the main key accommodating portion 231*b* of the main frame 230, oil in contact with the Oldham ring 870 rises through the oil supply groove 231*c* on the inner periphery of the main key accommodating portion 231*b* according to movement of the Oldham ring 870, the flow becomes more active in the main key 875 of the Oldham ring 870 in contact therewith, the supply to the main key 875 becomes smoother, and the number of parts in contact with oil on each surface of the main key 875 increases, so that reliability may be improved.

In particular, like the Oldham ring 870 in another embodiment, the Oldham ring 870 may further include a ring body 873. The ring body 873 is provided in an annular shape, and the main key 875 may be provided to protrude from one surface of the ring body 873 toward the main key accommodating portion 231*b*.

FIG. 20 shows an example in which the main key 875 protrudes from the upper surface of the annular ring body 873 in the direction toward the frame end plate portion 231 of the main frame 230. In addition, an example in which two main keys 875 are spaced apart from each other at 180-degree interval in the shape of a rectangular parallelepiped is shown.

Unlike the Oldham rings 570, 670, and 770 in the first to third embodiments, the Oldham ring 870 of the fourth embodiment is different in that the oil supply groove 875*a* is not provided in the main key 875. Meanwhile, in the fourth embodiment, like any one of the Oldham rings 570, 670, and 770 of the first to third embodiments, an oil supply hole 872*b* may be provided. In addition, an oil supply surface portion 873*a* may be provided to protrude on the outer periphery of the ring body 873.

The oil supply surface portion 873*a* has an inclined surface 873*b*, the inclined surface 873*b* is provided to be inclined so that the oil introduced into the lower part of the Oldham ring 770 may flow to the upper part.

The inclined surface 873*b* may be parallel to the formation direction of the oil supply hole 872*b*, for example.

The oil supply surface portion 873*a* may be in the shape of a triangular prism having a predetermined width, as shown in FIG. 24A.

The oil accommodated in the Oldham ring accommodating portion 231*a* of the main frame 230 in the lower part of the Oldham ring 870 is induced to flow upwardly to be supplied to the upper surface of the ring body 873 from the outer periphery of the ring body 873 riding the inclined surface 873*b* by the oil supply surface portion 873*a* having the inclined surface 873*b*.

In addition, as the supply of oil to the upper surface of the ring body 873 is induced, the supply of oil to the inclined oil supply groove 875*a* provided in the vertical direction on one surface of the inner periphery of the main key accommodating portion 231*b* becomes more active, the supply to the main key 875 in contact therewith becomes smoother, and the number of parts in contact with oil on each surface of the main key 875 increases, so that reliability may be improved.

Also in the Oldham ring 870 shown in FIG. 24A, the oil supply hole 872*b* may be inclined in the ring body 873, and the oil supply hole 872*b* may pass through the upper and lower ends of the ring body 873 to be inclined.

In addition, the oil supply hole 872*b* may be provided so that the upper end is adjacent to the side of the main key 875

As shown in FIG. 24A, an example in which the oil supply hole 872*b* penetrates the upper surface of the ring body 873 so as to be adjacent to the left surface of the main key 875, and maintains a predetermined angle, and the oil supply hole 872*b* is inclined is shown. In addition, an example in which the oil supply hole 7872*b* is provided on the left and right sides of the main key 875 to enable the flow of oil in both directions is shown in FIG. 25.

Due to the structure in which the oil supply hole 872*b* is inclined in the ring body 873 and penetrates the upper and lower ends of the ring body 873, the oil stored in the Oldham ring accommodating portion 231*a* may flow from the lower surface of the Oldham ring 870 to the upper surface through the oil supply hole 872*b*, while the Oldham ring 870 is moved with respect to the main frame 230.

In addition, as the supply of oil to the inclined oil supply groove 231*c* formed in the vertical direction on the inner peripheral side of the main key accommodating portion 231*b* of the orbiting scroll 250 becomes more active, the supply of oil to main key in contact with the inner periphery of the main key accommodating portion 231*b* is smoother, and the number of parts in contact with oil on each surface of the main key 875 increases, so that reliability may be improved.

In particular, in the Oldham ring 870 shown in FIG. 24A, since the inclined surface 873*b* and the oil supply hole 872*b* are provided side by side, so that when the Oldham ring 870 slides to move with respect to the main frame 230, the oil at the bottom of the Oldham ring 870 may flow to the upper surface of the ring body 873 along the inclined end of the inclined surface 873*b* and the inclination angle of the oil supply hole 872*b* along the movement direction.

In addition, the main key 875 may have a protruding side portion 875*b* that further protrudes in a direction toward at least one of the outer periphery and the inner periphery of the ring body 873. The oil supply surface portion 873*a* may be connected to the protrusion side portion 875*b* to provide oil to the oil supply groove 875*a* through the upper portion of the inclined surface 873*b*. In FIG. 23, the protruding side portion 875*b* protruding in the direction toward the outer periphery of the ring body 873 and the oil supply surface portion 873*a* connected thereto are shown. The oil supply groove 875*a* may be provided to extend to the side end so as to be connected to the inclined surface 873*b* of the protruding side portion 875*b*.

Accordingly, the oil rising on the inclined surface 873*b* of the oil supply surface portion 873*a* may be more promoted to the upper part of the main key 875 of the oil through the oil supply groove 875*a* extending to the protruding side portion 875*b*.

In the scroll compressor 200 of the present disclosure, the oil supply surface portion 873*a* provided with the inclined surface 873*b* is configured in the ring body 873 and the oil supply hole 872*b* is provided in the ring body 373 as described above, and thus, it is possible to improve the actual load efficiency according to the low pressure ratio operation by securing the low pressure ratio operation reliability.

Meanwhile, the Oldham ring 870 of FIGS. 19 and 20 may further include an orbiting key 871. In addition, the orbiting scroll 250 may be provided with an orbiting key accommodating portion 255 for accommodating the orbiting key 871 to be slidably inserted.

The orbiting key 871 may be provided to protrude downward from the lower surface of the ring body 873 on the opposite side where the main key 875 is provided, for example. In addition, as shown in FIGS. 19 and 20, two orbiting keys 871 may be spaced apart from each other at a 180 degree interval and may be alternately disposed, while maintaining a 90 degree interval with the main key 875 in the circumferential direction.

The orbiting key 871 may be provided in the shape of a rectangular parallelepiped, similar to the main key 875. In addition, the orbiting key accommodating portion 255 may be radially formed to accommodate the orbiting key 871 in the orbiting scroll 250 to slide in the radial direction. An example of the orbiting key accommodating portion 255 formed in the radial direction of the orbiting scroll 250 is shown in FIG. 19, and in the drawing, an example in which the orbiting key accommodating portion 255 in the upper and lower parts is shown in the form of a groove having a predetermined width and depth.

Meanwhile, referring to FIGS. 19 and 20, a support portion 877 may be provided between the two main keys 875 on the upper surface (contact surface with the main frame 230) of the ring body 873, and the support portion 877 may also be provided between the two orbiting keys 871 on the lower surface (contact surface with the orbiting scroll 250) of the ring body 873. The support portion 877 of the upper surface of the ring body 873 may be in contact with the main frame 230, and the support portion 177 of the upper surface of the ring body 873 may be in contact with the orbiting scroll 250. The Oldham ring may slide in a radial direction while being supported between the main frame 230 and the orbiting scroll 250 by the support portions 877 provided on the upper and lower surfaces of the ring body 873, respectively.

The Oldham ring 870 has a structure in which the orbiting key 871 slides on the orbiting key accommodating portion 255 and the main key 875 slides on the main key accommodating portion 231*b*, thereby preventing rotation of the orbiting scroll 250.

Hereinafter, a scroll compressor according to another embodiment of the present disclosure will be described with reference to FIG. 26 or the following drawings.

Figure 26:
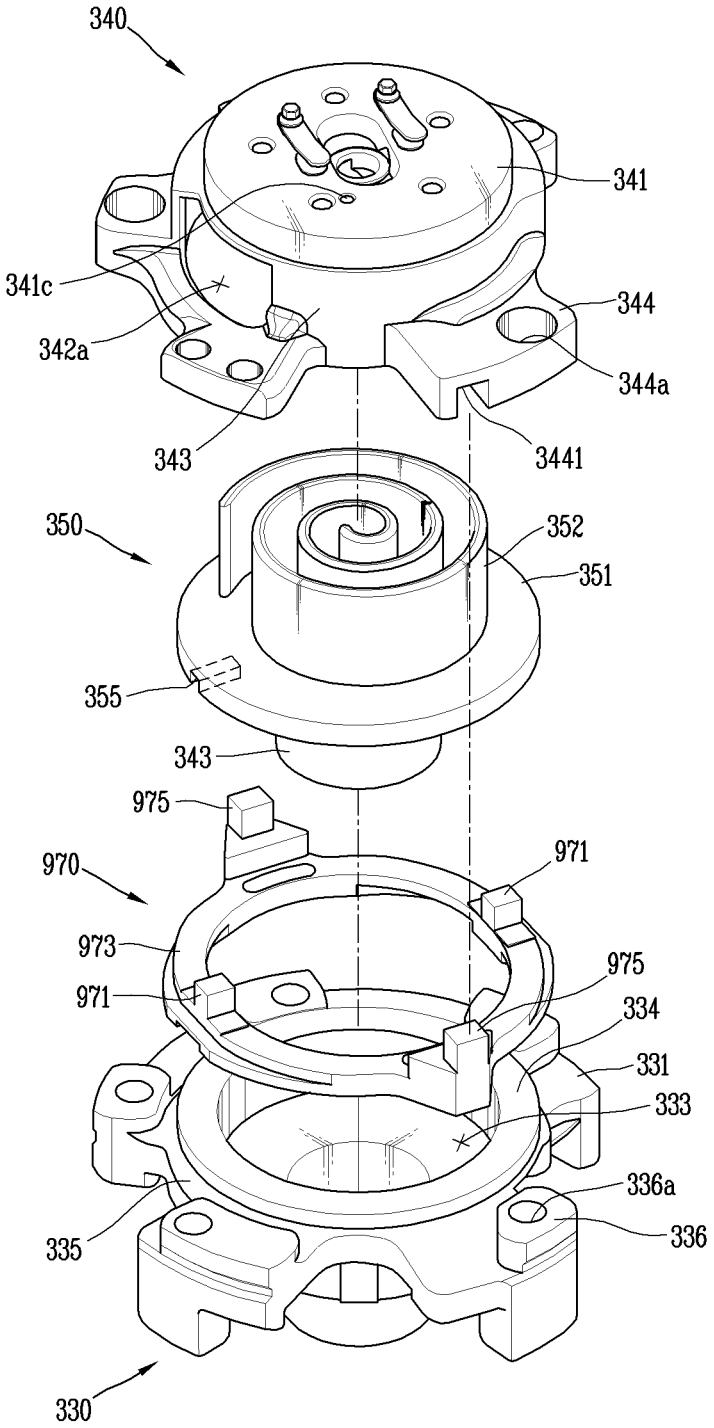
FIG. 26 is an exploded perspective view illustrating a main frame, an Oldham ring, an orbiting scroll, and a fixed scroll of a scroll compressor including a top compression type one-way Oldham ring.

The scroll compressor described below in FIG. 26 is a top compression type scroll compressor like the scroll compressor of FIG. 1, but is different from the structure described above with reference to FIG. 1 in that the key portions (orbiting key and fixed key) of the Oldham ring are all disposed on the upper surface (one-way Oldham ring).

Meanwhile, the configuration of the casing and the rotating shaft not shown in FIG. 26 or the like will be understood with reference to FIG. 1 and the like.

In addition, features not described with respect to the scroll compressor of FIG. 26 may be understood with reference to the description of FIG. 1, which is the same top compression type.

The scroll compressor of the present disclosure includes a casing 110 (FIG. 1), a main frame 330, a rotating shaft 125 (FIG. 1), an orbiting scroll 350, a fixed scroll 340, and an Oldham ring 970.

In addition, the Oldham ring 970 includes a ring body 973 and a key portion.

The ring body 973 is provided in an annular shape, is provided between the main frame 330 and the orbiting scroll 350, and is supported in the axial direction of the rotating shaft.

The key portion extends in the axial direction from the ring body 973 and is slidably inserted into a key accommodating portion provided in the orbiting scroll 350, the main frame 330, or the fixed scroll 340.

The key portion may include an orbiting key 971 and a fixed key 975 to be described later.

The key accommodating portion may include an orbiting key accommodating portion 355 and a fixed key accommodating portion 3441 to be described later.

The ring body 973 or the key portion is provided with an oil supply passage, the oil supply passage is configured to guide oil accumulated in the member on which the ring body 973 is supported between the key portion and the key accommodating portion.

The oil supply passage may be at least one of an oil supply groove 971*a*, an oil supply hole 1072*b*, and the oil supply surface portion 1273*a*, which will be described later.

Figure 27:
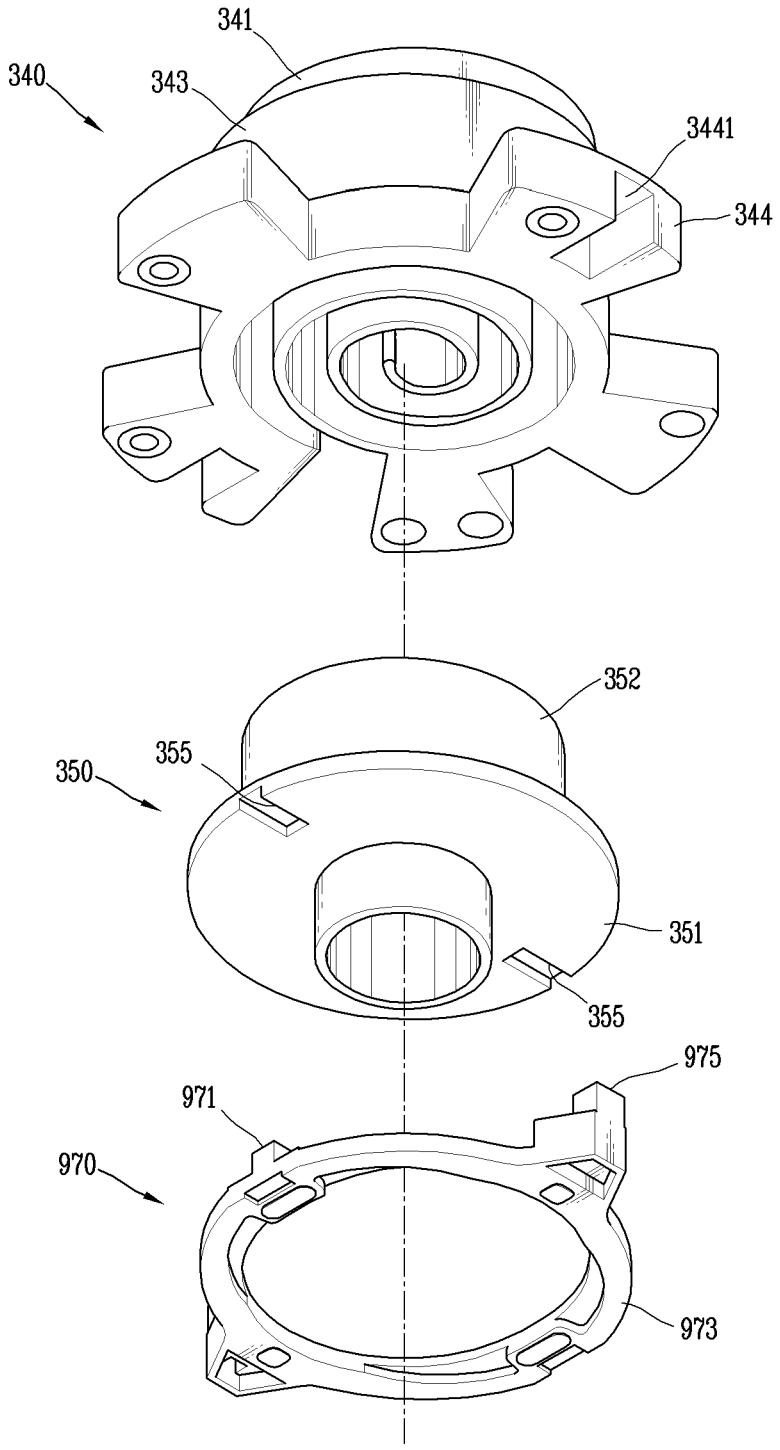
FIG. 27 is an exploded perspective view illustrating an orbiting scroll, a fixed scroll and an Oldham ring in FIG. 26.
Figure 28A:
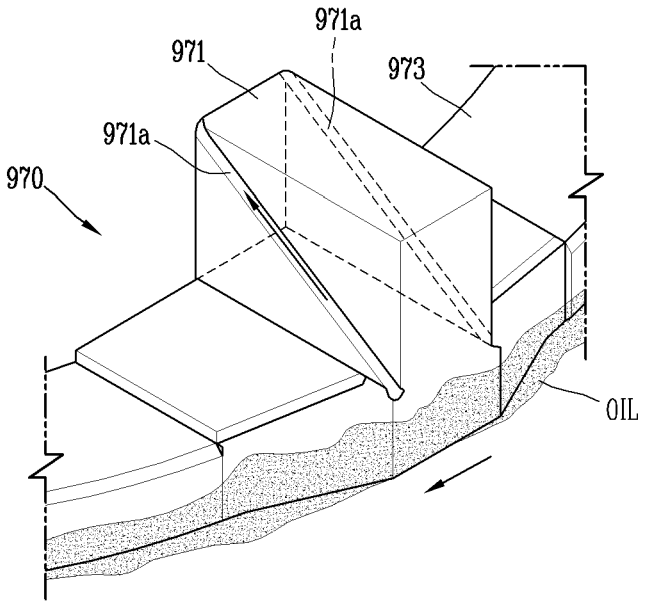
FIG. 28A is a perspective view showing an Oldham ring of a ninth embodiment.
Figure 28B:
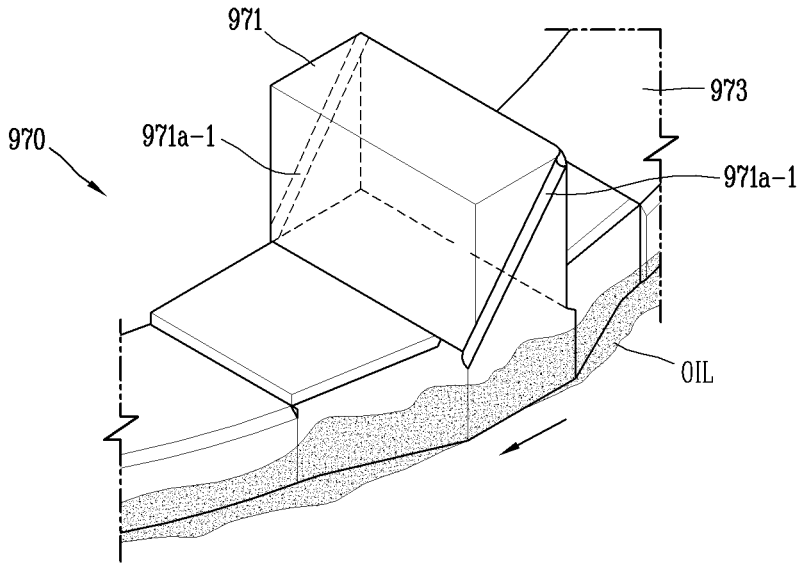
FIG. 28B is a perspective view showing an example in which oil supply grooves are provided on the inner and outer peripheral sides, as another example of the Oldham ring of the ninth embodiment.
Figure 28C:
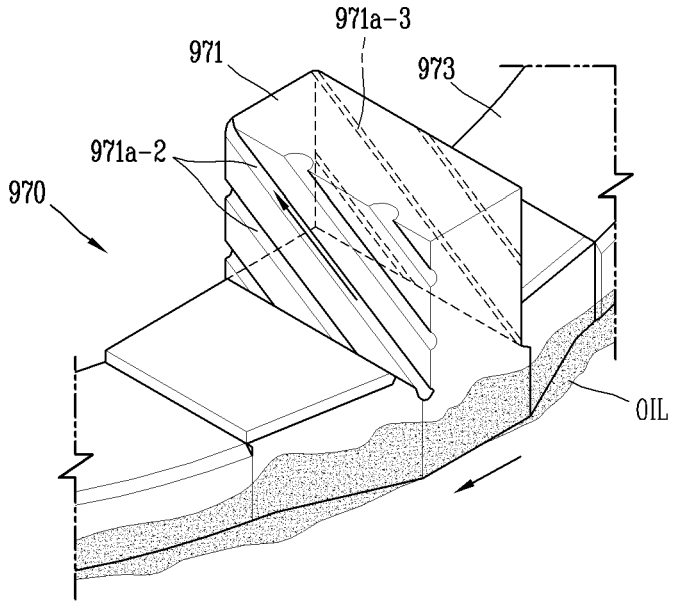
FIG. 28C is a perspective view showing different numbers of oil supply grooves having different widths on both sides as another example of the Oldham ring of the ninth embodiment.
Figure 28D:
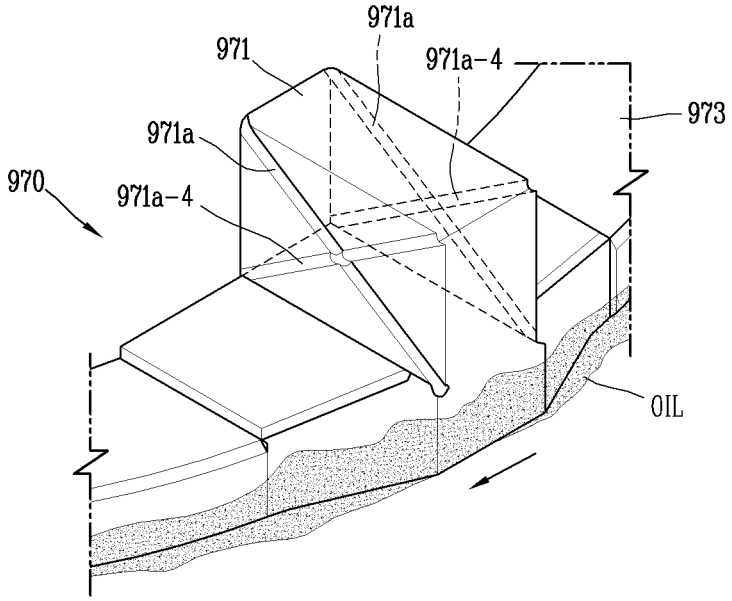
FIG. 28D is a perspective view showing oil supply grooves diagonally crossing each other on both sides as another example of the Oldham ring of the ninth embodiment.
Figure 28E:
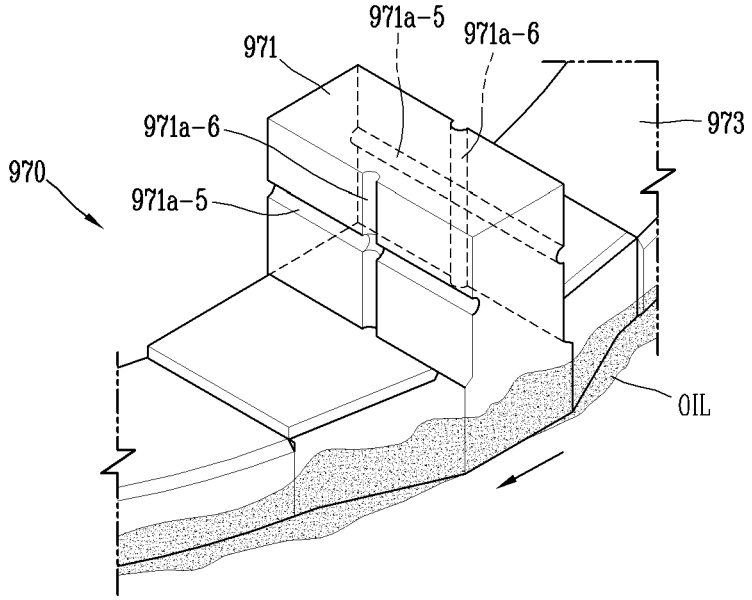
FIG. 28E is a perspective view showing oil supply grooves that cross each other in radial and axial directions on both sides as another example of the Oldham ring of the ninth embodiment.

Meanwhile, referring to FIGS. 26 and 27, the Oldham ring 970 includes an orbiting key 971 protruding from an upper surface toward the orbiting scroll 350 and a fixed key 975 protruding from the upper surface toward the fixed scroll 340. That is, the Oldham ring 970 described below in FIG. 26 may be understood as a "one-way Oldham ring" in which the orbiting key 971 and the fixed key 975 are provided on the upper surface. Meanwhile, the Oldham rings 170 and 570 described above in FIGS. 1 and 14 may be understood as "two-way Oldham rings" in which the orbiting keys 171 and 571 and the main keys 175 and 575 are divided to be disposed on the upper and lower surfaces.

Referring to FIGS. 26 and 27, the orbiting key 971 and the fixed key 975 may be disposed while maintaining an interval of approximately 90 degrees from each other in the circumferential direction.

An orbiting key accommodating portion 355 is provided on a bottom surface of the orbiting scroll 350, and a fixed key accommodating portion 3441 is provided on a bottom surface of the fixed scroll 340.

The orbiting key 971 may be slidably inserted into the orbiting key accommodating portion 355, and the fixed key 975 may be slidably coupled to the fixed key accommodating portion 3441.

Meanwhile, the fixed key accommodating portion 3441 may be provided in the form of a groove concavely provided in a guide protrusion 344 protruding from an outer periphery of the fixed scroll 340.

FIG. 27 shows an example of the fixed key accommodating portion 3441, arranged at a 180-degree interval in a circumferential direction from the guide protrusion 344 is shown.

The structures of the various oil supply grooves shown in FIGS. 28A to 28E are structurally the same as that of the oil supply groove structure described above in FIGS. 9A to 9E and only the reference numerals thereof are different, and thus, a description thereof will be replaced with the above description of FIGS. 9A to 9E.

Figure 29A:
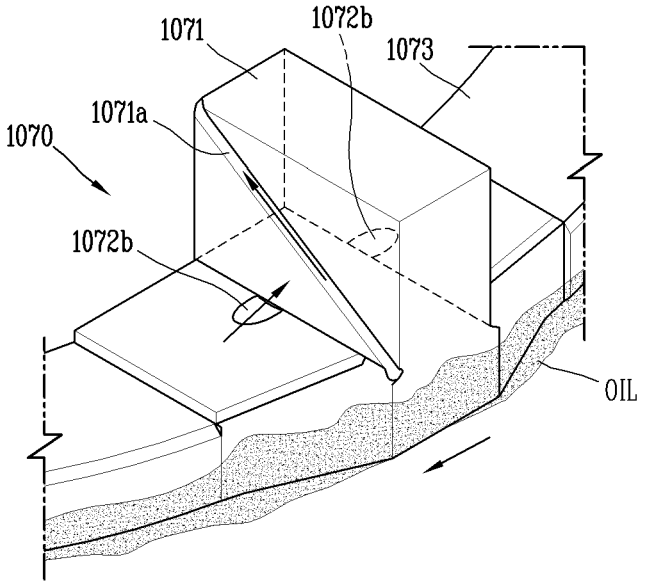
FIG. 29A is a perspective view showing an Oldham ring of a tenth embodiment.
Figure 29B:
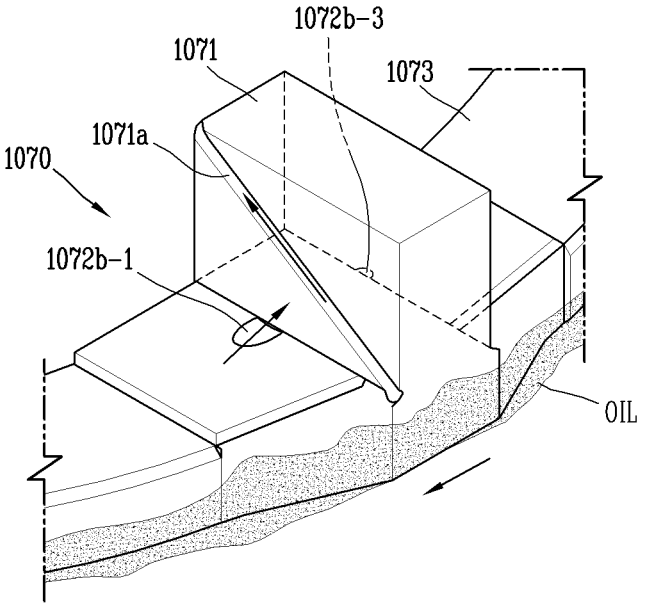
FIG. 29B is a perspective view showing another example of the Oldham ring of the tenth embodiment.
Figure 29C:
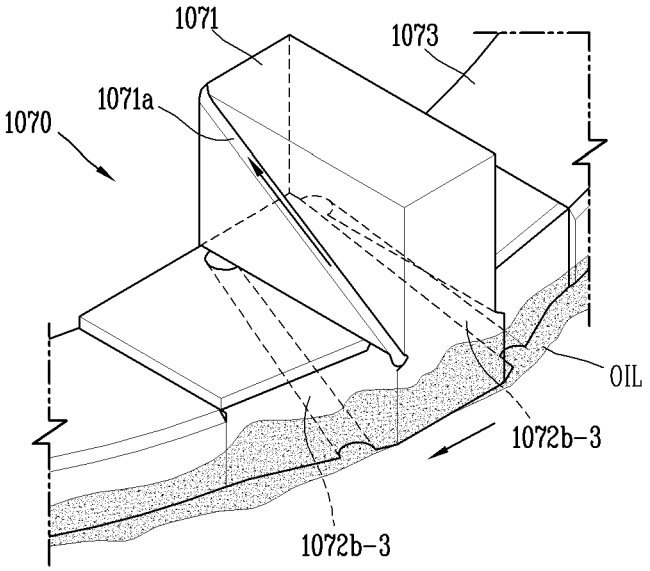
FIG. 29C is a perspective view showing another example of the Oldham ring of the tenth embodiment.
Figure 30:
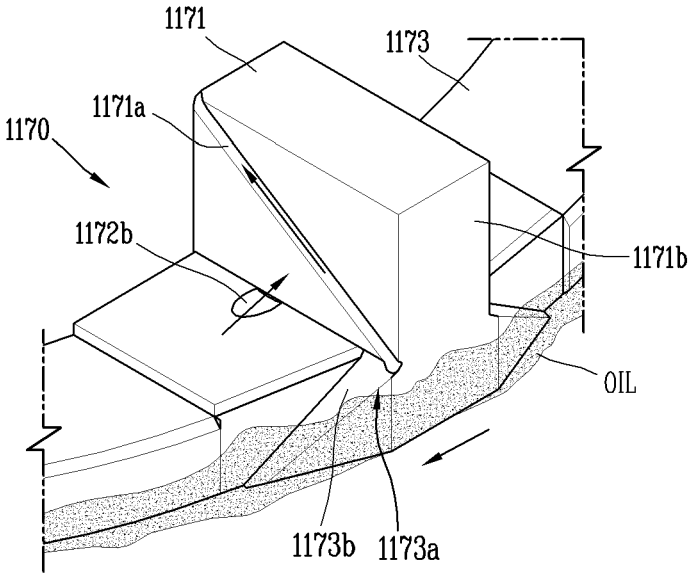
FIG. 30 is a perspective view showing an Oldham ring of an eleventh embodiment.
Figure 31A:
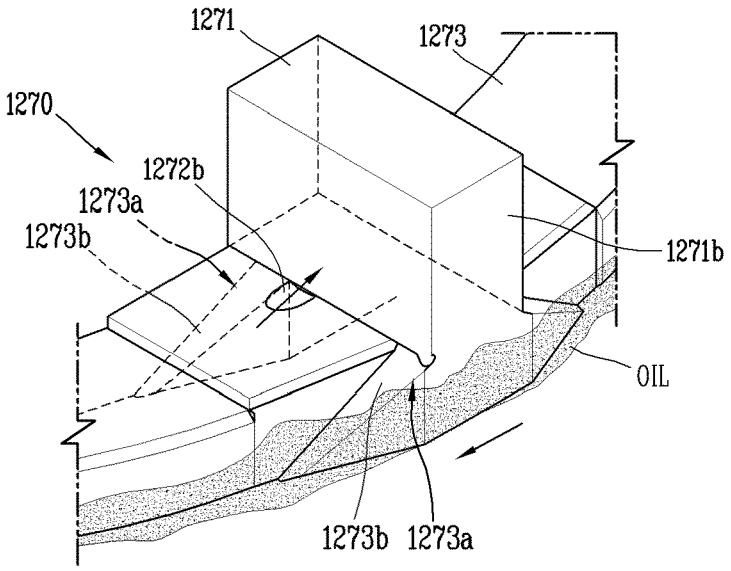
FIG. 31A is a perspective view showing an Oldham ring of a twelfth embodiment.
Figure 31B:
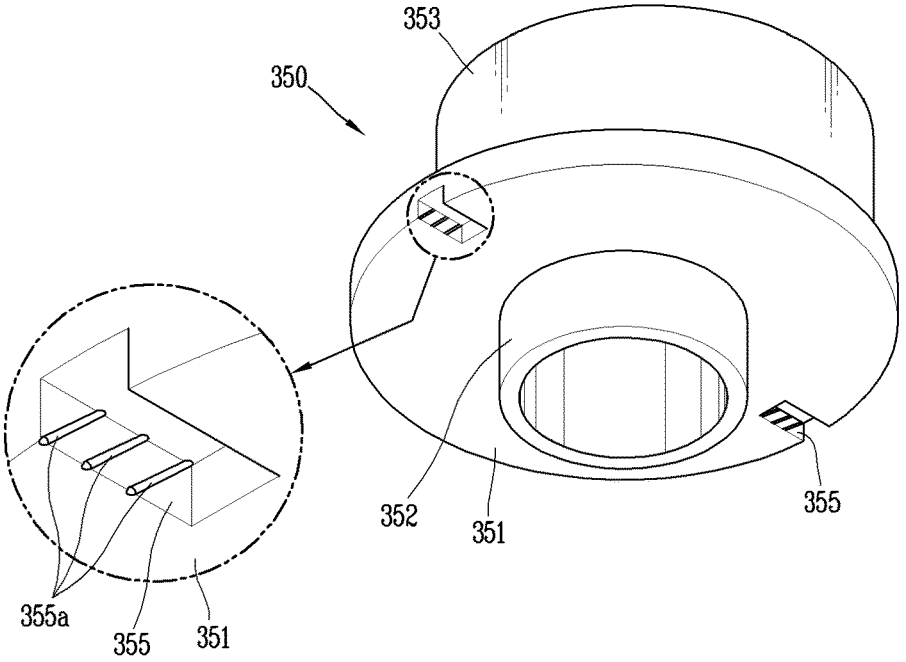
FIG. 31B is a perspective view showing a bottom of a main frame on which the Oldham ring of the twelfth embodiment is installed.
Figure 31C:
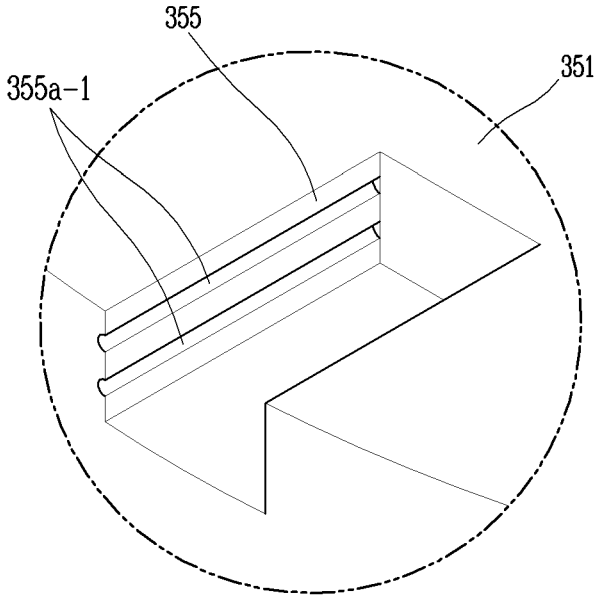
FIG. 31C is a perspective view showing a bottom of an orbiting scroll of another example on which the Oldham ring of the twelfth embodiment is installed.

In addition, the structures of the various oil supply holes and the structures of the oil supply grooves shown in FIGS. 29A to 29C are structurally the same as the structures of the various oil supply holes and the structure of the oil supply groove shown in FIGS. 10A to 10C and only the reference numerals thereof are different, and thus, a description thereof will be replaced with the above description of FIGS. 10A to 10C.

In addition, the structures shown in FIGS. 30 and 31A to 31C are also structurally the same as the structures shown in FIGS. 11 to 12C and only the reference numerals thereof are different, and thus, a description thereof will be replaced with the above description of FIGS. 11 to 12C.

In the scroll compressor of the present disclosure, the reliability may be improved because oil is more smoothly supplied to the key portion according to the movement of the Oldham ring by applying the groove structure such as the application of the inclined end of the edge portion.

In addition, in the scroll compressor of the present disclosure, the reliability may be improved because oil is more smoothly supplied to the key according to the movement of the Oldham ring by applying inclined hole machining and the oil supply groove to the key contact portion.

In addition, in the scroll compressor of the present disclosure, the low pressure ratio operation area may be expanded by forming the oil supply groove in the orbiting key of the Oldham ring and improving a related lubrication structure by providing the oil supply hole in the Oldham ring.

In addition, in the scroll compressor of the present disclosure, the actual load efficiency according to the low pressure ratio operation may be improved by securing the low pressure ratio operation reliability through the improvement of the oil supply structure as described above.

In addition, in the scroll compressor of the present disclosure, the problem of insufficient oil amount in the intermediate pressure space of the related art may be solved by adding simple machining to the Oldham ring without additional parts.

In addition, in the scroll compressor of the present disclosure, oil accommodated in the Oldham ring accommodating portion from a lower part of the Oldham ring flows upwardly from the outer periphery of the ring body along the inclined surface by the oil supply surface portion having an inclined surface, thereby inducing supply of oil to the upper surface of the ring body.

In addition, as the supply of oil to the upper surface of the ring body is induced, the supply of oil to the inclined groove provided in the vertical direction on one surface of the orbiting key of the Oldham ring becomes more active, the supply to the orbiting key becomes smoother, the number of parts in contact with oil on each side of the orbiting key may be increased, and thus, the reliability may be improved.

In addition, in the scroll compressor of the present disclosure, a groove may be provided in an inner periphery of the orbiting keyway of the orbiting scroll.

Accordingly, as the supply of oil to the upper surface of the ring body is induced, the supply of oil to the inclined groove provided in the vertical direction on the inner periphery of the orbiting keyway of the orbiting scroll becomes more active, and the number of parts in contact with oil on each side of the orbiting key in contact with the inner periphery of the orbiting keyway may be increased, and thus, the reliability may be improved.

According to the present disclosure, by the structure in which the oil supply hole is inclined in the ring body and penetrates the upper and lower ends of the ring body, the oil stored in the Oldham ring accommodating portion may flow to from the lower surface to the upper surface of the Oldham ring through the oil supply hole, when the Oldham ring moves with respect to the main frame.

In addition, according to the present disclosure, as the supply of oil to the inclined oil supply groove provided in the vertical direction on the inner periphery of the orbiting key accommodating portion of the orbiting scroll becomes more active, the supply of oil to the orbiting key in contact with the inner periphery of the orbiting key accommodating portion becomes smoother, and since the number of parts in contact with oil on each side of the orbiting key increases, the reliability may be improved.

In addition, in the present disclosure, the orbiting key may have a protruding side portion, and the oil supply surface portion may be connected to the protruding side portion to provide oil to the oil supply groove through the upper portion of the inclined surface. In addition, the oil supply groove may be provided to extend to the side end so as to be connected to the inclined surface of the protruding side portion.

Accordingly, the oil rising on the inclined surface of the oil supply surface may be more promoted to the upper part of the orbiting key of the oil through the oil supply groove extending to the protruding side portion.

In addition, the oil accommodated in the Oldham ring accommodating portion of the main frame may flow from the lower part of the Oldham ring upwardly from the outer periphery of the ring body along the inclined surface by the oil supply surface portion having an inclined surface, thereby inducing the supply of oil to the upper surface of the ring body.

According to the present disclosure, the oil supply improvement structure may be applied to the key portion of the orbiting scroll even in the bottom compression type scroll compressor, as well as in the high-pressure top compression type scroll compressor.

In addition, in the present disclosure, since the oil supply groove is provided on the outer surface, the inner surface, both sides of the key portion in the circumferential direction, it may be a structure advantageous to the oil rise in each surface.

In addition, in the present disclosure, a relatively large number of oil supply grooves or a wide width is provided on the side of the key portion disposed at the front based on the rotational direction of the rotating shaft, so that the oil flows relatively much, which is advantageous structure for oil supply.

In addition, the present disclosure, the oil supply groove is provided in parallel in the radial direction in the key portion or the key accommodating portion, providing a structure advantageous for oil retention.

In addition, in the present disclosure, the oil supply hole disposed on the front side of the rotating shaft in the rotational direction (the rotational direction of the Oldham ring) may have a larger diameter than the oil supply hole disposed on the rear side, so that a relatively large amount of oil may rise by the rotational force of the Oldham ring.

The aforementioned scroll compressor 100, 200 is not limited to the configuration and the method of the implementations described above, but the embodiments may be configured such that all or some of the embodiments are selectively combined so that various modifications may be made.

It will be apparent to those skilled in the art that the present disclosure may be embodied in other specific forms without departing from the spirit or essential characteristics thereof. The above detailed description should not be limitedly construed in all aspects and should be considered as illustrative. Therefore, all changes and modifications that fall within the metes and bounds of the claims, or equivalents of such metes and bounds are therefore intended to be embraced by the appended claims.

What is claimed is:

1. A scroll compressor comprising:

a casing;

a main frame provided at the casing;

a rotating shaft supported at the main frame;

an orbiting scroll coupled to the rotating shaft and supported by the main frame;

a fixed scroll fixed to the main frame and configured to engage the orbiting scroll and define a compression chamber; and an Oldham ring slidably coupled to the orbiting scroll and configured to restrict rotation of the orbiting scroll, wherein the Oldham ring includes:

a ring body having an annular shape and provided between the main frame and the orbiting scroll, the ring body being supported in an axial direction of the rotating shaft, a key portion extending in the axial direction from the ring body and slidably inserted into a key accommodating portion, the key accommodating portion being provided at the orbiting scroll, the main frame, or the fixed scroll, and an oil supply passage being partially defined at the ring body and partially defined at the key portion, the oil supply passage being configured to guide oil accumulated in a portion supporting the ring body to a gap between the key portion and the key accommodating portion, wherein the ring body has a first surface and a second surface opposite to the front side relative to the key portion, wherein the rotating shaft is configured to rotate in a rotation direction that is generally the same as a direction extending from the first surface to the second surface of the ring body, wherein the oil supply passage includes an oil supply hole, the oil supply hole including:

a first oil supply hole disposed at the first surface of the ring body, and a second oil supply hole disposed at the second surface of the ring body, and wherein the first oil supply hole has a larger diameter than the second oil supply hole.

2. The scroll compressor of claim 1, wherein the oil supply passage is further defined partially at the key accommodating portion, and wherein the oil supply passage includes an oil supply groove defined at (i) at least one side surface of the key portion or (ii) at least one side surface of the key accommodating portion facing the at least one side surface of the key portion.

3. The scroll compressor of claim 2, wherein the oil supply groove is provided at at least one of (i) an outer surface of the key portion in a circumferential direction or (ii) an inner surface of the key portion in the circumferential direction.

4. The scroll compressor of claim 3, wherein the oil supply groove is provided at both sides of the key portion between the outer surface of the key portion and the inner surface of the key portion.

5. The scroll compressor of claim 4, wherein the oil supply groove has a multi-stage structure that includes a plurality of oil supply grooves being spaced apart from each other at each of the both sides of the key portion.

6. The scroll compressor of claim 4, wherein the oil supply groove is inclined, wherein an outer periphery of the Oldham ring defines a lower end of the oil supply groove, and wherein an inner periphery of the Oldham ring defines an upper end of the oil supply groove.

7. The scroll compressor of claim 4, wherein the oil supply groove includes a plurality of oil supply grooves that extend across each other at each of the both sides of the key portion.

8. The scroll compressor of claim 4, wherein the oil supply groove is parallel to an extending direction of the rotating shaft.

9. The scroll compressor of claim 8, wherein the oil supply groove is further provided in a radial direction.

10. The scroll compressor of claim 3, wherein the oil supply groove is provided only at the inner surface of the key portion.

11. The scroll compressor of claim 2,
wherein the oil supply groove is inclined,
wherein a lower end of the oil supply groove meets an outer peripheral side of the Oldham ring, and
wherein an upper end of the oil supply groove meets an inner peripheral side of the Oldham ring.

12. The scroll compressor of claim 2,
wherein the oil supply groove is provided in a radial direction.

13. The scroll compressor of claim 1, wherein the oil supply hole passes through the ring body that is connected to at least one of both side surfaces of the key portion.

14. The scroll compressor of claim 13, wherein the oil supply hole extends through surfaces of the ring body that are connected to the both side surfaces of the key portion, respectively.

15. The scroll compressor of claim 13, wherein the oil supply hole is inclined in a circumferential direction.

16. The scroll compressor of claim 1, wherein the orbiting scroll and the fixed scroll are provided at an upper portion of the casing,
wherein the main frame is disposed at an opposite side of the orbiting scroll, the Oldham ring being interposed between the main frame and the orbiting scroll,
the key accommodating portion includes:
an orbiting key accommodating portion disposed at a surface of the orbiting scroll, and
a main key accommodating portion disposed at a surface of the main frame, and
wherein the key portion includes:
an orbiting key slidably inserted into the orbiting key accommodating portion at an upper surface of the ring body, and
a main key slidably inserted into the main key accommodating portion at a lower surface of the ring body.

17. The scroll compressor of claim 1, wherein the orbiting scroll and the fixed scroll are provided below the rotating shaft,
wherein the main frame is disposed at an upper surface of the orbiting scroll and disposed at an opposite side of the orbiting scroll, the Oldham ring being interposed between the main frame and the orbiting scroll,
wherein the key accommodating portion includes:
a main key accommodating portion provided at a surface of the main frame, and
an orbiting key accommodating portion provided at a surface of the orbiting scroll, and
wherein the key portion includes:
a main key slidably inserted into the main key accommodating portion at an upper surface of the ring body, and
an orbiting key slidably inserted into the orbiting key accommodating portion at a lower surface of the ring body.

18. The scroll compressor of claim 1, wherein the orbiting scroll and the fixed scroll are provided at an upper portion of the casing,
wherein the main frame is disposed at an opposite side of the orbiting scroll, the Oldham ring being interposed between the main frame and the orbiting scroll,
wherein the key accommodating portion includes:
an orbiting key accommodating portion provided at a surface of the orbiting scroll, and
a fixed key accommodating portion provided at a surface of the fixed scroll, and
wherein the key portion includes:
an orbiting key slidably inserted into the orbiting key accommodating portion at an upper surface of the ring body, and
a fixed key being spaced apart from the orbiting key at the upper surface of the ring body and slidably inserted into the fixed key accommodating portion.

19. A scroll compressor comprising:
a casing;
a main frame provided at the casing;
a rotating shaft supported at the main frame;
an orbiting scroll coupled to the rotating shaft and supported by the main frame;
a fixed scroll fixed to the main frame and configured to engage the orbiting scroll and define a compression chamber; and
an Oldham ring slidably coupled to the orbiting scroll and configured to restrict rotation of the orbiting scroll,
wherein the Oldham ring includes:
a ring body having an annular shape and provided between the main frame and the orbiting scroll, the ring body being supported in an axial direction of the rotating shaft,
a key portion extending in the axial direction from the ring body and slidably inserted into a key accommodating portion, the key accommodating portion being provided at the orbiting scroll, the main frame, or the fixed scroll, and
an oil supply passage being partially defined at the ring body and partially defined at the key portion, the oil supply passage being configured to guide oil accumulated in a portion supporting the ring body to a gap between the key portion and the key accommodating portion,
wherein the oil supply passage is further defined partially at the key accommodating portion, and wherein the oil supply passage includes an oil supply groove defined at (i) at least one side surface of the key portion or (ii) at least one side surface of the key accommodating portion facing the at least one side surface of the key portion,
wherein the key portion has a first side and a second side opposite to the first side,
wherein the rotating shaft is configured to rotate in a rotational direction that is generally the same as a direction extending from the first side to the second side of the key portion,
wherein the oil supply groove includes:
a first side oil supply groove disposed at the first side of the key portion; and
a second side oil supply groove disposed at the second side of the key portion, and
wherein the first side oil supply groove has a greater number or greater width than the second side oil supply groove.

20. A scroll compressor comprising:
a casing;
a main frame provided at the casing;
a rotating shaft supported at the main frame;
an orbiting scroll coupled to the rotating shaft and supported by the main frame;

a fixed scroll fixed to the main frame and configured to engage the orbiting scroll and define a compression chamber; and an Oldham ring slidably coupled to the orbiting scroll and configured to restrict rotation of the orbiting scroll, wherein the Oldham ring includes:

a ring body having an annular shape and provided between the main frame and the orbiting scroll, the ring body being supported in an axial direction of the rotating shaft, a key portion extending in the axial direction from the ring body and slidably inserted into a key accommodating portion, the key accommodating portion being provided at the orbiting scroll, the main frame, or the fixed scroll, and an oil supply passage being partially defined at the ring body and partially defined at the key portion, the oil supply passage being configured to guide oil accumulated in a portion supporting the ring body to a gap between the key portion and the key accommodating portion, wherein the oil supply passage includes an oil supply surface portion protruding in a radial direction from at least one of an inner periphery of the ring body or an outer periphery of the ring body, the oil supply surface portion having an inclined surface, wherein oil supply grooves are provided at an outer surface of the key portion and an inner surface of the key portion, wherein the key portion includes a protruding side portion protruding radially from at least one of the outer periphery of the ring body or the inner periphery of the ring body and connected to the oil supply surface portion, and wherein a lower end of the oil supply grooves is connected to an upper portion of the inclined surface.

* * * * *